US007851114B2

(12) United States Patent
Sugino et al.

(10) Patent No.: US 7,851,114 B2
(45) Date of Patent: Dec. 14, 2010

(54) ELECTROSTATIC LATENT IMAGE BEARING MEMBER, AND IMAGE FORMING APPARATUS, PROCESS CARTRIDGE, AND IMAGE FORMING METHOD USING THE SAME

(75) Inventors: Akihiro Sugino, Numazu (JP); Takaaki Ikegami, Susono (JP); Takeshi Takada, Yokohama (JP); Kazukiyo Nagai, Numazu (JP)

(73) Assignee: Ricoh Company Limited, Tokyo (JP)

( * ) Notice: Subject to any disclaimer, the term of this patent is extended or adjusted under 35 U.S.C. 154(b) by 1045 days.

(21) Appl. No.: 11/561,983

(22) Filed: Nov. 21, 2006

(65) Prior Publication Data

US 2007/0117033 A1 May 24, 2007

(30) Foreign Application Priority Data

Nov. 21, 2005 (JP) ..... 2005-335725

(51) Int. Cl.
*G03G 15/02* (2006.01)

(52) U.S. Cl. ..... 430/58.7; 430/56; 430/58.35; 430/66; 430/124.1; 430/159

(58) Field of Classification Search ..... 430/58.7, 430/66, 159, 124, 56, 58.35; 399/159
See application file for complete search history.

(56) References Cited

U.S. PATENT DOCUMENTS 4,772,525 A 9/1988 Badesha et al.
5,578,405 A 11/1996 Ikegami et al.
5,702,855 A 12/1997 Ikegami et al.
5,723,243 A 3/1998 Sasaki et al.
5,789,128 A 8/1998 Adachi et al.
5,840,454 A 11/1998 Nagai et al.
5,846,680 A 12/1998 Adachi et al.
5,910,561 A 6/1999 Adachi et al.
5,942,363 A 8/1999 Tanaka et al.
5,976,746 A 11/1999 Tanaka et al.
6,010,810 A * 1/2000 Uesaka et al. ..... 430/58.8
6,018,014 A 1/2000 Nagai et al.
6,027,846 A 2/2000 Shimada et al.

(Continued)

FOREIGN PATENT DOCUMENTS

JP 54-9632 1/1979

(Continued)

OTHER PUBLICATIONS

U.S. Appl. No. 11/873,876, filed Oct. 17, 2007, Nakamori, et al.

(Continued)

*Primary Examiner*—Thorl Chea
(74) *Attorney, Agent, or Firm*—Oblon, Spivak, McClelland, Maier & Neustadt, L.L.P.

(57) ABSTRACT

An electrostatic latent image bearing member is provided including a substrate and a photosensitive layer located overlying the substrate, wherein the outermost layer of the electrostatic latent image bearing member includes a cross-linked resin formed from a cross-linking reaction between a charge transport polyol having a specific formula and an isocyanate compound; and the use of the electrostatic latent image bearing member in an image forming apparatus, a process cartridge, and an image forming method.

20 Claims, 7 Drawing Sheets

U.S. PATENT DOCUMENTS 6,030,736 A 2/2000 Ikegami et al.
6,045,959 A 4/2000 Katayama et al.
6,066,428 A 5/2000 Katayama et al.
6,069,224 A 5/2000 Adachi et al.
6,130,310 A 10/2000 Katayama et al.
6,172,176 B1 1/2001 Tanaka et al.
6,187,492 B1 2/2001 Ri et al.
6,187,494 B1 2/2001 Kawamura et al.
6,191,249 B1 2/2001 Tanaka et al.
6,194,535 B1 2/2001 Katayama et al.
6,210,848 B1 4/2001 Nagai et al.
6,303,736 B1 10/2001 Kawamura et al.
6,316,577 B1 11/2001 Shimada et al.
6,444,387 B2 9/2002 Ri et al.
6,486,293 B1 11/2002 Ri et al.
6,492,079 B2 12/2002 Shimada et al.
6,548,216 B2 4/2003 Kawamura et al.
6,576,386 B1 6/2003 Ri et al.
6,596,449 B2 7/2003 Shimada et al.
6,618,565 B2 9/2003 Sawai et al.
6,664,361 B2 12/2003 Sasaki et al.
6,741,821 B2 5/2004 Sugino et al.
6,777,149 B2 8/2004 Ikegami et al.
6,777,150 B2 8/2004 Suzuki et al.
6,785,500 B2 8/2004 Takahashi et al.
6,790,571 B2 9/2004 Kawamura et al.
6,806,009 B2 * 10/2004 Tanaka et al. ..... 430/66
6,816,691 B2 11/2004 Kabata et al.
6,824,939 B2 11/2004 Kurimoto et al.
6,829,450 B2 12/2004 Tamiya et al.
6,830,858 B2 12/2004 Sugino et al.
6,853,823 B2 2/2005 Sugino et al.
6,853,834 B2 2/2005 Kurimoto et al.
6,861,188 B2 3/2005 Ikegami et al.
6,899,983 B2 5/2005 Tamoto et al.
6,919,419 B2 7/2005 Ri et al.
6,936,388 B2 8/2005 Suzuki et al.
6,939,651 B2 9/2005 Li et al.
6,946,229 B2 9/2005 Suzuki et al.
6,974,654 B2 12/2005 Kawamura et al.
7,005,006 B2 2/2006 Suzuki et al.
7,010,247 B2 3/2006 Suzuki et al.
7,018,755 B2 3/2006 Ikegami et al.
7,027,759 B2 4/2006 Kabata et al.
7,031,650 B2 4/2006 Kurimoto et al.
7,056,633 B2 6/2006 Kawamura et al.
7,056,635 B2 6/2006 Tanaka et al.
7,071,285 B2 7/2006 Kawamura et al.
7,112,392 B2 9/2006 Shimada et al.
7,122,284 B2 10/2006 Kawamura et al.
2003/0118359 A1 6/2003 Ogiyama et al.
2004/0053152 A1 3/2004 Nagai et al.
2004/0115551 A1 6/2004 Sugiyama et al.
2004/0180280 A1 9/2004 Ikegami et al.
2004/0248024 A1 12/2004 Suzuki et al.
2004/0253527 A1 12/2004 Suzuki et al.
2004/0265721 A1 12/2004 Matsuoka et al.
2005/0003291 A1 1/2005 Takada et al.
2005/0008957 A1 1/2005 Ikegami et al.
2005/0008961 A1 1/2005 Takada et al.
2005/0026058 A1 2/2005 Kami et al.
2005/0026066 A1 2/2005 Tanaka et al.
2005/0031980 A1 2/2005 Inoue et al.
2005/0042534 A1 2/2005 Tanaka et al.
2005/0053853 A1 3/2005 Sugino et al.
2005/0118518 A1 6/2005 Ikegami et al.
2005/0130050 A1 6/2005 Takada et al.
2005/0158641 A1 7/2005 Yanagawa et al.
2005/0170272 A1 8/2005 Suzuki et al.
2005/0201778 A1 9/2005 Takada et al.
2005/0221210 A1 10/2005 Suzuki et al.
2005/0266328 A1 12/2005 Yanagawa et al.
2006/0014093 A1 1/2006 Li et al.
2006/0056893 A1 3/2006 Kurimoto et al.
2006/0078809 A1 4/2006 Nagai et al.
2006/0122303 A1 6/2006 Li et al.
2006/0127116 A1 6/2006 Ogiyama et al.
2006/0141378 A1 6/2006 Takada et al.
2006/0160003 A1 7/2006 Nagai et al.
2006/0199092 A1 9/2006 Sugino et al.
2007/0254224 A1 * 11/2007 Sugino ..... 430/58.35

FOREIGN PATENT DOCUMENTS

JP 54-11737 1/1979
JP 57-78402 5/1982
JP 59-11603 3/1984
JP 59-18696 4/1984
JP 61-20953 1/1986
JP 61-296358 12/1986
JP 63-39899 8/1988
JP 64-88461 4/1989
JP 1-134456 5/1989
JP 1-134457 5/1989
JP 1-179164 7/1989
JP 2-123370 5/1990
JP 2-282264 11/1990
JP 2-304456 12/1990
JP 4-264130 9/1992
JP 4-264131 9/1992
JP 4-264132 9/1992
JP 4-264133 9/1992
JP 4-289867 10/1992
JP 5-40350 2/1993
JP 6-234836 8/1994
JP 6-234837 8/1994
JP 6-234840 8/1994
JP 6-234841 8/1994
JP 7-10912 2/1995
JP 2509292 4/1996
JP 2546739 8/1996
JP 2591793 12/1996
JP 2596588 1/1997
JP 9-127713 5/1997
JP 9-211877 8/1997
JP 9-304956 11/1997
JP 2775893 5/1998
JP 2805867 7/1998
JP 2847827 11/1998
JP 2847828 11/1998
JP 2852464 11/1998
JP 2889652 2/1999
JP 2958100 7/1999
JP 2958101 7/1999
JP 2000-171990 6/2000
JP 3096354 8/2000
JP 3124784 10/2000
JP 3164426 3/2001
JP 3183353 4/2001
JP 3189914 5/2001
JP 3224031 8/2001
JP 3252241 11/2001
JP 3258397 12/2001
JP 2002-006517 1/2002
JP 3267519 1/2002
JP 2003-186223 7/2003
JP 3527817 2/2004
JP 2004-117766 4/2004

| | | |
|---|---|---|
| JP | 3549350 | 4/2004 |
| JP | 2004-309940 | 11/2004 |
| JP | 3640444 | 1/2005 |
| JP | 2005-115347 | 4/2005 |

OTHER PUBLICATIONS

U.S. Appl. No. 11/876,396, filed Jan. 22, 2007, Nakamori, et al.
U.S. Appl. No. 12/000,239, filed Dec. 11, 2007, Fujiwara, et al.
U.S. Appl. No. 11/486,087, filed Jul. 14, 2006, Sugino, et al.
U.S. Appl. No. 12/030,886, filed Feb. 14, 2008, Toda, et al.
U.S. Appl. No. 11/696,738, filed Apr. 5, 2007, Sugino.
U.S. Appl. No. 11/868,618, filed Oct. 8, 2007, Sugiyama, et al.
Japanese Office Action.

* cited by examiner

ELECTROSTATIC LATENT IMAGE BEARING MEMBER, AND IMAGE FORMING APPARATUS, PROCESS CARTRIDGE, AND IMAGE FORMING METHOD USING THE SAME

BACKGROUND OF THE INVENTION

1. Field of the Invention

The present invention relates to an electrostatic latent image bearing member for use in electrophotography. In addition, the present invention relates to an image forming apparatus, a process cartridge, and an image forming method using the electrostatic latent image bearing member.

2. Discussion of the Background

In image forming apparatuses using electrophotography (such as copiers, printers, facsimiles), an image is typically formed as follows:

(1) a uniformly charged photoreceptor (i.e., electrostatic latent image bearing member) is irradiated by a light containing image information to form an electrostatic latent image thereon;

(2) a developing means supplies a toner to the electrostatic latent image to form a toner image on the photoreceptor;

(3) the toner image formed on the photoreceptor is transferred onto a recording medium (e.g., recording paper);

(4) a fixing means fixes the toner image onto the recording medium upon application of heat and pressure thereto; and (5) residual toner particles remaining on the surface of the photoreceptor are removed with a cleaning blade and collected.

In such electrophotographic image forming apparatuses, organic photoreceptors including an organic photoconductive material are widely used. Organic photoreceptors have the following advantages:

(1) capable of using materials responsive to various light (e.g., visible light, infrared light) irradiators, which are easily developed;

(2) capable of using environment-friendly materials; and (3) low manufacturing cost.

On the other hand, organic photoreceptors have poor mechanical strength, and therefore photosensitive layers thereof are abraded after long repeated use. When a specific amount of the photosensitive layer is abraded, the electrical property of the photoreceptor changes, and therefore a proper image forming process cannot be performed. The photoreceptor is abraded due to the friction between the photoreceptor and all image forming members (such as developing means, transfer means) which are in contact with the photoreceptor in an image forming process.

Various attempts have been made to prevent the photoreceptor from being abraded so as to lengthen the life thereof. For example, Japanese Patent No. (hereinafter referred to as JP) 3258397 discloses a photoreceptor having a protective layer including a hardened silicone resin containing a colloidal silica. It is described therein that such a protective layer has good abrasion resistance. However, fogging and blurring tend to appear in produced images after long repeated use because such a photoreceptor has insufficient electrophotographic property. Such a photoreceptor cannot satisfy the recent demands for a long-life photoreceptor having good durability.

JP 3640444 discloses a resin manufacturing method in which an organosilicon polymer is hardened in the presence of an organosilicon-modified positive hole transport compound. JP 3267519 discloses a photoreceptor having an outermost layer including a resin prepared by the above method. Such a photoreceptor tends to produce blurred images, and therefore an image-blurring-preventing mechanism such as a drum heater needs to be mounted on the machine used, resulting in upsizing of the machine and increasing the manufacturing cost. In addition, residual potential of the irradiated portion of the photoreceptor is hardly reduced, and therefore image density tends to decrease when the photoreceptor is particularly used for low potential developing processes.

Published unexamined Japanese Patent Application No. (hereinafter referred to as JP-A) 2000-171990 discloses a photoreceptor having a resin layer including a hardened siloxane resin having a charge transport group, which has a three-dimensional network structure. In such a photoreceptor, cracks tend to appear on the layer due to volume contraction of the resin, especially when low-priced and easy-to-handle commercially available coating agents are used in combination. In addition, residual potential of the irradiated portion of the photoreceptor depends on the layer thickness. Moreover, image density tends to decrease when the photoreceptor is used for low potential developing processes. When the content of the charge transport group increases, the layer strength decreases, and therefore durability of the photoreceptor deteriorates. Such a photoreceptor tends to produce blurred images after long repeated use. It is difficult to easily obtain a photoreceptor in low cost which can produce high quality images for a long period of time.

JP-A 2003-186223 discloses a photoreceptor having a protective layer including a charge transport material having at least one hydroxyl group, a three-dimensional cross-linked resin, and a particulate conductive material. It is described therein that such a photoreceptor has good abrasion resistance, and residual potential can be decreased to some extent. However, the particulate conductive material decreases volume resistance of the protective layer, and therefore blurred images tend to be produced due to blurred electrostatic latent images, especially under high temperature and high humidity conditions. Since the charge transport material may be a constitutional unit of the three-dimensional structure, as the amount of the charge transport material included in the protective layer increases, the effect of the molecular structure thereof (i.e., the number and the binding site of hydroxyl group) on abrasion resistance of the protective layer increases. In some cases, the resultant photoreceptor has insufficient abrasion resistance.

JP-A 2004-117766 discloses a photoreceptor having a protective layer including a urethane resin which is obtained by cross-linking plural polyols and a polyisocyanate. It is described therein that such a photoreceptor has good abrasion resistance. When an underlying layer (i.e., a recording layer) of the protective layer includes a polycarbonate, the adhesion between the protective layer and the underlying layer is not always sufficient. In this case, the protective layer tends to peel off from the edge of the photoreceptor or the portion on which scratches were made by carriers and paper powders, and therefore the underlying layer is exposed. Since a portion at which the underlying layer is exposed has charging property and light attenuation property different from those of an unexposed portion, abnormal images such as color unevenness tend to be produced.

When the thickness of the protective layer decreases due to abrasion, the protective layer easily peels off and disappears, resulting in reducing the life of the photoreceptor. In order to improve durability of the photoreceptor, the protective layer needs to have a large thickness. In this case, residual potential of the irradiated portion of the photoreceptor increases. When the residual potential is too high, potential gradation of the irradiated portion of the photoreceptor tends to deteriorate, and image density tends to decrease.

By the way, spherical polymerization toners come into practical use so as to respond to recent demands for producing high quality images. It is generally known that spherical polymerization toners remaining on a photoreceptor are difficult to remove with a cleaning blade made of a urethane rubber, compared to conventional pulverization toners. In attempting to solve this problem, a technique in which a contact pressure of the cleaning blade is increased to remove toner particles is proposed. However, this technique accelerates abrasion of the photoreceptor and promotes peeling of the protective layer. Because of these reasons, a need exists for a photoreceptor having a durable protective layer which hardly peels off, which can be used for electrophotographic image forming processes using a polymerization toner.

SUMMARY OF THE INVENTION

Accordingly, an object of the present invention is to provide an electrostatic latent image bearing member having good abrasion resistance, electrophotographic property, and durability.

Another object of the present invention is to provide an image forming apparatus, a process cartridge, and an image forming method which can stably produce high quality images for a long period of time.

These and other objects of the present invention, either individually or in combinations thereof, as hereinafter will become more readily apparent can be attained by an electrostatic latent image bearing member, comprising:

a substrate; and a photosensitive layer located overlying the substrate, wherein an outermost layer of the electrostatic latent image bearing member comprises a cross-linked resin formed from a cross-linking reaction between a charge transport polyol having the following formula (1) and an isocyanate compound:

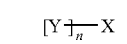

(1)

wherein Y represents a substituted or unsubstituted alkyl group or alkoxy group having 2 to 6 carbon atoms, wherein 2 carbon atoms are each bound to a hydroxyl group; X represents an organic residue group comprising a hydrocarbon bond having 1 to 4 valences, which has a charge transport molecular structure; and n represents an integer of from 1 to 4;

and an image forming apparatus, a process cartridge, and an image forming method using the electrostatic latent image bearing member.

BRIEF DESCRIPTION OF THE DRAWINGS

These and other objects, features and advantages of the present invention will become apparent upon consideration of the following description of the preferred embodiments of the present invention taken in conjunction with the accompanying drawings, wherein.

DETAILED DESCRIPTION OF THE INVENTION

Figure 1:
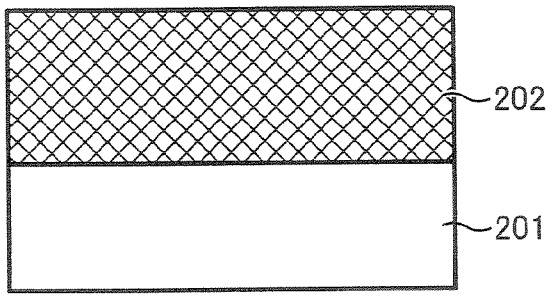
FIGS. 1 to 6 are schematic views illustrating cross-sections of embodiments of the electrostatic latent image bearing member of the present invention.

Generally, the present invention provides an electrostatic latent image bearing member comp sing a substrate and a photosensitive layer located overlying the substrate, wherein an outermost layer of the electrostatic latent image bearing member comprises a cross-linked resin formed from a cross-linking reaction between a charge transport polyol having the following formula (1) and an isocyanate compound:

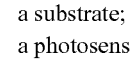

(1)

wherein Y represents a substituted or unsubstituted alkyl group or alkoxy group having 2 to 6 carbon atoms, wherein 2 carbon atoms are each bound to a hydroxyl group; X represents an organic residue group comprising a hydrocarbon bond having 1 to 4 valences, which has a charge transport molecular structure; and n represents an integer of from 1 to 4.

Specific examples of the unsubstituted alkyl groups having 2 to 6 carbon atoms include, but are not limited to, ethyl group, propyl group, butyl group, pentyl group, hexyl group, isopropyl group, isobutyl group, etc.

Specific examples of the unsubstituted alkoxy groups having 2 to 6 carbon atoms include, but are not limited to, alkoxy groups including the above unsubstituted alkyl groups having 2 to 6 carbon atoms such as ethoxy group, propoxy group, butoxy group, pentyloxy group, hexyloxy group, isopropoxy group, and isobutyloxy group.

Specific examples of the substituent groups include, but are not limited to, halogen atom, nitro group, nitrile group, alkoxy groups (e.g., methoxy group, ethoxy group), aryloxy groups (e.g., phenoxy group), aryl groups (e.g., phenyl group, naphthyl group), aralkyl groups (e.g., benzyl group, phenethyl group), etc.

In the formula (1), X represents an organic residue group comprising a hydrocarbon bond having 1 to 4 valences, which has an electron donating or electron accepting charge transport molecular structure.

Specific examples of the electron donating charge transport molecular structures include, but are not limited to, positive-hole transport compounds such as triphenylamine derivatives, oxazole derivatives, oxadiazole derivatives, imidazole derivatives, 9-(p-diethylaminostyrylanthracene), 1,1-bis-(4-dibenzylaminophenyl)propane, styrylanthracene, styrylpyrazoline, phenylhydrazone, α-phenylstilbene derivatives, thiazole derivatives, triazole derivatives, phenazine derivatives, acridine derivatives, benzofuran derivatives, benzimidazole derivatives, and thiophene derivatives.

Specific examples of the electron accepting charge transport molecular structures include, but are not limited to, electron transport materials such as chloranil, bromanil, tetracyanoethylene, tetracyanoquinodimethane, 2,4,7-trinitro-9-fluorenon, 2,4,5,7-tetranitro-9-fluorenon, 2,4,5,7-tetranitroxanthone, 2,4,8-trinitrothioxanthone, 2,6,8-trinitro-4H-indeno[1,2-b]thiophene-4-one, and 1,3,7-trinitrodibenzothiophene-5,5-dioxide.

Among these, positive-hole transport materials having nitrogen atom (e.g., triarylamine structure) are preferably used because of having good charge transport ability.

Such a cross-linked resin can impart a good combination of charge transport ability and abrasion resistance to the resultant electrostatic latent image bearing member. In particular, the electrostatic latent image bearing member has the following advantages:

(1) good abrasion resistance because of good abrasion resistance of the resin;
(2) sensitivity does not deteriorate;
(3) residual potential can be reduced;
(4) fogged images, blurred images, and images having uneven image density are not produced; and
(5) image density does not decrease.

Such a durable electrostatic latent image bearing member having good electrophotographic property can stably produce high quality images for a long period of time. When the layer (i.e., recording layer) located underlying the outermost layer (i.e., protective layer) includes a polycarbonate, adhesion between the protective layer and the underlying layer improves.

In particular, it is preferable that the 2 carbon atoms, each bound to a hydroxyl group, are adjacent to each other. In this case, the resultant electrostatic latent image bearing member has better abrasion resistance.

When the 2 carbon atoms, each bound to a hydroxyl group, are adjacent to each other, each of the hydroxyl groups independently cross-links with an independent isocyanate. As a result, each of the 2 resultant urethane bonds is bound to an independent carbon atom being adjacent to each other (i.e., C—C bond). In this case, the charge transport molecular structure of the charge transport polyol is not present in the main chain thereof, and is suspended from the main chain. For this reason, steric strain of the charge transport polyol hardly occurs. Since the main chain of the polyurethane chain includes the minimum amount of carbon atoms, network structures are densely formed, and therefore abrasion resistance of the electrostatic latent image bearing member improves. The above-mentioned charge transport polyol can impart a good combination of electrophotographic property and abrasion resistance to the electrostatic latent image bearing member without deteriorating charge transport ability.

In particular, the charge transport polyol mentioned above preferably has the following formula (2):

(2)

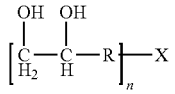

wherein R represents a substituted or unsubstituted alkylene group or oxyalkylene group having 1 to 4 carbon atoms; X represents an organic residue group comprising a hydrocarbon bond having 1 to 4 valences, which has a charge transport molecular structure; and n represents an integer of from 1 to 4.

Specific examples of the unsubstituted alkylene groups having 1 to 4 carbon atoms include, but are not limited to, divalent groups such as methyl group, ethyl group, propyl group, and butyl group.

Specific examples of the unsubstituted oxyalkylene groups having 1 to 4 carbon atoms include, but are not limited to, oxyalkylene groups derived from the above substituted or unsubstituted alkylene groups.

Specific examples of the substituent groups include, but are not limited to, halogen atom, nitro group, nitrile group, alkoxy groups (e.g., methoxy group, ethoxy group), aryloxy groups (e.g., phenoxy group), aryl groups (e.g., phenyl group, naphthyl group), aralkyl groups (e.g., benzyl group, phenethyl group), etc.

When 2 adjacent carbon atoms, each of which is bound to an independent hydroxyl group, are present on the end of the molecule of the charge transport polyol, the resultant electrostatic latent image bearing member has better abrasion resistance. This is because these 2 hydroxyl groups can form a conformation in which steric hindrance thereof is minimized, and therefore the hydroxyl groups can easily react. As a result, a very small amount of unreacted hydroxyl group may remain after being subjected to the cross-linking reaction, and therefore an outermost layer having high cross-linking density can be formed without deteriorating the electrophotographic property of the resultant electrostatic latent image bearing member. Thus, an electrostatic latent image bearing member having good abrasion resistance and electrophotographic property can be obtained.

It is preferable that X is an organic residue group having 1 to 4 valences, which is derived from a charge transport molecular structure having the following formula (3):

(3)

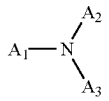

wherein at least one of $A_1$, $A_2$, and $A_3$ is bound to Y in the formula (1) or R in the formula (2), wherein any one of which bound to Y or R represents a substituted or unsubstituted arylene group, aralkylene group, or alkylene group, and the others independently represents a substituted or unsubstituted aryl group, aralkyl group, or alkyl group.

It is also preferable that X is an organic residue group having 1 to 4 valences, which is derived from a charge transport molecular structure having the following formula (4):

(4)

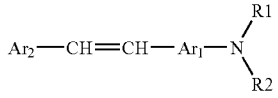

wherein at least one of $R_1$, $R_2$, and $Ar_2$ is bound to Y in the formula (1) or R in the formula (2), wherein any one of which bound to Y or R represents a substituted or unsubstituted arylene group, aralkylene group, or alkylene group, and the others independently represents a substituted or unsubstituted aryl group, aralkyl group, or alkyl group; and $Ar_1$ represents a substituted or unsubstituted arylene group.

It is also preferable that X is an organic residue group having 1 to 4 valences, which is derived from a charge transport molecular structure having the following formula (5):

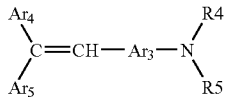

(5)

wherein at least one of $Ar_4$, $Ar_5$, $R_4$, and $R_5$ is bound to Y in the formula (1) or R in the formula (2), wherein any one of which bound to Y or R represents a substituted or unsubstituted arylene group, aralkylene group, or alkylene group, and the others independently represents a substituted or unsubstituted aryl group, aralkyl group, or alkyl group; and $Ar_3$ represents a substituted or unsubstituted arylene group.

It is also preferable that X is an organic residue group having 1 to 4 valences, which is derived from a charge transport molecular structure having the following formula (6):

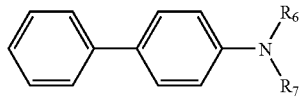

(6)

wherein at least one of biphenylyl, $R_6$, and $R_7$ is bound to Y in the formula (1) or R in the formula (2); when $R_6$ or $R_7$ is bound to Y or R, any one of $R_6$ and $R_7$ bound to Y or R represents a substituted or unsubstituted arylene group, aralkylene group, or alkylene group, and the other represents a substituted or unsubstituted aryl group, aralkyl group, or alkyl group; and when biphenylyl is bound to Y or R, biphenylyl represents a biphenylidene group, and $R_6$ and $R_7$ independently represents a substituted or unsubstituted aryl group, aralkyl group, or alkyl group.

It is also preferable that X is an organic residue group having 1 to 4 valences, which is derived from a charge transport molecular structure having the following formula (7):

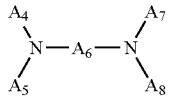

(7)

wherein at least one of $A_4$, $A_5$, $A_7$, and $A_8$ is bound to Y in the formula (1) or R in the formula (2), wherein any one of which bound to Y or R represents a substituted or unsubstituted arylene group, aralkylene group, or alkylene group, and the others independently represents a substituted or unsubstituted aryl group, aralkyl group, or alkyl group; and $A_6$ represents a substituted or unsubstituted arylene group.

In the above formulae (3) to (7), specific examples of the unsubstituted aryl groups represented by $A_1$, $A_2$, $A_3$, $R_1$, $R_2$, $Ar_2$, $Ar_4$, $Ar_5$, $R_4$, $R_5$, $R_6$, $R_7$, $A_4$, $A_5$, $A_7$, or $A_8$ which is bound to neither Y nor R include, but are not limited to, phenyl group, naphthyl group, biphenylyl group, triphenylenyl group, etc.

In the above formulae (3) to (7), specific examples of the unsubstituted aralkyl groups represented by $A_1$, $A_2$, $A_3$, $R_1$, $R_2$, $Ar_2$, $Ar_4$, $Ar_5$, $R_4$, $R_5$, $R_6$, $R_7$, $A_4$, $A_5$, $A_7$, or $A_8$ which is bound to neither Y nor R include, but are not limited to, benzyl group, etc.

In the above formulae (3) to (7), specific examples of the unsubstituted alkyl groups represented by $A_1$, $A_2$, $A_3$, $R_1$, $R_2$, $Ar_2$, $Ar_4$, $Ar_5$, $R_4$, $R_5$, $R_6$, $R_7$, $A_4$, $A_5$, $A_7$, or $A_8$ which is bound to neither Y nor R include, but are not limited to, methyl group, ethyl group, propyl group, butyl group, pentyl group, hexyl group, etc.

Specific examples of the substituent groups include, but are not limited to, halogen atom, nitro group, nitrile group, alkoxy groups (e.g., methoxy group, ethoxy group), aryloxy groups (e.g., phenoxy group), aryl groups (e.g., phenyl group, naphthyl group), aralkyl groups (e.g., benzyl group, phenethyl group), etc.

In the above formulae (3) to (7), specific examples of the unsubstituted arylene groups, aralkylene groups, or alkylene groups which are bound to either Y or R include, but are not limited to, divalent groups of the above aryl groups, aralkyl groups, and alkyl groups. Specific examples of the substituent groups include, but are not limited to, halogen atom, nitro group, nitrile group, alkoxy groups (e.g., methoxy group, ethoxy group), aryloxy groups (e.g., phenoxy group), aryl groups (e.g., phenyl group, naphthyl group), aralkyl groups (e.g., benzyl group, phenethyl group), etc.

In the formula (3), any one of $A_1$, $A_2$, and $A_3$ bound to Y or R may represent, for example, stilbenylidene group, α-phenylstilbenylidene group, etc.

In the formula (7), specific examples of the unsubstituted arylene groups represented by $A_6$ include, but are not limited to, divalent groups of the above aryl groups such as phenyl group, naphthyl group, biphenylyl group, and triphenylenyl group.

Next, specific preferred examples of suitable charge transport polyols of the present invention will be explained in detail.

A cross-linked resin, formed from a cross-linking reaction between (i) a charge transport polyol having a substituted or unsubstituted alkyl group or alkoxy group having 2 to 6 carbon atoms, wherein 2 carbon atoms each are bound to a hydroxyl group and (ii) an isocyanate compound, is a polyurethane resin having urethane bonds.

A polyurethane resin which is formed from a cross-linking reaction between a polyfunctional isocyanate compound and a polyol compound has a three-dimensional network structure, and therefore the polyurethane resin has good abrasion resistance and is preferably used as a binder resin. Some reactive charge transport materials have a disadvantage in forming three-dimensional network structure. For example, the following reactive charge transport materials (D1-1) to (D1-5) having only one hydroxyl group are not preferably used for the present invention. These reactive charge transport materials are different in structure from the charge transport polyol of the present invention.

(D1-1)

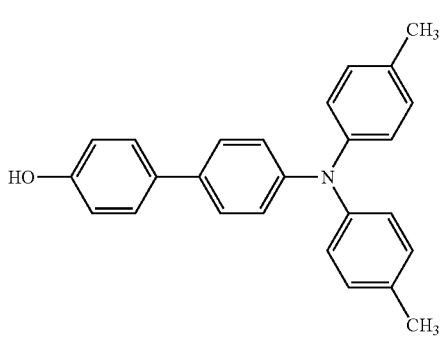

-continued (D1-2)

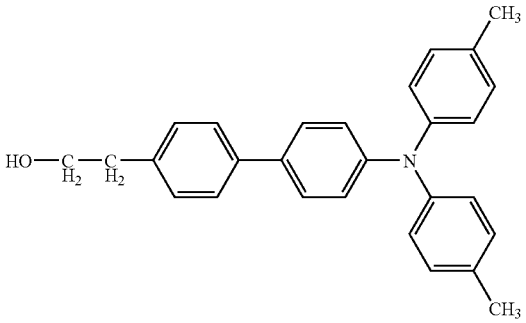

(D1-3)

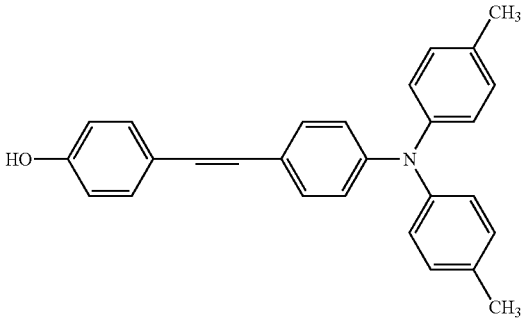

(D1-4)

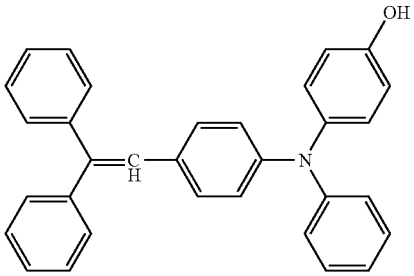

-continued (D1-5)

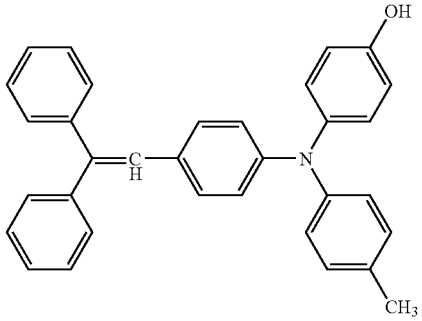

Each of the reactive charge transport materials (D1-1) to (D1-5) has only one reactive hydroxyl group. When such a reactive charge transport material is reacted with a polyfunctional isocyanate compound, the reaction product has a structure such that the reactive charge transport material unit is suspended from the end of the main skeleton (i.e., the reactive charge transport material unit forms a pendant group).

In this case, the reaction product no longer has a polymer structure. It is difficult for the reactive charge transport materials (D1-1) to (D1-5) to form a strong resin layer (i.e., polymer structure) without using some other polyol in combination. Even if another polyol is used in combination, it is inevitable that the reactive charge transport material unit is suspended from the end of the main skeleton and inhibits formation of a three-dimensional network structure in the resultant polyurethane. As a result, abrasion resistance of the electrostatic latent image bearing member largely deteriorates. When the content of the reactive charge transport material is decreased and the content of the other polyol is increased in order to prevent the above problem, other problems such as deterioration of charge transport ability and photosensitivity of the outermost layer and increase of residual potential occur. It is difficult for the electrostatic latent image bearing member to have a good balance between abrasion resistance and electrical property of the outermost layer thereof.

The following reactive charge transport materials (D2-1) to (D2-7) having 2 or more hydroxyl groups, each of which is present on different end of the molecule, are not preferably used in the present invention.

(D2-1)

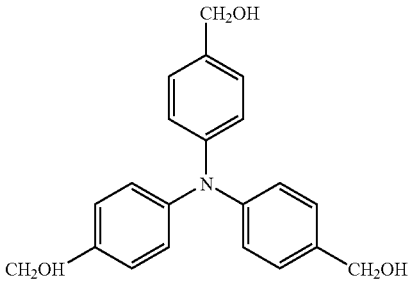

(D2-2)

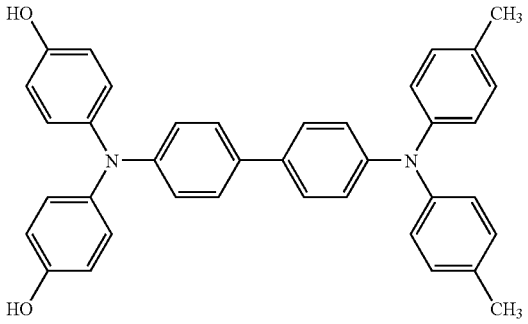

-continued (D2-3)

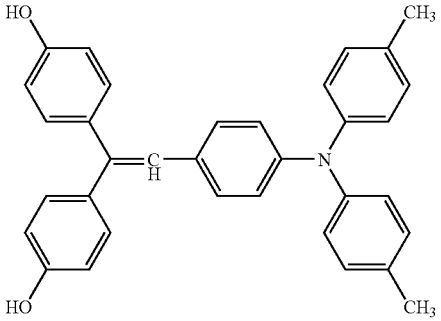

(D2-4)

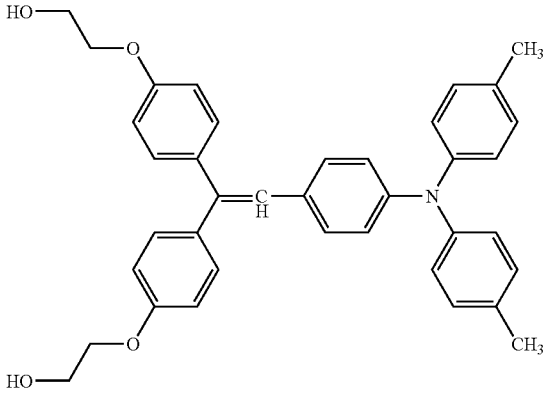

(D2-5)

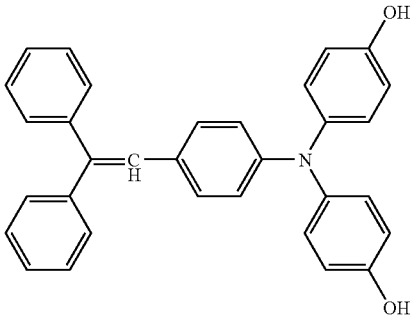

(D2-6)

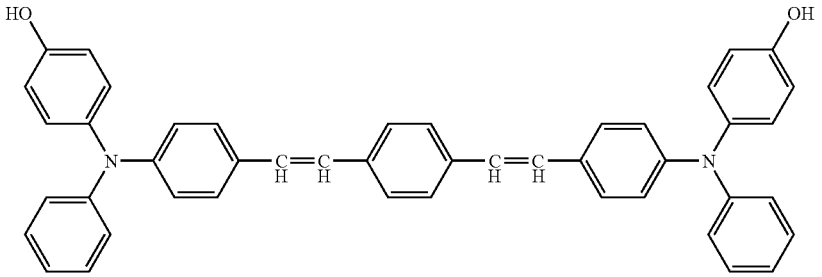

(D2-7)

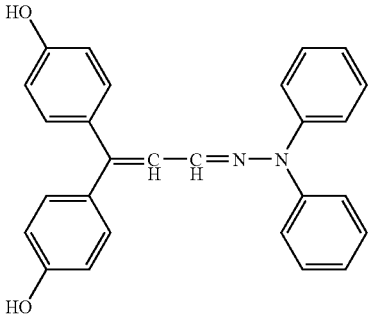

When the reactive charge transport materials (D2-1) to (D2-7) are used, the charge transport molecular structure of the reactive charge transport material is sandwiched with plural urethane bonds. In other words, the charge transport molecular structure of the reactive charge transport material is present in the main chain of the polyurethane chain. Therefore, steric strain tends to occur due to the secondary structure of the polyurethane chain in the resultant cross-linked resin. The steric strain tends to weaken pi-electron conjugated system of the charge transport molecular structure, and therefore problems such as increase of ionized potential and deterioration of charge transport ability tend to occur. As a result, the sensitivity of the resultant electrostatic latent image bearing member deteriorates and the residual potential increases.

The above problems can be solved when the following charge transport polyols (D3-1) to (D3-6) of the present invention are used.

(D3-1)
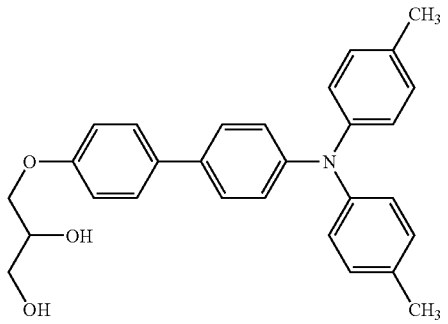
(D3-2)
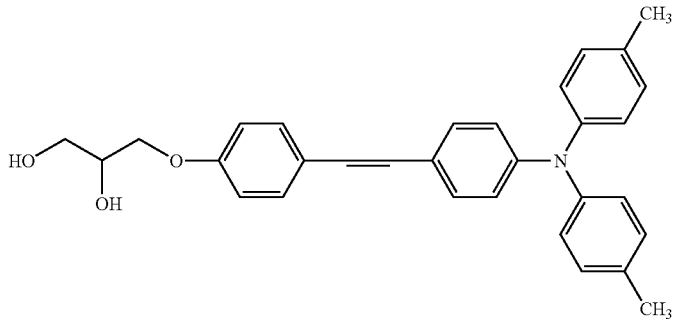
(D3-3)
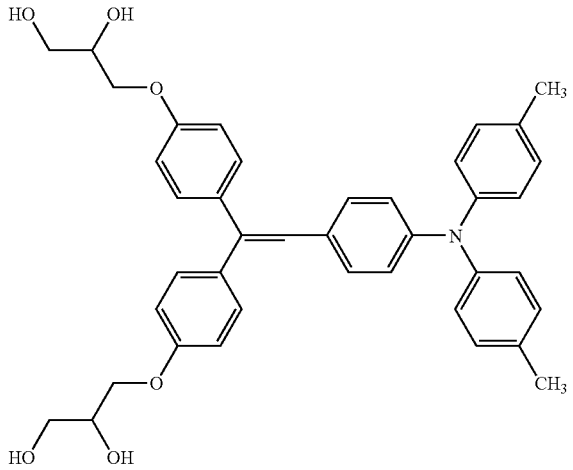
(D3-4)
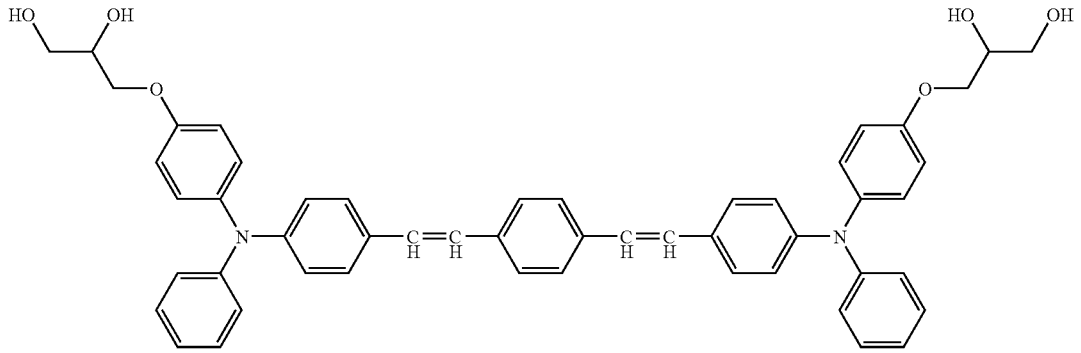

-continued (D3-5)

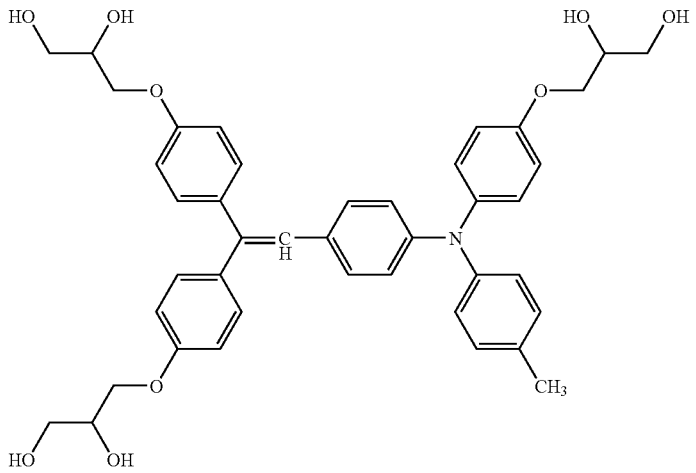

(D3-6)

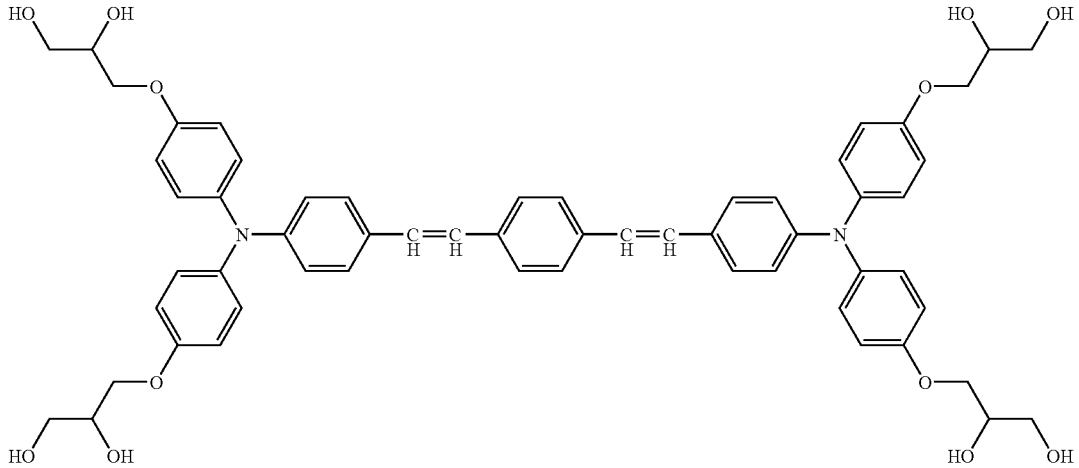

The charge transport polyols (i.e., reactive charge transport materials) (D3-1) to (D3-6) hardly cause the above-mentioned problems and can impart good abrasion resistance to the resultant electrostatic latent image bearing member.

For example, the charge transport polyol (D3-1) has a structure in which (i) a substituted or unsubstituted alkyl group or alkoxy group having 2 to 6 carbon atoms, wherein 2 carbon atoms each are bound to a hydroxyl group, and (ii) an organic residue group comprising a hydrocarbon bond having 1 to 4 valences, which has a charge transport molecular structure, are bound together. In this case, the charge transport molecular structure is suspended from the polyurethane chain (i.e., the charge transport molecular structure forms a pendant group) while forming 2 or more cross-links therebetween. The charge transport molecular structure is not present in the main chains of the plural polyurethane chains.

For this reason, the charge transport molecular structure is hardly influenced by the secondary structure of the polyurethane chain, and therefore the steric strain thereof hardly occurs. As a result, the resultant electrostatic latent image bearing member has good charge transport ability, sensitivity, resistance to residual potential increase, and abrasion resistance.

The charge transport polyols (D3-2) to (D3-6) furthermore prevent increase of residual potential.

This is because these charge transport polyols hardly cause steric strain when urethane bonds are formed, and therefore the charge transport molecular structure easily exerts the effect thereof. Stilbene compounds and α-phenylstilbene compounds have by nature good charge transport ability. The charge transport polyols (D3-2) to (D3-6), which have a stilbene or α-phenylstilbene structure having an alkyl or alkoxy group having 2 to 4 hydroxyl groups, have very good charge transport ability.

Outermost Layer

The first embodiment of the electrostatic latent image bearing member of the present invention includes a substrate and a single-layered photosensitive layer overlaid on the substrate, and optionally includes a protective layer, an intermediate layer, etc.

The second embodiment of the electrostatic latent image bearing member of the present invention includes a substrate and a multi-layered photosensitive layer including at least a charge generation layer and a charge transport layer overlaid on the substrate in this order, and optionally includes a protective layer, an intermediate layer, etc. In the second embodiment of the electrostatic latent image bearing member, the charge transport layer and the charge generation layer may be overlaid on the substrate in this order.

The outermost layer of the single-layered photosensitive layer is the photosensitive layer or a protective layer overlaid on the photosensitive layer. The outermost layer of the multi-layered photosensitive layer is the charge transport layer or a protective layer overlaid on the charge transport layer. When the charge transport layer and the charge generation layer are overlaid on the substrate in this order, the outermost layer is the charge generation layer or a protective layer overlaid on the charge generation layer. Within the context of the present invention, if a first layer is stated to be "overlaid" on, or "overlying" a second layer, the first layer may be in direct contact with the second layer, or there may be one or more intervening layers between the first and second layer, with the second layer being closer to the substrate than the first layer.

Figure 2:
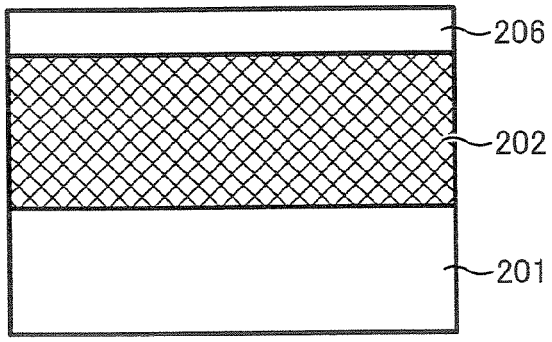
Figure 3:
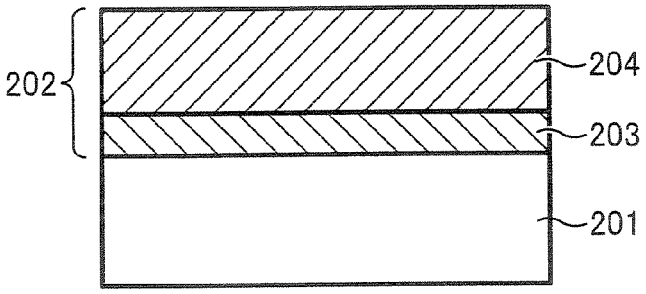
Figure 4:
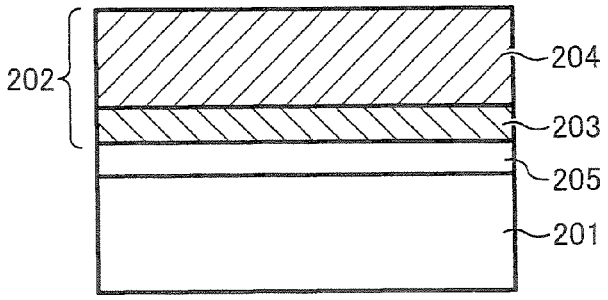
Figure 5:
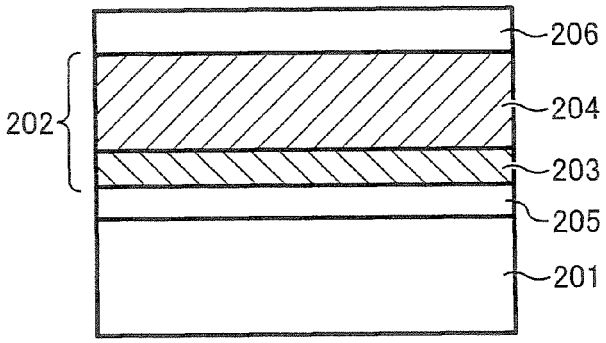
Figure 6:
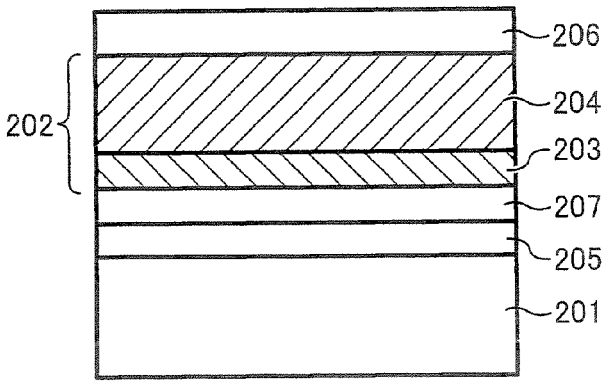

FIG. 1 is a cross section of an embodiment of the electrostatic latent image bearing member of the present invention. This electrostatic latent image bearing member includes a substrate 201 and a single-layered photosensitive layer 202 overlaid on the substrate 201. FIG. 2 is a cross section of another embodiment of the electrostatic latent image bearing member of the present invention, further including a protective layer 206 overlaid on the photosensitive layer 202.

FIGS. 3 to 6 are cross sections of other embodiments of the electrostatic latent image bearing member of the present invention. The electrostatic latent image bearing member illustrated in FIG. 3 includes a substrate 201, a charge generation layer (CGL) 203, and a charge transport layer (CTL) 204, wherein the layers 203 and 204 are overlaid on the substrate 201 in this order. In this case, the charge generation layer 203 and the charge transport layer 204 form a photosensitive layer 202. The electrostatic latent image bearing member illustrated in FIG. 4 further includes an undercoat layer 205 located between the substrate 201 and the charge generation layer 203. The electrostatic latent image bearing member illustrated in FIG. 5 further includes a protective layer 206 overlaid on the charge transport layer 204. The electrostatic latent image bearing member illustrated in FIG. 6 further includes an intermediate layer 207 located between the undercoat layer 205 and the charge generation layer 203. As long as the electrostatic latent image bearing member includes the substrate 201 and the photosensitive layer 202, the electrostatic latent image bearing member can optionally include other layers. The photosensitive layer may be either single-layered or multi-layered.

The outermost layer of the electrostatic latent image bearing member of the present invention includes a cross-linked resin formed from a polyol, as mentioned above. As the polyol used for preparing the cross-linked resin, at least one polyol having no charge transport molecular structure can be used other than the charge transport polyol having the formula (1).

Specific examples of the polyols having no charge transport molecular structure include, but are not limited to, diols and polyols having 3 or more valences.

Specific examples of the diols include, but are not limited to, alkylene glycols (e.g., ethylene glycol, 1,2-propylene glycol, 1,3-propylene glycol, 1,4-butanediol, 1,6-hexanediol), alkylene ether glycols (e.g., diethylene glycol, triethylene glycol, dipropylene glycol, polyethylene glycol, polypropylene glycol, polytetramethylene ether glycol), alicyclic diols (e.g., 1,4-cyclohexanedimethanol, hydrogenated bisphenol A), bisphenols (e.g., bisphenol A, bisphenol F, bisphenol S), alkylene oxide (e.g., ethylene oxide, propylene oxide, butylene oxide) adducts of the above alicyclic diols, alkylene oxide (e.g., ethylene oxide, propylene oxide, butylene oxide) adducts of the above bisphenols, etc.

Specific examples of the polyols having 3 or more valences include, but are not limited to, aliphatic polyols (e.g., glycerin, trimethylolethane, trimethylolpropane, pentaerythritol, sorbitol), phenols having 3 or more valences (e.g., phenol novolac, cresol novolac), alkylene oxide adducts of the above phenols having 3 or more valences, etc.

Among these, trimethylolpropane and a polyol having a styrene-acrylic copolymer skeleton having a hydroxyethyl group, represented by the following formula (I), are preferably used:

(I)

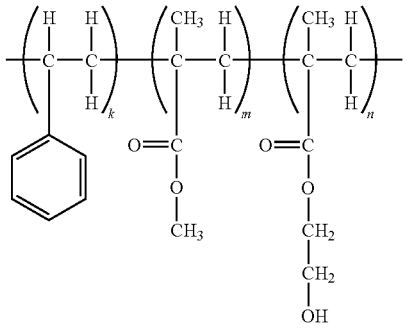

wherein k is 28, m is 42, and n is 30. The compound (I) has a number average molecular weight of not less than 1,000 and a weight average molecular weight of about 31,000. Specific examples of commercially available compounds having the formula (I) include, but are not limited to, a styrene-acrylic copolymer LZR-170 (manufactured by Fujikura Kasei Co., Ltd), etc.

In addition, polyols having a polyether skeleton, polyols having a polyester skeleton, polyols having an acrylic skeleton, polyols having an epoxy skeleton, polyols having a polycarbonate skeleton, polyols having a charge generation molecular skeleton, and polyols having a charge transport molecular skeleton can be used.

These polyols can be used alone or in combination.

When plural polyol are used in combination, at least one polyol preferably has a ratio of the molecular weight to the number of the hydroxyl group (i.e., OH equivalent), of not less than 30 and less than 150, and more preferably not less than 40 and less than 120.

When the OH equivalent satisfies the above range, the outermost layer has good abrasion resistance. In other words, as a content of a polyol having small OH equivalent increases, the cross-linking density increases, and therefore dense three-dimensional structure can be formed in the outermost layer.

The content of the polyol having an OH equivalent of not less than 30 and less than 150 is preferably from 10 to 90% by weight based on the total weight of the polyols.

When the content is too small, abrasion resistance of the resultant electrostatic latent image bearing member is poor. When the content is too large, cross-linking density increases, and therefore abrasion resistance of the resultant electrostatic latent image bearing member improves. However, too large an amount of functional group increases the reactivity of the polyol, and therefore the storage stability of the coating liquid thereof deteriorates and the life thereof is shortened. In this case, various problems tend to occur in the manufacturing process, and a large amount of organic waste liquid may be produced. In addition, the amount of cross-linking point increases in the product, and therefore volume contraction becomes larger. As a result, fractures and cissings tend to appear on the resultant layer.

Moreover, at least one polyol preferably has an OH equivalent of not less than 150 and less than 1,500.

In this case, the coating liquid thereof is well coated and the resultant outermost layer has good abrasion resistance. The coating liquid also has good storage stability (i.e., preservability).

This is because such a polyol satisfying the above OH equivalent range has relatively a large molecular weight so that the coating liquid has an appropriate viscosity. Therefore, the polyol having a small OH equivalent, a polyisocyanate, and the charge transport polyol of the present invention can be uniformly mixed. As a result, the wet coated layer has good leveling property and uniformity.

Specific examples of the polyisocyanates for use in the present invention include, but are not limited to, aliphatic polyisocyanates (e.g., tetramethylene diisocyanate, hexamethylene diisocyanate, 2,6-diisocyanatomethyl caproate), alicyclic polyisocyanates (e.g., isophorone diisocyanate, cyclohexylmethane diisocyanate), aromatic diisocyanates (e.g., tolylene diisocyanate, diphenylmethane diisocyanate), aromatic aliphatic diisocyanates (e.g., α,α,α',α'-tetramethylxylylene diisocyanate), isocyanurates, the above-mentioned polyisocyanates blocked with phenol derivatives, oxime and caprolactam, etc., and their combinations. Trimers consisting essentially of an isocyanate compound (e.g., hexamethylene diisocyanate trimer) can also be used.

In addition, adducts of (i) trimethylolpropane and (ii) aliphatic polyisocyanates (e.g., hexamethylene diisocyanate) or alicyclic polyisocyanates (e.g., isophorone diisocyanate) can be preferably used.

Among these, isocyanate compounds having 3 or more NCO groups per molecule are preferably used. Specific examples of such isocyanate compounds include, but are not limited to, an adduct of trimethylolpropane and hexamethylene diisocyanate having the following formula (II):

(II)

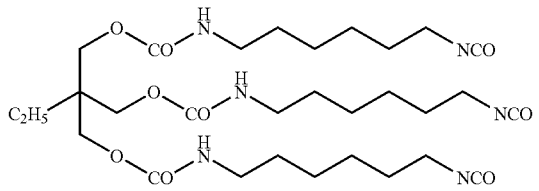

Specific examples of commercially available compounds having the formula (II) include SUMIDUR HT (manufactured by Sumika Bayer Urethane Co., Ltd.), etc.

In addition, polyisocyanates having a charge generation molecular skeleton and polyisocyanates having a charge transport molecular skeleton can be used.

The weight ratio (i.e., D/R) of the charge transport polyol unit (D) to the cross-linked resin (R) is preferably from 1/10 to 15/10, and more preferably from 3/10 to 10/10.

When the weight ratio is too small, charge transport ability of the resultant electrostatic latent image bearing member deteriorates, and therefore residual potential increases. In contrast, when the ratio is too large, the content of the binder resin component is too small, and therefore formation of three-dimensional network structure is distributed, resulting in deterioration of abrasion resistance.

The outermost layer optionally includes various additives so as to improve smoothness and chemical stability thereof, if desired.

The outermost layer is formed on the photosensitive layer by known coating methods such as a dip coating method, a spray coating method, a blade coating method, and a knife coating method. Among these, the dip coating method and the spray coating method are preferably used in terms of mass productivity and coating quality.

The outermost layer preferably has a thickness of from 0.5 to 50 μm, more preferably from 1 to 40 μm, and much more preferably from 2 to 20 μm.

When the thickness is too small, resistance to abrasion and flaws is too small, resulting in deterioration of durability. When the thickness is too large, residual potential tends to increase.

Photosensitive Layer

Multi-Layered Photosensitive Layer

A multi-layered photosensitive layer includes a charge generation layer (CGL) and a charge transport layer (CTL). The CGL and the CTL are typically overlaid on the substrate in this order.

Charge Generation Layer (CGL)

When the charge generation layer is the outermost layer of the electrostatic latent image bearing member, the charge generation layer includes at least a cross-linked resin (i.e., binder resin) formed from a cross-linking reaction between the charge transport polyol of the present invention and an isocyanate compound, and optionally includes other components.

When the charge generation layer is not the outermost layer of the electrostatic latent image bearing member, the charge generation layer includes at least a charge generation material, and optionally includes other components such as a binder resin. Any known charge generation materials, both inorganic materials and organic materials, can be used.

Specific examples of the inorganic charge generation materials include, but are not limited to, crystalline selenium, amorphous selenium, selenium-tellurium compounds, selenium-tellurium-halogen compounds, selenium-arsenic compounds, etc.

Specific examples of the organic charge generation materials include, but are not limited to, phthalocyanine pigments (e.g., metal phthalocyanine, metal-free phthalocyanine), azulenium salt pigments, squaric acid methyne pigments, azo pigments having a carbazole skeleton, azo pigments having a triphenylamine skeleton, azo pigments having a diphenylamine skeleton, azo pigments having a dibenzothiophene skeleton, azo pigments having a fluorenone skeleton, azo pigments having an oxadiazole skeleton, azo pigments having a bisstilbene skeleton, azo pigments having a distyryloxadiazole skeleton, azo pigments having a distyrylcarbazole skeleton, perylene pigments, anthraquinone and polycyclic quinone pigments, quinonimine pigments, diphenylmethane and triphenylmethane pigments, benzoquinone and naphthoquinone pigments, cyanine and azomethine pigments, indigoid pigments, bisbenzimidazole pigments, etc. These charge generation materials can be used alone or in combination.

When the charge generation layer is not the outermost layer of the electrostatic latent image bearing member, any known resins can be used as a binder resin. Specific examples of the binder resins include, but are not limited to, polyamide resins, polyurethane resins, epoxy resins, polyketone resins, polycarbonate resins, silicone resins, acrylic resins, polyvinyl butyral resins, polyvinyl formal resins, polyvinyl ketone resins, polystyrene resins, poly-N-vinylcarbazole resins, polyacrylic amide resins, etc. These binder resins can be used alone or in combination.

The charge generation layer may optionally include a charge transport material. In addition to the above-mentioned binder resins, charge transport polymer materials can be used as a binder resin of the charge generation layer.

The charge generation layer is typically formed by a vacuum thin layer manufacturing method or a casting method using a liquid dispersion.

Specific examples of the vacuum thin layer manufacturing methods include, but are not limited to, a glow discharge polymerization method, a vacuum deposition method, a CVD method, a sputtering method, a reactive sputtering method, an ion plating method, an accelerate ion injection method, etc. The vacuum thin layer manufacturing method can well form a layer of the above inorganic and organic charge generation materials.

Specific examples of the casting methods include any known coating methods such as a dip coating method, a spray coating method, and a bead coating method, using a charge generation layer coating liquid.

The charge generation layer coating liquid can be prepared by dispersing or dissolving a charge generation material and a binder resin in an organic solvent.

Specific examples of the organic solvents for use in the charge generation layer coating liquid include, but are not limited to, acetone, methyl ethyl ketone, methyl isopropyl ketone, cyclohexanone, benzene, toluene, xylene, chloroform, dichloromethane, dichloroethane, dichloropropane, trichloroethane, trichloroethylene, tetrachloroethane, tetrahydrofuran, dioxolane, dioxane, methanol, ethanol, isopropyl alcohol, butanol, ethyl acetate, butyl acetate, dimethyl sulfoxide, methyl cellosolve, ethyl cellosolve, propyl cellosolve, etc. These can be used alone or in combination.

Among these, solvents having a boiling point of from 40 to 80° C. such as tetrahydrofuran, methyl ethyl ketone, dichloromethane, methanol, and ethanol, are preferably used because these can be easily removed.

The charge generation material can be dispersed in the organic solvent by dispersing methods using a dispersion medium such as a ball mill, a bead mill, a sand mill, and a vibration mill, or high-speed liquid collision dispersing methods.

Electrophotographic property, especially photosensitivity, of the charge generation layer depends on the thickness thereof. Generally speaking, as the thickness of the charge generation layer increases, photosensitivity thereof improves. The thickness of the charge generation layer is preferably determined according to the requirements of the specification of the image forming apparatus used. In order to satisfy the requirements for a photoreceptor used for electrophotography, the charge generation layer preferably has a thickness of from 0.01 to 5 μm, and more preferably from 0.05 to 2 μm.

Charge Transport Layer (CTL)

The charge transport layer has functions of keeping a charge and transporting a charge generated in the charge generation layer so as to be bound to the keeping charge kept. In order to keep a charge, the charge transport layer is required to have high electrical resistance. In order to achieve high surface potential with the charge kept, the charge transport layer is required to have a small dielectric constant and good charge transport ability.

When the charge transport layer is the outermost layer of the electrostatic latent image bearing member, the charge transport layer includes at least a cross-linked resin (i.e., binder resin) formed from a cross-linking reaction between the charge transport polyol of the present invention and an isocyanate compound, and optionally includes other components.

When the charge transport layer is not the outermost layer and a protective layer is formed thereon, the charge transport layer is not required to have abrasion resistance. Therefore, it is not necessary for the charge transport layer to include a cross-linked resin (i.e., binder resin) formed from a cross-linking reaction between the charge transport polyol of the present invention and an isocyanate compound.

When the charge transport layer is not the outermost layer, the charge transport layer includes at least a charge transport material mentioned below, and optionally includes other components such as a binder resin.

Specific examples of the charge transport materials include, but are not limited to, electron transport materials, positive-hole transport materials, polymeric charge transport materials, etc.

Specific examples of the electron transport materials (i.e., electron accepting materials) include, but are not limited to, chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one, 1,3,7-trinitrodibenzothiophene-5,5-dioxide, etc. These can be used alone or in combination.

Specific examples of the positive-hole transport materials (i.e., electron donating materials) include, but are not limited to, oxazole derivatives, oxadiazole derivatives, imidazole derivatives, triphenylamine derivatives, 9-(p-diethylaminostyrylanthracene), 1,1-bis-(4-dibenzylaminophenyl)propane, styrylanthracene, styrylpyrazoline, phenylhydrazones, α-phenylstilbene derivatives, thiazole derivatives, triazole derivatives, phenazine derivatives, acridine derivatives, benzofuran derivatives, benzimidazole derivatives, thiophene derivatives, etc. These can be used alone or in combination.

Specific examples of the polymeric charge transport materials include, but are not limited to, the following compounds:

(1) polymers having a carbazole ring (e.g., poly-N-vinylcarbazole, compounds disclosed in JP-As 50-82056, 54-9632, 54-11737, 04-175337, 04-183719, and 06-234841);

(2) polymers having a hydrazone structure (e.g., compounds disclosed in JP-As 57-78402, 61-20953, 61-296358, 01-134456, 01-179164, 03-180851, 03-180852, 03-50555, 05-310904, and 06-234840);

(3) polysilylene polymers (e.g., compounds disclosed in JP-As 63-285552, 01-88461, 04-264130, 04-264131, 04-264132, 04-264133, and 04-289867);

(4) polymers having a triarylamine structure (e.g., N,N-bis(4-methylphenyl)-4-amino polystyrene, compounds disclosed in JP-As 01-134457, 02-282264, 02-304456, 04-133065, 04-133066, 05-40350, and 05-202135); and (5) other polymers (e.g., formaldehyde condensate of nitropyrene, compounds disclosed in JP-As 51-73888, 56-150749, 06-234836, and 06-234837).

In addition, polycarbonate resins having a triarylamine structure, polyurethane resins having a triarylamine structure, polyester resins having a triarylamine structure, polyether resins having a triarylamine structure, and compounds disclosed in JP-As 64-1728, 64-13061, 64-19049, 04-11627, 04-225014, 04-230767, 04-320420, 05-232727, 07-56374, 09-127713, 09-222740, 09-265197, 09-211877, and 09-304956 can be used as the polymeric charge transport material.

In addition to the above polymers, any known copolymers, block polymers, graft polymers, star polymers, and cross-linked polymers having an electron donating group (e.g., a polymer disclosed in JP-A 03-109406) can be used as electron donating polymers.

Specific examples of the binder resins for use in the charge transport layer include, but are not limited to, polycarbonate resins, polyester resins, methacrylic resins, acrylic resins, polyethylene resins, polyvinyl chloride resins, polyvinyl acetate resins, polystyrene resins, phenol resins, epoxy resins, polyurethane resins, polyvinylidene chloride resins, alkyd resins, silicone resins, polyvinyl carbazole resins, polyvinyl butyral resins, polyvinyl formal resins, polyacrylate resins, polyacrylamide resins, phenoxy resins, etc. These can be used alone or in combination.

The charge transport layer may include a copolymer of a cross-linked binder resin with a cross-linked charge transport material.

The charge transport layer can be formed by applying a coating liquid, in which a charge transport material and a binder resin are dissolved in an organic solvent, onto the charge generation layer, followed by drying. The charge transport layer optionally includes a plasticizer, an oxidation inhibitor, a leveling agent, etc., other than the charge transport material and the binder resin, if desired.

The charge transport layer preferably has a thickness of from 5 to 100 μm. In order to satisfy the recent demands for producing high quality images having a resolution of 1200 dpi or more, the charge transport layer is required to be as thin as possible, and therefore the charge transport layer more preferably has a thickness of from 5 to 30 μm.

Single-Layered Photosensitive Layer

When the single-layered photosensitive layer is the outermost layer of the electrostatic latent image bearing member, the single-layered photosensitive layer includes at least a cross-linked resin (i.e., binder resin) formed from a cross-linking reaction between the charge transport polyol mentioned above and an isocyanate compound, and optionally includes other components.

When the single-layered photosensitive layer is not the outermost layer and a protective layer is formed thereon, the single-layered photosensitive layer is not required to have abrasion resistance. Therefore, it is not necessary for the single-layered photosensitive layer to include a cross-linked resin (i.e., binder resin) formed from a cross-linking reaction between the charge transport polyol of the present invention and an isocyanate compound.

When the single-layered photosensitive layer is not the outermost layer, the single-layered photosensitive layer includes at least a charge transport material (such as the above-mentioned positive-hole transport materials, electron transport materials, and polymeric charge transport materials) and a binder resin, and optionally includes other components.

The single-layered photosensitive layer can be formed by applying a coating liquid, in which a charge generation material and a thermosetting binder resin and a charge transport material (which may have a cross-linking group) are dissolved in an organic solvent, onto the substrate, followed by drying (i.e., a casting method). The single-layered photosensitive layer optionally includes a plasticizer, if desired.

The single-layered photosensitive layer preferably has a thickness of from 5 to 100 μm, and more preferably from 5 to 50 μm. When the thickness is too small, chargeability of the resultant electrostatic latent image bearing member deteriorates. When the thickness is too large, sensitivity of the resultant electrostatic latent image bearing member deteriorates.

Substrate

Suitable materials for use in the substrate include materials having conductivity, and are not particularly limited.

For example, conductive materials and conductive-treated insulating materials are preferably used. Specific examples of such materials include, but are not limited to, metals (e.g., Al, Ni, Fe, Cu, Au) and alloys thereof; insulating substrates (e.g., polyesters, polycarbonates, polyimides, glasses), on the surface of which a thin layer of a metal (e.g., Al, Ag, Au) or a conductive material (e.g., $In_2O_3$, $SnO_2$) is formed; resin substrates in which a carbon black, a graphite, a metal (e.g., Al, Cu, Ni) powder, conductive glass powder, etc. are uniformly dispersed in a resin, so as to impart conductivity to the resin; etc.

The shape and size of the substrate are not particularly limited. For example, platy substrates, cylindrical substrates, and belt substrates can be used. Belt substrates have a drawback such that a driving roller and a driven roller have to be arranged inside the belt, resulting in complication and upsizing of the machine. In contrast, belt substrates have an advantage of being flexibly arranged in the machine. When an electrostatic latent image bearing member has a protective layer, cracks may appear on the surface thereof, because the protective layer has insufficient flexibility in some cases. Such an electrostatic latent image bearing member tends to produce images having grainy background fouling. For these reasons, cylindrical substrates are most preferably used.

Undercoat Layer

The electrostatic latent image bearing member of the present invention optionally includes an undercoat layer located between the substrate and the photosensitive layer, if desired. The undercoat layer is formed for the purposes of improving adhesion between the layers, preventing occurrence of moiré, improving coating property of the upper layer, decreasing residual potential, etc.

The undercoat layer generally includes a resin as a main component. It is preferable that the resin is insoluble in typical organic solvents because photosensitive layers are coated thereon using organic solvents. Specific examples of such resins include, but are not limited to, water-soluble resins (e.g., polyvinyl alcohols, casein, sodium polyacrylates), alcohol-soluble resins (e.g., copolymerized nylons, methoxymethylated nylons), indurative resins (e.g., polyurethanes, melamine resins, alkyd-melamine resins, epoxy resins) which can form a three-dimensional network structure, etc.

The undercoat layer optionally includes a fine powder of metal oxides (e.g., titanium oxide, silica, alumina, zirconium oxide, tin oxide, indium oxide), metal sulfides, metal nitrides, etc. The undercoat layer can be formed by a typical coating method using a solvent.

In addition, metal oxide layers formed by sol-gel method using silane coupling agents, titanium coupling agents, chromium coupling agents, etc.; $Al_2O_3$ layers formed by anodic oxidation; and layers of organic materials (e.g., poly-para-xylylene (i.e., parylene)) or inorganic materials (e.g., $SnO_2$, $TiO_2$, ITO, $CeO_2$) formed by a vacuum thin-layer manufacturing method can be used as the undercoat layer.

The undercoat layer preferably has a thickness of from 0.1 to 10 μm, and more preferably from 1 to 5 μm, but the thickness is not limited thereto.

Intermediate Layer

The electrostatic latent image bearing member of the present invention optionally includes an intermediate layer on the substrate, in order to improve adhesion between other layers and charge blocking property. The intermediate layer typically includes a resin as a main component. It is preferable that the resin is insoluble in typical organic solvents because photosensitive layers are coated thereon using organic solvents.

Specific examples of such resins include, but are not limited to, water-soluble resins (e.g., polyvinyl alcohols, casein, sodium polyacrylates), alcohol-soluble resins (e.g., copolymerized nylons, methoxymethylated nylons), indurative resins (e.g., polyurethanes, melamine resins, alkyd-melamine resins, epoxy resins) which can form a three-dimensional network structure, etc.

Image Forming Apparatus and Method

Next, the image forming apparatus and image forming method of the present invention will be explained in detail.

The image forming apparatus of the present invention comprises:

an electrostatic latent image bearing member;

an electrostatic latent image forming means for forming an electrostatic latent image on the electrostatic latent image bearing member;

a developing means for developing the electrostatic latent image with a toner to form a toner image;

a transfer means for transferring the toner image onto a recording medium; and a fixing means for fixing the transferred image onto the recording medium;

wherein the electrostatic latent image bearing member is the electrostatic latent image bearing member of the present invention.

In other words, the image forming apparatus of the present invention comprises:

an electrostatic latent image bearing member;

an electrostatic latent image forming means for forming an electrostatic latent image on the electrostatic latent image bearing member;

a developing means for developing the electrostatic latent image with a toner to form a toner image;

a transfer means for transferring the toner image onto a recording medium; and a fixing means for fixing the transferred image onto the recording medium;

wherein the outermost layer of the electrostatic latent image bearing member comprises a cross-linked resin formed from a reaction between a charge transport polyol having the formula (1) and an isocyanate compound.

The image forming apparatus of the present invention optionally includes other means, such as a discharging means, a cleaning means, a recycle means, a controlling means, etc., if desired.

For example, a cleaning means which contacts the surface of the electrostatic latent image bearing member so as to remove residual toner particles remaining thereon is preferably used.

The image forming method of the present invention comprises:

forming an electrostatic latent image on an electrostatic latent image bearing member (i.e., electrostatic latent image forming process);

developing the electrostatic latent image with a toner to form a toner image (i.e., developing process);

transferring the toner image onto a recording medium (i.e., transfer process); and fixing the transferred image onto the recording medium (i.e., fixing process);

wherein the outermost layer of the electrostatic latent image bearing member comprises a cross-linked resin formed from a cross-linking reaction between a charge transport polyol having the formula (1) and an isocyanate compound.

The image forming method of the present invention optionally includes other processes, such as a discharging process, a cleaning process, a recycle process, a controlling process, etc., if desired.

The image forming method of the present invention is preferably performed using the image forming apparatus of the present invention. Namely, the electrostatic latent image forming process can be performed with the electrostatic latent image forming means, the developing process can be performed with the developing means, the transfer process can be performed with the transfer means, the fixing process can be performed with the fixing means, and the other processes can be performed with the corresponding means.

Each of the image forming processes and image forming means will be explained in detail below.

Electrostatic Latent Image Forming Process and Means

In the electrostatic latent image forming process, an electrostatic latent image is formed on a charged electrostatic latent image bearing member by irradiation of light. As the electrostatic latent image bearing member, the electrostatic latent image bearing member of the present invention is used. The electrostatic latent image forming means includes a charger and an irradiator.

The electrostatic latent image bearing member can be charged by applying a voltage to the surface thereof, using the charger. Specific examples of the chargers include, but are not limited to, contact chargers including a conductive or semi-conductive roller, brushes, films, rubber blades, etc.; non-contact chargers using corona discharge such as corotron and scorotron; non-contact chargers including a roller having means for forming a gap (such as a gap tape) on the ends thereof, so as not to be in contact with the electrostatic latent image bearing member; etc.

The configuration of the charging member may be a roller, a magnetic brush, a fur brush, etc., and is not particularly limited. The magnetic brush-type charging member includes, for example, ferrite particles (such as Zn—Cu ferrites), a non-magnetic conductive sleeve supporting the ferrite particles, and a magnet roll arranged in the non-magnetic conductive sleeve. The fur brush-type charging member includes, for example, charging members in which a fur treated with a carbon, copper sulfide, a metal, or a metal oxide to have conductivity is wound around or attached to a metal or a cored bar treated to have conductivity.

Among these, the contact chargers and non-contact chargers having a means for forming a gap are preferably used, because these chargers produce less ozone. It is more preferable that contact and non-contact chargers charging the electrostatic latent image bearing member by applying a DC voltage overlapped with an AC voltage thereto are used.

When a charger is a non-contact charging roller located close to the electrostatic latent image bearing member with a gap therebetween, and the electrostatic latent image bearing member is charged by applying a DC voltage overlapped with an AC voltage to the non-contact charging roller, charging inconsistency and poor chargeability resulted from contaminations of the charging roller can be reduced. Such an image forming apparatus is preferably used because of being free from maintenance.

The charged electrostatic latent image bearing member can be irradiated with light containing image information using the irradiator.

Specific examples of the irradiators include, but are not limited to, emit optical irradiators, rod lens array irradiators, laser optical irradiators, liquid crystal shutter irradiators, etc.

In the present invention, the electrostatic latent member can be irradiated from the back side thereof.

Developing Process and Means

In the developing process, the electrostatic latent image is developed with a toner to form a toner image. The toner includes the toners and developers mentioned later.

The formation of the toner image is performed with the developing means by developing the electrostatic latent image with a toner or a developer.

Suitable developing means include any known developing means, and are not particularly limited. For example, developing devices containing a toner or a developer, which can directly or indirectly supply the toner or the developer to an electrostatic latent image, are preferably used.

The developing device may be either or both of a dry developing device or a wet developing device in the present invention. Moreover, the developing device may be either or both of a single-colored developing device or a multi-colored developing device in the present invention. For example, a developing device including an agitator configured to agitate the toner or the developer so as to be friction-charged and a rotatable magnet roller is preferably used.

In the developing device, the toner and the carrier mentioned later are mixed and agitated. The toner is charged while agitated, and held in a magnetic brush which is formed on the surface of a rotating magnetic roller. Because the magnetic roller is located near the electrostatic latent image bearing member, a part of the toner held in the magnetic brush, which is formed on the surface of the rotating magnetic roller, is moved to the surface of the electrostatic latent image bearing member due to the electric force. As a result, the electrostatic latent image is developed with the toner to form a toner image on the electrostatic latent image bearing member.

The developer contained in the developing device may be either or both of a one-component developer or a two-component developer.

Transfer Process and Means

In the transfer process, the toner image is transferred onto a recording medium. It is preferable that the toner image is firstly transferred onto an intermediate transfer medium, and then secondly transferred onto the recording medium. It is more preferable that the toner image is a multiple toner image which is formed with two or more full-color toner images, and the multiple toner image is firstly transferred onto the intermediate transfer medium (i.e., primary transfer process), and then secondly transferred onto the recording medium (i.e., secondary transfer process).

The toner image is charged with a transfer charger and then transferred with the transfer means. The transfer means preferably includes a primary transfer means for transferring a toner image onto an intermediate transfer medium to form a multiple toner image, and a secondary transfer means for transferring the multiple toner image onto a recording medium.

Namely, it is preferable that plural single-colored toner images are independently formed on an independent electrostatic latent image bearing member, and then each of the single-colored toner images is transferred onto the intermediate transfer medium one by one to form a multiple toner image (i.e., primary transfer process), and then the multiple toner image is transferred onto the recording medium (i.e., secondary transfer process). As the intermediate transfer medium, any known transfer media can be used, and is not particularly limited. For example, transfer belts are preferably used.

The intermediate transfer medium preferably has a static friction coefficient of from 0.1 to 0.6, and more preferably from 0.3 to 0.5.

The intermediate transfer medium preferably has a volume resistivity of not less than several Ω·cm and not greater than $10^3$ Ω·cm. In this case, the intermediate transfer medium is hardly charged, and the charge supplied with a charge supplying means hardly remains on the intermediate transfer medium, and therefore occurrence of uneven transfer in the secondary transfer process can be prevented. In addition, it becomes easier to apply a transfer bias in the secondary transfer process.

Any known materials can be used for the intermediate transfer medium, and are not particularly limited. Specific examples of the materials used for the intermediate transfer medium include, but are not limited to, the following materials.

(1) A single-layered belt made of a material having a high Young's modulus (i.e., modulus of elongation). Specific examples of the materials having a high Young's modulus include, but are not limited to, PC (polycarbonate), PVDF (polyvinylidene fluoride), PAT (polyalkylene terephthalate), blended materials of PC and PAT, blended materials of ETFE (ethylene-tetrafluoroethylene copolymer) and PC, blended materials of ETFE and PAT, blended materials of PC and PAT, thermosetting resins in which a carbon black is dispersed therein, etc. Such a single-layered belt having a high Young's modulus deforms a little even if a stress is applied thereto, when an image is formed. In particular, occurrence of registration drift can be prevented when a color image is formed.

(2) A two-layered belt including the above single-layered belt having a high Young's modulus and a surface layer, and a three-layered belt further including an intermediate layer. When such a two-layered or three-layered belt is used, occurrence of hollow defects in line images, which is caused due to the hardness of the single-layered belt, can be prevented.

(3) A Belt made of a rubber or an elastomer having a low Young's modulus. When such a belt is used, hollow defects hardly occur in line images because the belt is soft. Since the belt has a width larger than those of the driving roller and the driven roller, meandering of the belt is prevented, using elasticity of the projected portions of the belt. The manufacturing cost can be reduced because a rib and a meandering preventing apparatus are not needed.

Conventional intermediate transfer belts are made of fluorocarbon resins, polycarbonate resins, polyimide resins, etc. Elastic belts in which all layers or a part of the belt is made of an elastic material are used for the intermediate transfer belts recently.

When a resin belt is used in transferring full-color images, the following problem tends to occur.

A typical full-color image includes four single-colored toner layers. When the single-colored toner layers are transferred from an electrostatic latent image bearing member onto an intermediate transfer belt (i.e., primary transfer), and then transferred from the intermediate transfer belt onto a recording medium (i.e., secondary transfer), the toner particles receive a pressure, and therefore cohesion among the toner particles increases. As a result, line images with hollow defects and solid images with edge defects tend to be produced. This is because the resin belt has a high hardness and cannot deform according to the deformation of the toner layers. Therefore, the toner layers are easily compressed and hollow defects tend to occur.

On the other hand, demands for forming full-color images on various kinds of papers (e.g., Japanese papers, papers having convexes and convexities) have increased recently. However, papers having poor smoothness tend to form voids between the paper and a toner when the toner is transferred thereon, resulting in occurrence of transfer defect. If the secondary transfer pressure is increased so as to improve adhesion between the paper and the toner, cohesion among the toner particles increases, and therefore the above-mentioned hollow defects tend to occur.

The elastic belt receives attention because the belt can deform according to the toner layer and the papers having poor smoothness, in the transfer process. The elastic belt can deform following concavities and convexities locally formed on the paper, and therefore the toner and the paper are firmly attached to each other without application of excessive pressure to the toner layer. As a result, a uniform transfer image without hollow defects in characters can be formed on the paper having poor smoothness.

Specific examples of the materials used for the elastic belt include, but are not limited to, polycarbonate resins; fluorocarbon resins (e.g., ETFE, PVDF); styrene resins (i.e., homopolymers and copolymers of styrene or styrene substitutions) such as polystyrene resins, chloro polystyrene resins, poly-α-methylstyrene resins, styrene-butadiene copolymers, styrene-vinyl chloride copolymers, styrene-vinyl acetate copolymers, styrene-maleic acid copolymers, styrene-acrylate copolymers (e.g., styrene-methyl acrylate copolymers, styrene-ethyl acrylate copolymers, styrene-butyl acrylate copolymers, styrene-octyl acrylate copolymers, styrene-phenyl acrylate copolymers), styrene-methacrylate copolymers (e.g., styrene-methyl methacrylate copolymers, styrene-ethyl methacrylate copolymers, styrene-phenyl methacrylate copolymers), styrene-methyl α-chroloacrylate copolymers, and styrene-acrylonitrile-acrylate copolymers; and other resins such as methyl methacrylate resins, butyl methacrylate resins, ethyl acrylate resins, butyl acrylate resins, modified acrylic resins (e.g., silicone-modified acrylic resins, vinyl chloride-modified acrylic resins, acrylic urethane resins), polyvinyl chloride resins, styrene-vinyl acetate copolymers, vinyl chloride-vinyl acetate copolymers, rosin-modified maleic acid resins, phenol resins, epoxy resins, polyester resins, polyester polyurethane resins, polyethylenes, polypropylenes, polybutadienes, polyvinylidene chloride, ionmer resins, polyurethane resins, silicone resins, ketone resins, ethylene-ethyl acrylate copolymers, xylene resins, polyvinyl butyral resins, polyamide resins, modified polyphenyleneoxide resins, etc. These can be used alone or in combination.

Specific examples of the elastic rubber and elastomer include, but are not limited to, butyl rubbers, fluorocarbon rubbers, acrylic rubbers, EPDM, NBR, acrylonitrile-butadiene-styrene rubbers, natural rubbers, isoprene rubbers, styrene-butadiene rubbers, butadiene rubbers, ethylene-propylene rubbers, ethylene-propylene terpolymers, chloroprene rubbers, chlorosulfonated polyethylenes, chlorinated polyethylenes, urethane rubbers, syndyotactic 1,2-polybutadiene, epichlorohydrin rubbers, silicone rubbers, polysulfide rubbers, polynorbornene rubbers, hydrogenated nitrile rubbers, thermoplastic elastomers (e.g., polystyrene-based elastomers, polyolefin-based elastomers, polyvinyl chloride-based elastomers, polyurethane-based elastomers, polyamide-based elastomers, polyurea-based elastomers, polyester-based elastomers, fluorocarbon resin-based elastomers), etc. These can be used alone or in combination.

The intermediate transfer medium can include a conductive agent to control the volume resistivity thereof.

Specific examples of the conductive agents include, but are not limited to, carbon black, graphite, metal (e.g., aluminum, nickel) powders, conductive metal oxides (e.g., tin oxide, titanium oxide, antimony oxide, indium oxide, potassium titanate, antimony oxide-tin oxide combined oxide (ATO), indium oxide-tin oxide combined oxide (ITO)), etc. The conductive metal oxides can be covered with a particulate insulative material such as barium sulfate, magnesium silicate, and calcium carbonate.

Materials used for the outermost layer of the intermediate transfer medium are required to prevent contamination of the elastic materials to the electrostatic latent image bearing member, to decrease surface friction resistance so as to reduce toner adhesion and to improve cleanability and secondary transferability.

For example, a material in which at least one particulate material (e.g., a fluorocarbon resin, a fluorine compound, a carbon fluoride, a titanium dioxide, a silicon carbide), which can decrease surface energy and improve lubricity, is dispersed in at least one resin selected from a polyurethane resin, a polyester resin, and an epoxy resin, can be used. The particulate materials can be used alone or in combination. In addition, the particulate materials can be used in combination with the same material having a different particle diameter. Fluorocarbon rubbers can form a layer thereof on the intermediate transfer medium by application of heat. In this case, the surface energy decreases because a large amount of fluorine atoms are present on the surface.

A method of preparing the belt is not particularly limited. For example, the above-mentioned belts can be prepared by a centrifugal molding method in which constituent materials are poured into a rotating cylindrical mold; a spray coating method in which a coating liquid is sprayed; a dipping method in which a cylindrical mold is dipped into a constituent liquid and then raised up; a cast molding method in which constituent materials are poured into an inner mold or an outer mold; and a method in which a compound is wound around a cylindrical mold and then subject to vulcanization polishing. These methods are typically used in combination when a belt is prepared.

In order to prevent the elongation of the elastic belt, a method in which a rubber layer is formed on a resin-cored layer which hardly elongates, a method in which an elongation inhibitor is put into a core layer, etc., have been proposed. However, the method of preparing the belt is not particularly limited.

Specific examples of the materials used for the elongation inhibitors include, but are not limited to, natural fibers (e.g., cotton, silk), synthesized fibers (e.g., polyester fibers, nylon fibers, acrylic fibers, polyolefin fibers, polyvinyl alcohol fibers, polyvinyl chloride fibers, polyvinylidene chloride fibers, polyurethane fibers, polyacetal fibers, polyfluoroethylene fibers, phenol fibers), inorganic fibers (e.g., carbon fibers, glass fibers, boron fibers), metal fibers (e.g., iron fibers, copper fibers), etc. These can be used alone or in combination. Textiles and threads of the above-materials can also be used.

Any type of threads can be used. For example, a thread can be prepared by twisting one or more filaments. The thread may be a blended thread in which the above plural fibers are mixed. Of course, the thread can be conductive-treated. Any type of textiles (e.g., knitted fabrics) can be used. Of course, the textile can be conductive-treated.

A method of preparing the core layer is not particularly limited. For example, the above-mentioned core layer can be prepared by a method in which a metal mold is covered with a cylindrical textile, and then a cover layer is formed thereon; a method in which a cylindrical textile is dipped into a liquid rubber, etc. to form a cover layer on one side or both sides thereof; and a method in which a thread is spirally wound around a metal mold with a given pitch, and then a cover layer is formed thereon.

The elastic layer preferably has a thickness of less than about 1 mm. When the elastic layer has too large a thickness, cracks tend to appear on the surface thereof because the surface largely expands and contracts, even though it depends on the hardness of the elastic layer. When the surface largely expands and contracts, the produced images also expand and contract.

The transfer means (i.e., the primary transfer means and the secondary transfer means) preferably comprises a transfer device configured to attract the toner image from the electrostatic latent image bearing member to the recording medium. The number of the transfer member can be one or more.

Specific examples of the transfer devices include, but are not limited to, corona transfer devices, transfer belts, transfer rollers, pressure transfer rollers, adhesion transfer members, etc.

Any known media on which an unfixed image can be transferred can be used as the recording medium. Specific examples of the recording media include, but are not limited to, plain papers, overhead projection PET sheets, etc.

Fixing Process and Means

In the fixing process, the toner image transferred onto the recording medium is fixed with the fixing means. When the toner image is a full-color toner image, each single-colored toner image can be independently fixed on the recording medium one by one. Of course, a multiple toner image, in which all of the single-colored toner images are superimposed, can be fixed on the recording medium.

As the fixing means, heat pressing means are preferably used, but are not limited thereto.

The heat pressing means typically includes a combination of a heat roller and a pressing roller; and a combination of a heat roller, a pressing roller, and an endless belt; etc. Heating temperature of the heat pressing means is preferably from 80 to 200° C. In the present invention, any known light fixing devices can be used in combination with the heat fixing device, or instead of the heat fixing device.

Discharging Process and Means

In the discharging process, which is optionally performed, a discharging bias is applied to the electrostatic latent image bearing member so as to remove the charge therefrom with the discharging means.

As the discharging means, any known discharging device which can apply a discharging bias to the electrostatic latent image bearing member can be used, and is not particularly limited. For example, discharging lamps are preferably used.

Cleaning Process and Means

In the cleaning process, which is optionally performed, residual toner particles remaining on the electrostatic latent image bearing member are removed with the cleaning means.

As the cleaning means, any known cleaning devices which can remove residual toner particles from the electrostatic latent image bearing member can be used, and is not particularly limited. Specific examples of usable cleaning devices include, but are not limited to, magnet brush cleaners, electrostatic brush cleaners, magnetic roller cleaners, blade cleaners, web cleaners, etc.

The image forming apparatus of the present invention preferably includes a lubricant applicator configured to apply a lubricant to the surface of the electrostatic latent image bearing member.

As the lubricant, metal soaps are preferably used. The metal soap is preferably selected from zinc stearate, aluminum stearate, and calcium stearate.

Recycling Process and Means

In the recycling process, which is optionally performed, the toner particles removed with the cleaning means are collected and transported to the developing means with the recycling device.

As the recycling device, any known transport means can be used, and is not particularly limited.

Controlling Process and Means

In the controlling process, which is optionally performed, each image forming process is controlled with the controlling means.

Specific examples of the controlling means include sequencers, computers, etc., but are not limited thereto.

Image Forming Apparatus

Next, the image forming apparatus of the present invention will be explained, referring to drawings.

Figure 7:
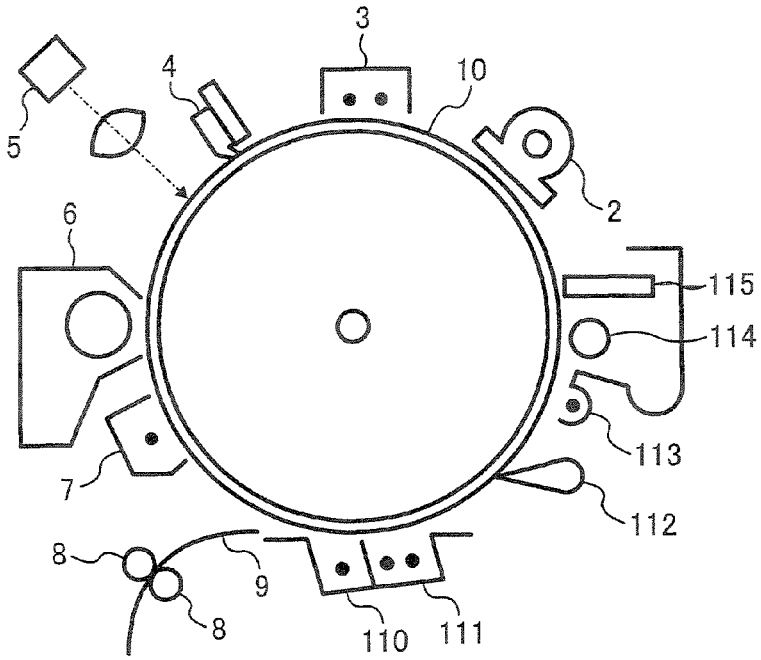
FIG. 7 is a schematic view illustrating an embodiment of the image forming apparatus of the present invention.

FIG. 7 is a schematic view illustrating an embodiment of the image forming apparatus of the present invention. The image forming apparatus illustrated in FIG. 7 includes the cylindrical electrostatic latent image bearing member (hereinafter referred to as photoreceptor) 10 of the present invention, a discharging lamp 2, a charger 3, an eraser 4, a light irradiator 5, a developing unit 6, a pre-transfer charger 7, a pair of registration rollers 8, a transfer charger 110, a separation charger 111, a separation pick 112, a pre-cleaning charger 113, a cleaning brush 114, and a cleaning blade 115.

The shape of the photoreceptor 10 is not limited in a cylindrical form, and sheet-shaped photoreceptors and endless belt-shaped photoreceptors can also be used.

As the chargers, any known charging means such as corotron, scorotron, solid state chargers, contact charging rollers, and non-contact charging rollers (i.e., a gap is formed between the photoreceptor and the charging roller using a gap forming means, such as a gap tape or a step formed on the ends thereof, so that the roller is located close to the photoreceptor) can be used.

The non-contact chargers have the following advantages:

(1) uneven charging hardly occurs;

(2) chargeability hardly deteriorates even if the charging roller is contaminated; and (3) maintenance-free.

However, the non-contact chargers have a drawback such that high voltage needs to be applied thereto. This is hazardous to the surface of the photoreceptor. The outermost layer (i.e., a charge transport layer or a protective layer) including a polymer is significantly abraded, and therefore the life of the photoreceptor shortens, resulting in increase in cost and maintenance frequency.

When only a DC (direct current) is applied to the non-contact charger, discharging is unstably performed, resulting in producing image unevenness. It is preferable that an AC (alternate current) is overlapped with the DC.

The electrostatic latent image bearing member (i.e., photoreceptor) of the present invention can be stably charged with the non-contact charger without being abraded. In addition, residual potential of the irradiated portion thereof can be decreased, and blurred images are hardly produced. Therefore, the electrostatic latent image bearing member of the present invention can stably produce high quality images even after a long repeated use.

As a transfer means, the above chargers can be used. As illustrated in FIG. 7, the transfer charger 110 and the separation charger 111 are preferably used in combination as the transfer means.

Suitable light sources for use in the light irradiator 5 and the discharging lamp 2 include illuminants such as fluorescent lamps, tungsten lamps, halogen lamps, mercury lamps, sodium lamps, light emitting diodes (LEDs), laser diodes (LDs), and electroluminescence lamps (ELs), but are not limited thereto. In addition, in order to obtain light having a desired wavelength range, filters such as sharp-cut filters, band pass filters, near-infrared filters, dichroic filters, interference filters, and color temperature converting filters can be used.

The above-mentioned light sources can be used not only for the processes mentioned above and illustrated in FIG. 7, but also for other processes using light irradiation, such as the transfer process, the discharging process, and the cleaning process including light irradiation and pre-exposure process.

When the toner image formed on the photoreceptor 10 by the developing unit 6 is transferred onto a recording medium 9, all toner particles of the toner image are not transferred, and some toner particles remain on the photoreceptor 10. If the next image forming process is performed before such residual toner particles are removed, an electrostatic latent image is not sufficiently formed. The residual toner particles are typically removed from the photoreceptor 10 using a cleaning means such as the cleaning brush 114, the cleaning blade 115, and the combination thereof. As the cleaning brush 114, any known brushes such as fur brushes and magnetic fur brushes can be used.

The cleaning blade 115 is made of an elastic material having a low friction coefficient such as urethane resins, silicone resins, fluorocarbon resins, urethane elastomers, silicone elastomers, and fluorocarbon elastomers. Among these, urethane elastomers including a thermosetting urethane resin are preferably used because of having good resistance to abrasion, ozone, and contamination. In this application, rubbers are considered as elastomers.

The cleaning blade 115 preferably has a JIS-A hardness of from 65 to 85, a thickness of from 0.8 to 3.0 mm, and an extended portion of from 3 to 15 mm. Other conditions such as contact pressure, contact angle, and contact length can be determined as desired.

Since the cleaning means contacts the photoreceptor, the cleaning means gives mechanical impact to the photoreceptor and abrades the surface thereof, while removing residual toner particles. The photoreceptor of the present invention has a protective layer having good abrasion resistance, and therefore high quality images can be stably produced even if the cleaning means contacts the photoreceptor.

The image forming apparatus of the present invention may optionally include a lubricant applicator (not shown in FIG. 7) configured to apply a lubricant to the surface of the photoreceptor. It is known that spherical toners, which are considered to have an advantage in producing high quality images and are practically used recently, are difficult to be removed with a cleaning blade, compared to conventional pulverized toners. When a spherical toner is used, the contact pressure of the cleaning blade is increased or a urethane rubber blade having a high hardness is used to improve cleanability of the spherical toner.

In this case, the cleaning blade tends to give much larger impact to the surface of the photoreceptor, and therefore the surface of the photoreceptor is abraded much more when the spherical toner is used. Since the photoreceptor of the present invention has excellent abrasion resistance, the protective layer is hardly abraded even if a large impact is applied thereto. However, a blade noise, which is considered to occur due to high friction coefficient of the cleaning blade, and abrasion of the blade edge may occur.

These problems can be solved by constantly applying a lubricant to the surface of the photoreceptor using a lubricant applicator, so as to decrease friction coefficient of the surface of the photoreceptor to the cleaning blade for a long period of time.

Figure 8:
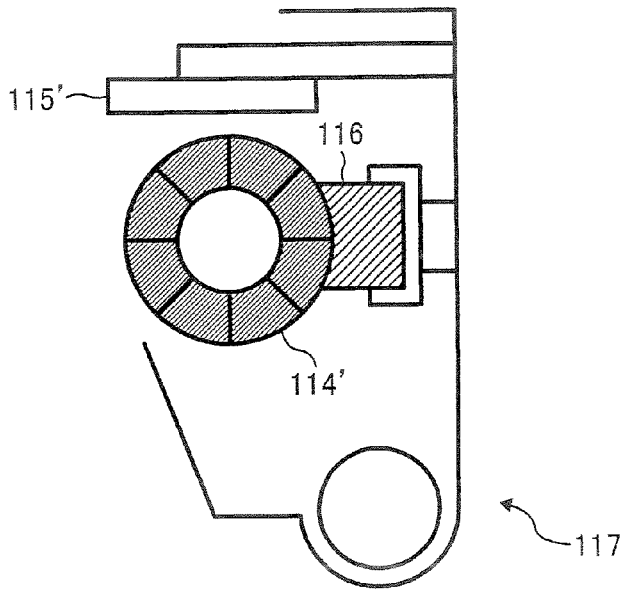
FIG. 8 is a schematic view illustrating an embodiment of a cleaning unit including a lubricant applicator for use in the image forming apparatus of the present invention.

FIG. 8 is a schematic view illustrating an embodiment of a cleaning unit including a lubricant applicator.

A cleaning unit 117 includes a cleaning brush 114', a cleaning blade 115', and a lubricant bar 116. The lubricant bar 116 contacts the cleaning brush 114' under pressure. The cleaning brush 114' rotates to scrape the lubricant off, and the scraped lubricant adhered to the brush is applied to the surface of the photoreceptor.

The lubricant need not be solid. Any known lubricants which can be applied to the surface of the photoreceptor and satisfy electrophotographic property, such as liquid lubricants, powder lubricants, and half-kneaded lubricants can be used, and are not particularly limited.

Specific examples of the lubricants include, but are not limited to, metal soaps (e.g., zinc stearate, barium stearate, aluminum stearate, calcium stearate), waxes (e.g., carnauba waxes, lanolin, haze waxes), lubricant oils (e.g., silicone oils), etc. Among these, zinc stearate, aluminum stearate, and calcium stearate are preferably used because these can be easily converted into a bar and have high lubrication property.

When a lubricant applicator is included in a cleaning unit as illustrated in FIG. 8, there are advantages that the layout around the photoreceptor is easily designed, and the image forming apparatus can be simplified. In contrast, there are disadvantages that a large amount of the lubricant is mixed with removed toner particles and therefore these toner particles cannot be recycled, and cleaning efficiency of the cleaning brush decreases. These disadvantages can be improved when an application unit including a lubricant applicator is independently arranged from a cleaning unit. In this case, the application unit is preferably arranged on a downstream side from the cleaning unit. When plural application units are arranged, each of the application units can simultaneously or successively work so as to improve lubricant application efficiency and to control the amount of consumed lubricant.

Figure 9:
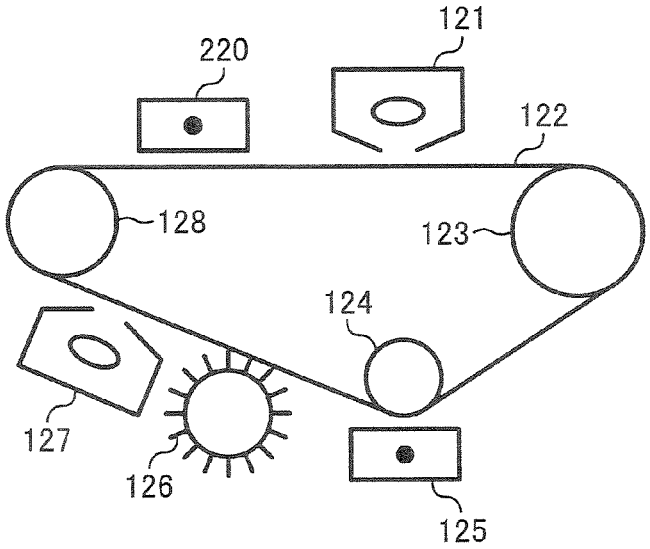
FIG. 9 is a schematic view illustrating another embodiment of the image forming apparatus of the present invention.

FIG. 9 is a schematic view illustrating another embodiment of the image forming apparatus of the present invention.

A photoreceptor 122 is the electrostatic latent image bearing member of the present invention. The photoreceptor 122 is tightly stretched with a drive roller 123 and rollers 124 and 128, and driven by the drive roller 123. The photoreceptor 122 is charged with a charger 220, and then irradiated with light by a light irradiator 121 to form an electrostatic latent image thereon. The electrostatic latent image is developed with a developing device (not shown), and then transferred onto a recording medium using a transfer charger 125. Residual toner particles remaining on the photoreceptor 122 are removed using a cleaning brush 126. The photoreceptor 122 is discharged with a discharging lamp 127.

Figure 10:
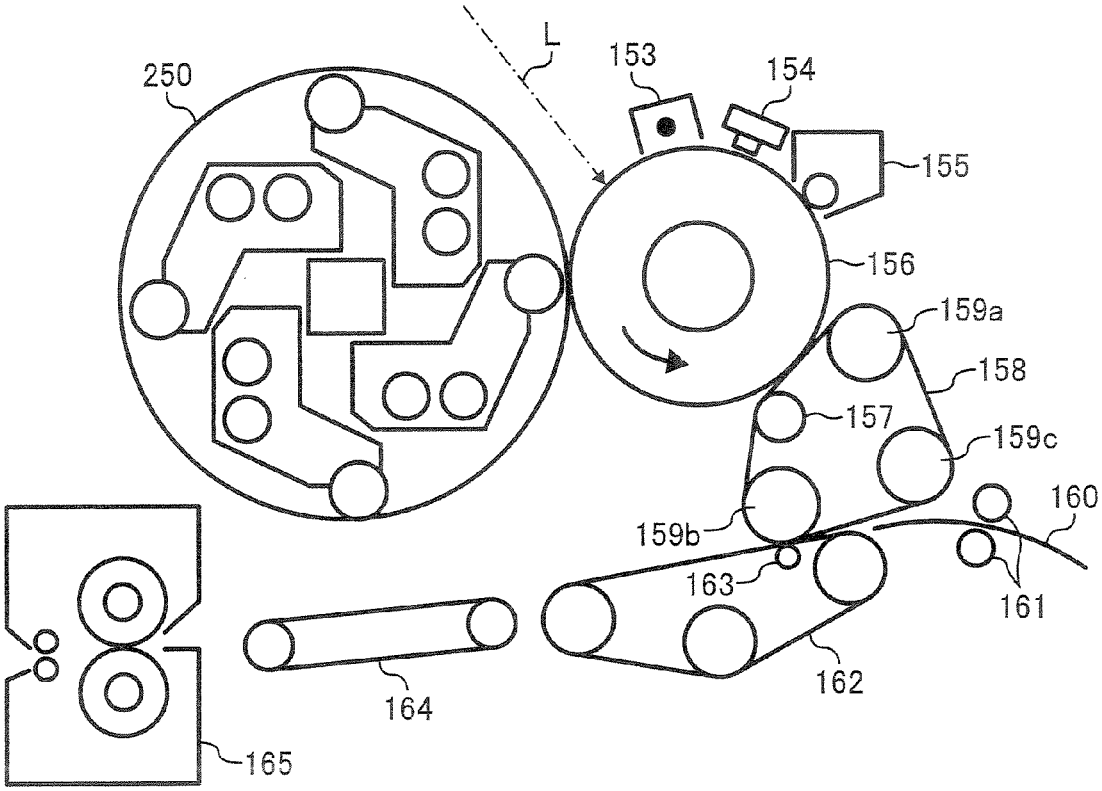
FIG. 10 is a schematic view illustrating another embodiment of the image forming apparatus of the present invention.

FIG. 10 is a schematic view illustrating an embodiment of the full-color image forming apparatus of the present invention.

A photoreceptor 156 is the electrostatic latent image bearing member of the present invention. The photoreceptor 156 is driven to rotate in the counterclockwise direction. The surface of the photoreceptor 156 is uniformly charged with a charger 153 using corotron, scorotron, etc., and is exposed to a laser light beam L emitted by a laser optical device (not shown) to form an electrostatic latent image on the photoreceptor 156. The laser light beam scanning is performed based on single-color information (yellow, magenta, cyan, and black) separated from an original full-color image. Thus, single-color images (yellow, magenta, cyan, and black) are formed on the photoreceptor 156.

On the left side of the photoreceptor 156, a revolver developing unit 250 is arranged. The revolver developing unit 250 includes a yellow developing device, a magenta developing device, a cyan developing device, and a black developing device inside a rotating cylinder, and rotates each developing device to transport the developing device to a developing point facing the photoreceptor 156. The yellow developing device, the magenta developing device, the cyan developing device, and the black developing device develop the electrostatic latent image with a yellow toner, a magenta toner, a cyan toner, and a black toner, respectively. Namely, the electrostatic latent images corresponding to yellow, magenta, cyan, and black images, which are formed one by one by on the photoreceptor 156, are developed one by one by the respective developing devices, and a yellow toner image, a magenta toner image, a cyan toner image, and a black toner image are formed.

An intermediate transfer unit is arranged on a downstream side from the developing point relative to the rotating direction of the photoreceptor 156. An intermediate transfer belt 158 is tightly stretched with a stretching roller 159*a*, an intermediate transfer bias roller 157 serving as a transfer means, a secondary transfer backup roller 159*b*, and a belt drive roller 159*c*. The intermediate transfer belt 158 is endlessly moved in the clockwise direction by the rotary driving force of the belt drive roller 159*c*. The yellow toner image, the magenta toner image, the cyan toner image, and the black toner image formed on the photoreceptor 156 are transported to an intermediate transfer nip at which the photoreceptor 156 contacts the intermediate transfer belt 158. These images are superimposed on the intermediate transfer belt 158 while influenced by a bias applied to the intermediate transfer bias roller 157. Thus, a full color toner image is formed on the intermediate transfer belt 158.

As mentioned above, a typical intermediate transfer method comprises:

forming single-color toner images on a photoreceptor with respective developing means;

primarily transferring each of the single-color toner images onto an intermediate transfer medium one by one to form a full-color image; and secondly transferring the full-color image onto a recording medium.

In this method, positioning of the photoreceptor and the intermediate transfer member can be performed relatively easily and accurately, and therefore color drifts hardly occur. This method is effective for producing high quality full-color images.

After the surface of the photoreceptor 156 passes the intermediate transfer nip by rotation, residual toner particles are removed by a drum cleaning unit 155. The drum cleaning unit 155 removes the residual toner particles with a cleaning roller to which a cleaning bias is applied. A cleaning brush such as a fur brush and a magnetic fur brush, or a cleaning blade can be used instead of the cleaning roller.

After the residual toner particles are removed, the surface of the photoreceptor 156 is discharged with a discharging lamp 154. Specific examples of the discharging lamps include, but are not limited to, fluorescent lamps, tungsten lamps, halogen lamps, mercury lamps, sodium lamps, light emitting diodes (LEDs), laser diodes (LDs), electroluminescent lamps (EL), etc. The laser diode is used for the laser optical device mentioned above. In addition, in order to obtain light having a desired wavelength range, filters such as sharp-cut filters, band pass filters, near-infrared cutting filters, dichroic filters, interference filters, and color temperature converting filters can be used.

A transfer unit including a transfer belt 162, a paper transfer bias roller 163, and plural rollers, is arranged below the intermediate transfer unit. On the left side of the transfer unit, a transport belt 164 and a fixing device 165 are arranged. The transfer belt 162, which is endlessly moved, may be vertically movable. When a first toner image (i.e., yellow toner image) or a two-colored or three-colored toner image formed on the intermediate transfer belt 158 passes a point facing the paper transfer bias roller 163, the transfer belt 162 moves away from the intermediate transfer belt 158. The transfer belt 162 is in contact with the transfer belt 158 again to form a secondary transfer nip, before the tip of a four-colored toner image comes to the point facing the paper transfer bias roller 163.

A recording medium 160 is fed from a feeding cassette (not shown) and is stopped by a pair of registration rollers 161. Then the recording medium 160 is timely fed to the secondary intermediate transfer nip such that the color toner images superimposed on the intermediate transfer belt 158 are transferred onto the recording medium 160. The color toner images superimposed on the intermediate transfer belt 158 are transferred onto the recording medium 160 at the same time at the secondary transfer nip while influenced by the secondary transfer bias applied to the paper transfer bias roller 163. Thus, a full-color image is formed on the recording medium 160.

The recording medium 160 having the full-color image thereon is then transported to the transport belt 164 by the transfer belt 162. The transport belt 164 transports the recording medium 160 from the transfer unit to the fixing device 165. The fixing device 165 transports the recording medium 160 through a fixing nip formed between a heating roller and a backup roller. The full-color image on the recording medium 160 is fixed thereon by a heat of the heating roller and a pressure of the backup roller.

Even though not shown, a bias is applied to the transfer belt 162 or the transport belt 164 so that the recording medium 160 is attracted thereto. In addition, a paper discharger configured to discharge the recording medium 160, and three belt chargers configured to discharge the respective belts (i.e., the intermediate transfer belt 158, the transfer belt 162, and the transport belt 164) are arranged. Moreover, the intermediate transfer unit includes a belt cleaning unit having the same configuration as that of the drum cleaning unit 155 to remove the residual toner particles on the intermediate transfer belt 158.

Figure 11:
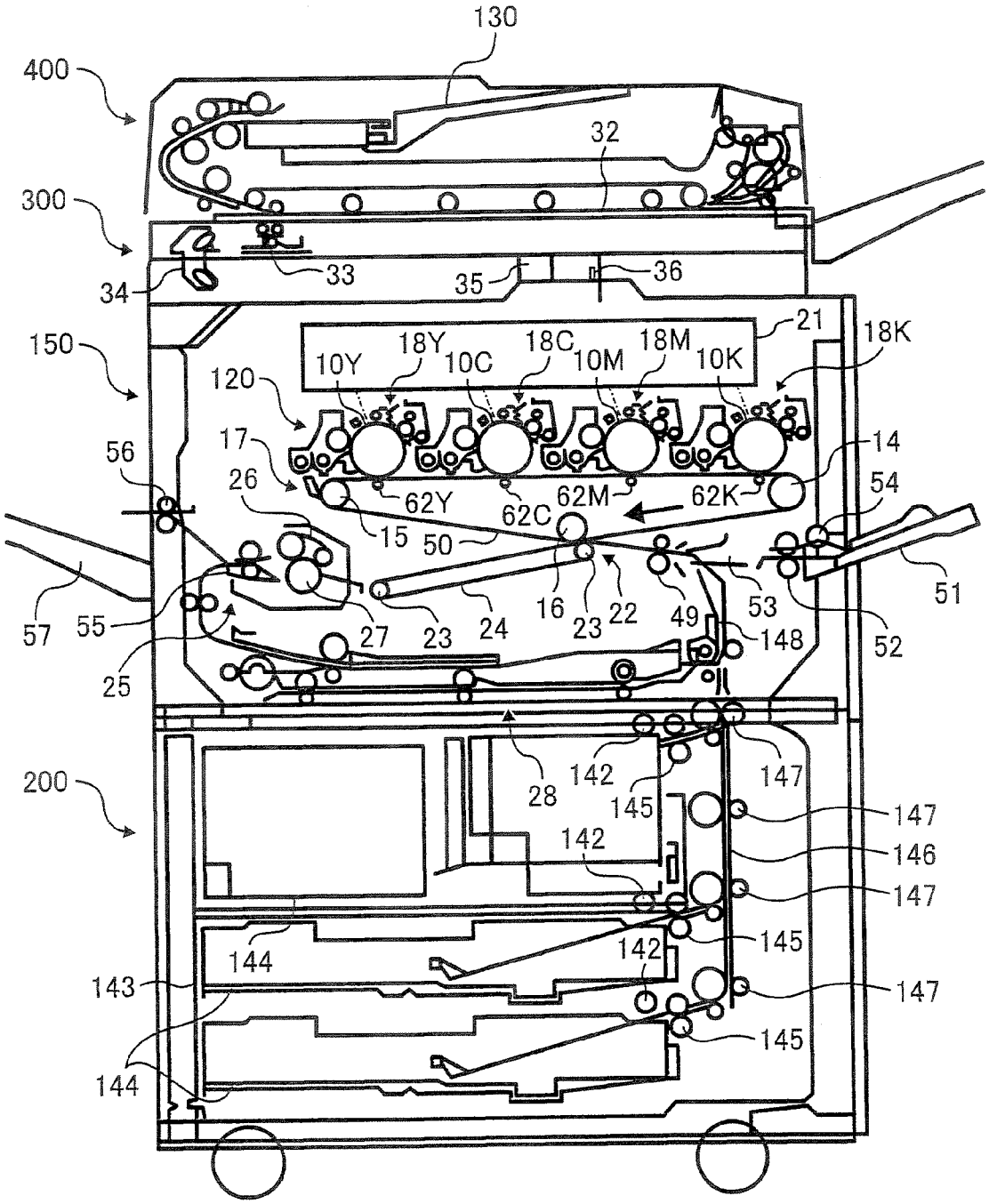
FIG. 11 is a schematic view illustrating another embodiment of the image forming apparatus of the present invention.

FIG. 11 is a schematic view illustrating an embodiment of the tandem-type image forming apparatus of the present invention, which includes plural image forming members such as electrostatic latent image bearing members, electrostatic latent image forming means, developing means, transfer means, and fixing means.

An intermediate transfer medium 50 is arranged in the center of a main body 150. The intermediate transfer medium 50 is an endless belt which is tightly stretched with support rollers 14, 15 and 16 to rotate in the clockwise direction. A cleaning device 17, configured to remove residual toner particles remaining on the intermediate transfer medium 50, is arranged close to the support roller 15. A tandem-type image forming device 120 including image forming units 18Y, 18C, 18M and 18K is arranged facing the intermediate transfer medium 50. The image forming units 18Y, 18C, 18M and 18K are arranged in this order around the intermediate transfer medium 50 relative to the rotating direction thereof. A light irradiator 21 is arranged close to the tandem-type image forming device 120. A secondary transfer device 22 is arranged on the opposite side of the intermediate transfer medium 50 relative to the tandem-type image forming device 120. The secondary transfer device 22 includes a secondary transfer belt 24 tightly stretched with a pair of rollers 23. The secondary transfer belt 24 is an endless belt. A recording medium transported on the secondary transfer belt 24 can contact the intermediate transfer medium 50. A fixing device 25 is arranged close to the secondary transfer device 22.

In the main body 150, a reversing device 28 configured to reverse a recording medium to form images on both sides thereof is arranged close to the secondary transfer device 22 and the fixing device 25.

Next, the procedure of forming a full color image with the tandem-type image forming device 120 will be explained. An original document is set to a document feeder 130 included in an automatic document feeder (ADF) 400, or placed on a contact glass 32 included in a scanner 300.

When a start switch button (not shown) is pushed, the scanner 300 starts driving, and a first runner 33 and a second runner 34 start moving. When the original document is set to the automatic document feeder (ADF) 400, the scanner 300 starts driving after the original document is fed on the contact glass 32. The original document is irradiated with light emitted by a light source via the first runner 33, and the light reflected from the original document is then reflected by a mirror included in the second runner 34. The light passes through an imaging lens 35 and is received by a reading sensor 36. Thus, image information of each color is read.

Image information of each color (yellow, cyan, magenta and black) is transported to each of the image forming units 18Y, 18C, 18M, and 18K of the tandem-type developing device to form each toner image.

Figure 12:
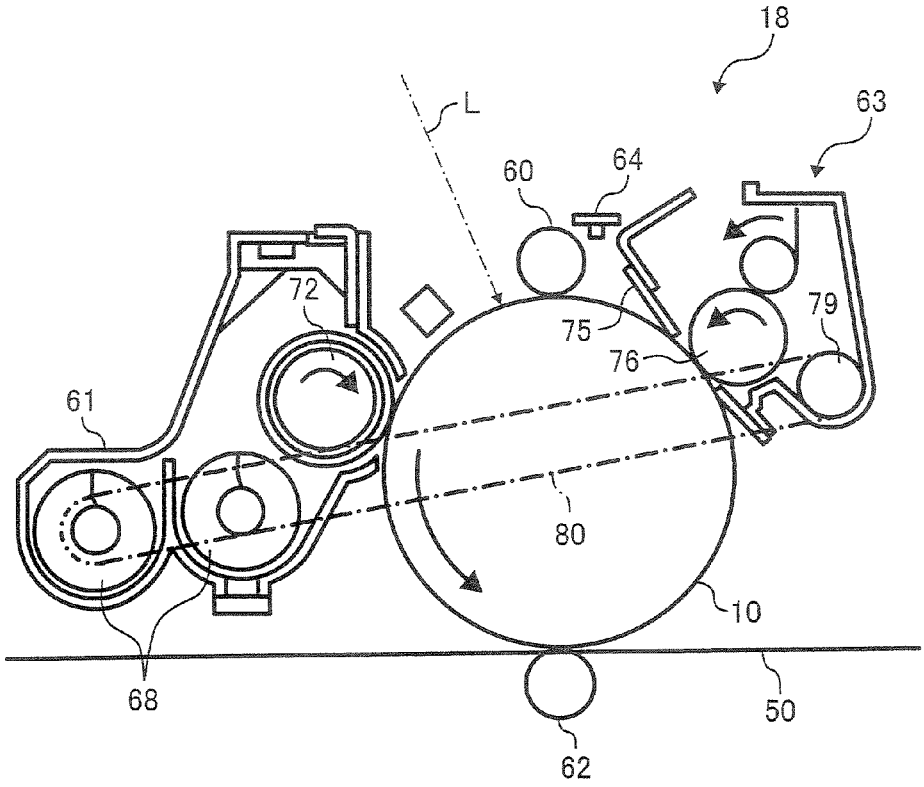
FIG. 12 is a schematic view illustrating an embodiment of the image forming unit of the image forming apparatus illustrated in FIG. 11.

FIG. 12 is a schematic view illustrating an embodiment of the image forming units 18Y, 18C, 18M, and 18K. Since the image forming units 18Y, 18C, 18M, and 18K have the same configuration, only one image forming unit is illustrated in FIG. 12. Symbols Y, C, M, and K, which represent each of the colors, are omitted from the reference number.

The image forming unit 18 includes a photoreceptor 10, a charger 60 configured to uniformly charge the photoreceptor 10, a light irradiator (not shown) configured to form an electrostatic latent image on the photoreceptor 10 by irradiating a light L containing image information corresponding to color information, a developing device 61 configured to form a toner image by developing the electrostatic latent image with a developer including a toner, a transfer charger 62 configured to transfer the toner image onto the intermediate transfer medium 50, a cleaning device 63, and a discharging device 64. Each of the image forming units can form a single-colored image based on each color information.

The thus prepared toner image formed on the photoreceptor 10 of each color is transferred onto the intermediate transfer medium 50, which is rotated by support rollers 14, 15, and 16, one by one (i.e., a primary transfer). Namely, a full-color image is formed by overlaying the toner images of each color.

The toner is mixed with a carrier to prepare a developer. The developer is contained in the developing device 61, and agitated with an agitation screw 68 so as to be friction-charged. The charged developer is held on a magnetic roller 72 and forms magnetic brushes. A part of the toner particles included in the magnetic brushes is electrically attracted on the surface of the photoreceptor 10 to form a visible toner image.

The cleaning device 63 configured to remove residual toner particles remaining on the photoreceptor 10 is arranged on the downstream side from the transfer point. The cleaning device 63 includes a cleaning brush 76 and a cleaning blade 75. The cleaning blade 75 is arranged so as to face the photoreceptor 10 in the reverse direction of rotation of the photoreceptor 10, and removes residual toner particles remaining on the photoreceptor 10.

The removed toner particles can be transported to the developing device 61 again by a recycling means. The toner particles removed by the cleaning device 63 are transported to the developing device 61 by a transport screw 79 and a recycling path 80 so that the toner particles are recycled.

On the other hand, referring to FIG. 11, in the paper feeding table 200, a recording paper is fed from one of multistage paper feeding cassettes 144, included in a paper bank 143, by rotating one of paper feeding rollers 142. The recording paper is separated by separation rollers 145 and fed to a paper feeding path 146. Then the recording paper is transported to a paper feeding path 148, included in the main body 150, by transport rollers 147, and is stopped by a registration roller 49. When the recording paper is fed from a manual paper feeder 51 by rotating a paper feeding roller 54, the recording paper is separated by a separation roller 52 and fed to a manual paper feeding path 53, and is stopped by the registration roller 49. The registration roller 49 is typically grounded, however, a bias can be applied thereto in order to remove a paper powder.

The recording paper is timely fed to an area formed between the intermediate transfer medium 50 and the secondary transfer device 22, by rotating the registration roller 49, to meet the full-color toner image formed on the intermediate transfer medium 50. The full-color toner image is transferred onto the recording material in the secondary transfer device 22 (secondary transfer). Toner particles remaining on the intermediate transfer medium 50 are removed using with cleaning device 17.

The recording paper having the toner image thereon is transported from the secondary transfer device 22 to the fixing device 25. The toner image is fixed on the recording paper upon application of heat and pressure thereto in the fixing device 25. The fixing device 25 includes a fixing belt 26 and a pressing roller 27, wherein the pressing roller 27 is in contact with the fixing belt 26 under pressure.

The recording paper is switched by a switch pick 55 and ejected by an ejection roller 56 and then stacked on an ejection tray 57. When the recording paper is switched by the switch pick 55 to be reversed in the reverse device 28, the recording paper is fed to a transfer area again in order to form a toner image on the backside thereof. And then the recording paper is ejected by the ejection roller 56 and stacked on the ejection tray 57.

A tandem-type image forming apparatus can simultaneously perform electrostatic latent image forming, developing, etc. of each color. Therefore, the tandem-type image forming apparatus can produce images faster than the revolver-type image forming apparatus. The image forming apparatus illustrated in FIG. 11 is a tandem-type image forming apparatus using an intermediate transfer method and the image bearing member of the present invention, and therefore high quality images having no color drift can be stably produced at a high-speed even after long repeated use.

Process Cartridge

The process cartridge of the present invention includes the electrostatic latent image bearing member of the present invention and at least one member selected from an electrostatic latent image forming means, a light irradiating means, a developing means, a transfer means, and a cleaning means.

The developing means includes at least a developer container containing a toner or a developer, and a developer bearing member configured to bear and transport the toner or the developer, and optionally includes a toner layer forming member configured to control the thickness of the toner layer on the developer bearing member.

Figure 13:
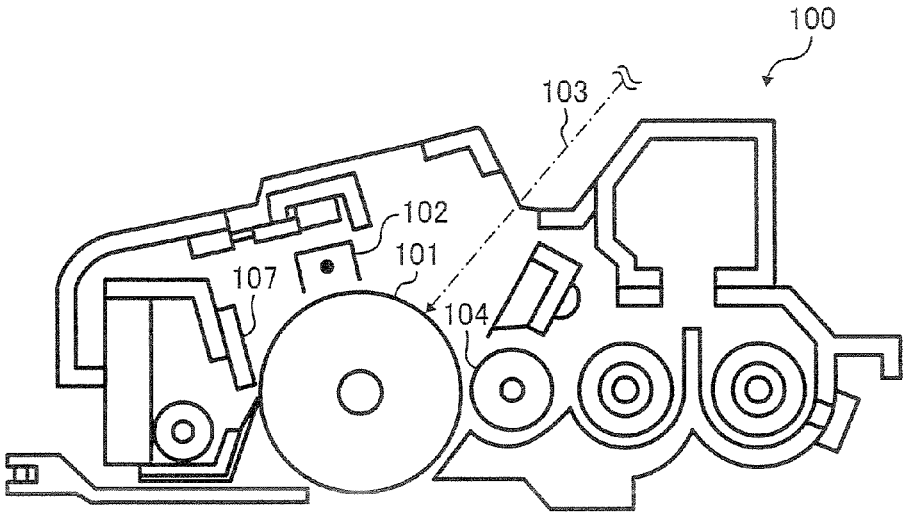
FIG. 13 is a schematic view illustrating an embodiment of the process cartridge of the present invention.

FIG. 13 is a schematic view illustrating an embodiment of the process cartridge of the present invention.

A process cartridge 100 includes a photoreceptor 101, a charger 102, a light irradiator 103, a developing means 104, and a cleaning means 107. The photoreceptor 101 is the electrostatic latent image bearing member of the present invention. The light irradiator 103 includes a light source which can write a high-resolution electrostatic latent image on the photoreceptor 101. Any known charging member can be used for the charger 102.

In the image forming apparatus of the present invention, image forming members such as a developing device, a cleaning device, etc. can be united as a process cartridge and detachably attached thereto. Furthermore, the electrostatic latent image bearing member and one member selected from a charger, a light irradiator, a developing device, and a transfer device can be united as a process cartridge and detachably attached thereto using a guide member such as a rail.

The process cartridge has an advantage that image forming members such as an electrostatic latent image bearing member can be easily replaced with a new one in a short time, and therefore time used for maintenance can be reduced, and the cost can be reduced. Since the electrostatic latent image bearing member and the image forming members are united, the process cartridge has another advantage that they can be precisely positioned.

Toner

Next, the toner for use in the image forming apparatus of the present invention will be explained in detail.

Any known toners can be used for the present invention, and materials used for the toners and manufacturing method of the toners are not particularly limited. Specific examples of the toner manufacturing methods include, but are not limited to, pulverization methods, suspension polymerization methods, emulsification aggregation methods, polymer suspension methods, etc.

For example, in a pulverization method, a mother toner can be prepared by melt-kneading toner constituent materials (e.g., binder resins, colorants, release agents), and then pulverizing the kneaded mixture, followed by classification. The shape of the pulverization toner can be controlled upon application of mechanical impact so as to have an average circularity of from 0.97 to 1.0. Specific examples of the mechanical impact applicators include, but are not limited to, MECHANOFUSION®, HYBRIDIZATION SYSTEM, etc.

In a suspension polymerization method, a toner is prepared as follows:

dispersing a colorant, a release agent, etc., in a monomer containing a oil-soluble polymerization initiator to prepare a toner constituent mixture liquid;

emulsifying the toner constituent mixture liquid in an aqueous medium containing a surfactant, a solid dispersant, etc.;

subjecting the monomer to a polymerization to prepare toner particles; and adhering a particulate inorganic material to the surface of the toner particles by a wet process.

It is preferable that the excess surfactant remaining on the surface of the toner particles are washed away and removed before the particulate inorganic materials are adhered thereto.

When acids such as acrylic acid, methacrylic acid, α-cyanoacrylic acid, α-cyanomethacrylic acid, itaconic acid, crotonic acid, fumaric acid, maleic acid, and maleic anhydride acid, and acrylates and methacrylates having an amino group such as acrylamide, methacrylamide, diacetoneacrylamide, methylol compound thereof, vinylpyridine, vinyl pyrrolidone, vinyl imidazole, ethyleneimine, and dimethylaminoethyl methacrylate are used as one component of the monomer, the surface of the resultant toner has a functional group on the surface thereof. When a dispersant having an acid group or a base group is used as the dispersant, the dispersant adsorbs to the surface of the resultant toner, and therefore the resultant toner has a functional group on the surface thereof.

In an emulsion aggregation method, a toner is prepared as follows:

emulsifying a water-soluble polymerization initiator and a monomer in an aqueous medium using a surfactant, and subjecting the monomer to an emulsion polymerization, to form a latex;

dispersing a colorant, a release agent, etc. in another aqueous medium to prepare a dispersion;

mixing the latex and the dispersion to aggregate dispersed particles in the latex and the dispersion to form aggregated particles;

heating and fusing the aggregated particles to prepare toner particles; and adhering a particulate inorganic material to the surface of the toner particles by a wet process.

When the above-mentioned monomers used for the suspension polymerization method are used for the monomers of the emulsion aggregation method, the surface of the resultant toner has a functional group thereon.

In the present invention, a toner prepared by the following method is preferably used:

dissolving or dispersing toner constituents (i.e., raw materials) in an organic solvent, to prepare a toner constituent mixture liquid; and emulsifying or dispersing the toner constituent mixture liquid in an aqueous medium to prepare toner particles.

Such a toner has the following advantages:

(1) capable of using various kinds of resin;

(2) good granulation property;

(3) easy to control particle diameter, particle diameter distribution, and shape; and (4) good low temperature fixability.

In particular, the above toner includes at least an adhesive base material formed by reacting (i) a compound having an active hydrogen group with (ii) a polymer capable of reacting with the active hydrogen group, a release agent, and a colorant, and may include any known binder resins. The toner may optionally include other components such as a particulate resin and a charge controlling agent. In the present invention, when the toner does not include the adhesive base material formed by reacting (i) a compound having an active hydrogen group with (ii) a polymer capable of reacting with the active hydrogen group, the toner includes at least a binder resin.

The compound having an active hydrogen group is hereinafter referred to as AC, and the polymer capable of reacting with the active hydrogen group is hereinafter referred to as PC.

It is preferable that the above toner is prepared as follows:

dissolving or dispersing toner constituents including at least the AC and the PC in an organic solvent, to prepare a toner constituent mixture liquid;

emulsifying or dispersing the toner constituent mixture liquid in an aqueous medium and subjecting the AC and the PC to a reaction, to prepare a dispersion including toner particles; and removing the organic solvent from the dispersion to obtain toner particles.

Adhesive Base Material

The adhesive base material has adhesiveness to a recording medium such as a paper. The adhesive base material includes at least an adhesive polymer formed by reacting the AC and the PC in an aqueous medium, and may include any known resins.

The adhesive base material preferably has a weight average molecular weight of not less than 1,000, more preferably from 2,000 to 10,000,000, and much more preferably from 3,000 to 1,000,000. When the weight average molecular weight is too small, hot offset resistance of the resultant toner deteriorates.

The adhesive base material preferably has elastic property such that a temperature (TG') at which a storage elastic modulus is 10,000 dyne/cm$^2$ is not less than 100° C., and preferably from 110 to 200° C., when measured at a frequency of 20 Hz. When the TG' is too small, hot offset resistance of the resultant toner deteriorates.

The adhesive base material preferably has viscous property such that a temperature (Tη) at which a viscosity is 1,000 poise is not greater than 180° C., and preferably from 90 to 160° C., when measured at a frequency of 20 Hz. When the Tη is too large, low temperature fixability of the resultant toner deteriorates.

Namely, in order that the resultant toner has a good combination of hot offset resistance and low temperature fixability, TG' is preferably larger than Tη. It is preferable that the difference between TG' and Tη (i.e., (TG'-Tη)) is from 0 to 100° C., more preferably from 10 to 90° C., and much more preferably from 20 to 80° C.

Specific examples of the adhesive base materials include polyester resins, but are not limited thereto. Specific examples of the polyester resins include urea-modified polyester resins, but are not limited thereto.

The urea-modified polyester resin can be prepared by reacting (i) an amine (B) serving as a compound having an active hydrogen group with (ii) a polyester prepolymer (A) having an isocyanate group, serving as a polymer capable of reacting with the active hydrogen group, in an aqueous medium.

The urea-modified polyester resin may include a urethane bond other than the urea bond. In this case, the molar ratio of the urea bond to the urethane bond (i.e., urea bond/urethane bond) is preferably from 100/0 to 10/90, more preferably from 80/20 to 20/80, and much more preferably from 60/40 to 30/70. When the ratio is too small, hot offset resistance of the resultant toner deteriorates.

Specific preferred examples of suitable urea-modified polyester resins include, but are not limited to, the following (1) to (10):

(1) a mixture of (i) a urea-modified compound of a polyester prepolymer, which is obtained by reacting isophorone diisocyanate with a polycondensation product between an ethylene oxide (2 mol) adduct of bisphenol A and isophthalic acid, obtained by using isophorone diamine, and (ii) a polycondensation product between an ethylene oxide (2 mol) adduct of bisphenol A and isophthalic acid;

(2) a mixture of (i) a urea-modified compound of a polyester prepolymer, which is obtained by reacting isophorone diisocyanate with a polycondensation product between an ethylene oxide (2 mol) adduct of bisphenol A and isophthalic acid, obtained by using isophorone diamine, and (ii) a polycondensation product between an ethylene oxide (2 mol) adduct of bisphenol A and terephthalic acid;

(3) a mixture of (i) a urea-modified compound of a polyester prepolymer, which is obtained by reacting isophorone diisocyanate with a polycondensation product between a mixture of an ethylene oxide (2 mol) adduct of bisphenol A and a propylene oxide (2 mol) adduct of bisphenol A, and terephthalic acid, obtained by using isophorone diamine, and (ii) a polycondensation product between a mixture of an ethylene oxide (2 mol) adduct of bisphenol A and a propylene oxide (2 mol) adduct of bisphenol A, and terephthalic acid;

(4) a mixture of (i) a urea-modified compound of a polyester prepolymer, which is obtained by reacting isophorone diisocyanate with a polycondensation product between a mixture of an ethylene oxide (2 mol) adduct of bisphenol A and a propylene oxide (2 mol) adduct of bisphenol A, and terephthalic acid, obtained by using isophorone diamine, and (ii) a polycondensation product between a propylene oxide (2 mol) adduct of bisphenol A and terephthalic acid;

(5) a mixture of (i) a urea-modified compound of a polyester prepolymer, which is obtained by reacting isophorone diisocyanate with a polycondensation product between an ethylene oxide (2 mol) adduct of bisphenol A and terephthalic acid, obtained by using hexamethylene diamine, and (ii) a polycondensation product between an ethylene oxide (2 mol) adduct of bisphenol A and terephthalic acid;

(6) a mixture of (i) a urea-modified compound of a polyester prepolymer, which is obtained by reacting isophorone diisocyanate with a polycondensation product between an ethylene oxide (2 mol) adduct of bisphenol A and terephthalic acid, obtained by using hexamethylene diamine, and (ii) a polycondensation product between a mixture of an ethylene oxide (2 mol) adduct of bisphenol A and a propylene oxide (2 mol) adduct of bisphenol A, and terephthalic acid;

(7) a mixture of (i) a urea-modified compound of a polyester prepolymer, which is obtained by reacting isophorone diisocyanate with a polycondensation product between an ethylene oxide (2 mol) adduct of bisphenol A and terephthalic acid, obtained by using ethylene diamine, and (ii) a polycondensation product between an ethylene oxide (2 mol) adduct of bisphenol A and terephthalic acid;

(8) a mixture of (i) a urea-modified compound of a polyester prepolymer, which is obtained by reacting diphenylmethane diisocyanate with a polycondensation product between an ethylene oxide (2 mol) adduct of bisphenol A and isophthalic acid, obtained by using hexamethylene diamine, and (ii) a polycondensation product between an ethylene oxide (2 mol) adduct of bisphenol A and isophthalic acid;

(9) a mixture of (i) a urea-modified compound of a polyester prepolymer, which is obtained by reacting diphenylmethane diisocyanate with a polycondensation product between a mixture of an ethylene oxide (2 mol) adduct of bisphenol A and a propylene oxide (2 mol) adduct of bisphenol A, and a mixture of terephthalic acid and dodecenyl succinic anhydride, obtained by using hexamethylene diamine, and (ii) a polycondensation product between a mixture of an ethylene oxide (2 mol) adduct of bisphenol A and a propylene oxide (2 mol) adduct of bisphenol A, and isophthalic acid; and

(10) a mixture of (i) a urea-modified compound of a polyester prepolymer, which is obtained by reacting toluene diisocyanate with a polycondensation product between an ethylene oxide (2 mol) adduct of bisphenol A and isophthalic acid, obtained by using hexamethylene diamine, and (ii) a polycondensation product between an ethylene oxide (2 mol) adduct of bisphenol A and isophthalic acid.

Compound Having Active Hydrogen Group

The compound having an active hydrogen group acts as an elongation agent and/or a crosslinking agent when the polymer capable of reacting with the active hydrogen group is subjected to an elongation reaction and/or a crosslinking reaction.

Any known compounds having an active hydrogen group can be used as the compound having an active hydrogen group in the present invention, and are not particularly limited. For example, when a polymer capable of reacting with the active hydrogen group is a polyester prepolymer (A) having an isocyanate group, an amine (B) is preferably used as the compound having an active hydrogen group, because the amine (B) can react with the polyester prepolymer (A) having an isocyanate group so as to prepare a polymer by an elongation reaction or a crosslinking reaction.

Specific examples of the active hydrogen groups include, but are not limited to, hydroxyl group (alcoholic hydroxyl group or phenolic hydroxyl group), amino group, carboxyl group, mercapto group, etc. These can be used alone or in combination. Among these, alcoholic hydroxyl group is preferably used.

Any known amines can be used as the amine (B) of the present invention. Specific examples of the amines (B) include, but are not limited to, diamines (B1), polyamines (B2) having three or more amino groups, amino alcohols (B3), amino mercaptans (B4), amino acids (B5) and blocked amines (B6) in which the amino groups in the amines (B1) to (B5) are blocked. These can be used alone or in combination. Among these amines (B), diamines (B1) and mixtures in which a diamine (B1) is mixed with a small amount of polyamine (B2) are preferably used.

Specific examples of the diamines (B1) include, but are not limited to, aromatic diamines such as phenylene diamine, diethyltoluene diamine, and 4,4'-diaminodiphenyl methane; alicyclic diamines such as 4,4'-diamino-3,3'-dimethyldicyclohexyl methane, diaminocyclohexane, and isophoronediamine; aliphatic diamines such as ethylene diamine, tetramethylene diamine, and hexamethylene diamine; etc.

Specific examples of the polyamines (B2) having three or more amino groups include, but are not limited to, diethylene triamine, triethylene tetramine, etc.

Specific examples of the amino alcohols (B3) include, but are not limited to, ethanolamine, hydroxyethyl aniline, etc.

Specific examples of the amino mercaptan (B4) include, but are not limited to, aminoethyl mercaptan, aminopropyl mercaptan, etc.

Specific examples of the amino acids (B5) include, but are not limited to, amino propionic acid, amino caproic acid, etc.

Specific examples of the blocked amines (B6) include, but are not limited to, ketimine compounds which are prepared by reacting one of the amines (B1) to (B5) with a ketone such as acetone, methyl ethyl ketone and methyl isobutyl ketone; oxazoline compounds; etc.

When an elongation reaction and/or a crosslinking reaction between the compound having an active hydrogen group and the polymer capable of reacting with the active hydrogen is stopped, reaction stopping agents can be used. The reaction stopping agents are preferably used in terms of controlling the molecular weight of the reaction product (i.e., the resultant adhesive base material).

Specific examples of the reaction stopping agents include, but are not limited to, monoamines such as diethyl amine, dibutyl amine, butyl amine and lauryl amine; and blocked amines, i.e., ketimine compounds prepared by blocking the monoamines mentioned above.

The mixing ratio (i.e., an equivalent ratio [NCO]/[NHx]) of the content of the polyester prepolymer (A) having an isocyanate group to the amine (B) is from 1/3 to 3/1, preferably from 1/2 to 2/1, and more preferably from 1/1.5 to 1.5/1.

When the mixing ratio is too small, low temperature fixability of the resultant toner deteriorates. When the mixing ratio is too large, the resultant urea-modified polyester resin has too low a molecular weight, resulting in deterioration of hot offset resistance of the resultant toner.

Polymer Capable of Reacting with Active Hydrogen Group

As the polymer capable of reacting with an active hydrogen group, i.e., prepolymer, any known compounds having a site capable of reacting with an active hydrogen group can be used, and are not particularly limited. Specific examples of such polymers include, but are not limited to, polyol resins, polyacrylic resins, polyester resins, epoxy resins, etc., and derivative resins thereof. These resins can be used alone or in combination. Among these resins, polyester resins are preferably used because of having high fluidity and transparency when melted.

As the site capable of reacting with an active hydrogen group, which is included in the prepolymer, any known functional groups can be used. Specific examples of the functional groups include, but are not limited to, isocyanate group, epoxy group, carboxylic group, acid chloride group, etc. These functional groups can be included in the prepolymer alone or in combination. Among these, isocyanate group is most preferably included therein.

Among the prepolymers, a polyester resin (RMPE) having a functional group capable of forming a urea bond is preferably used. It is easy to control the molecular weight of the resultant resin when such a polyester resin is used, and therefore the resultant resin can impart good releasability and fixability to the resultant toner even if the fixing device includes no oil applying system, which applies a release oil to the heating medium for fixing.

Specific examples of the functional groups capable of forming a urea bond include isocyanate group, but are not limited thereto. When a RMPE includes an isocyanate group as the functional group capable of forming a urea bond, the polyester prepolymer (A) having an isocyanate group is preferably used as the RMPE.

Specific examples of the polyester prepolymers (A) having an isocyanate group include compounds obtained by reacting (i) a base polyester formed by polycondensation reaction between a polyol (PO) and a polycarboxylic acid (PC), and having an active hydrogen group, with (ii) a polyisocyanate (PIC), but are not limited thereto.

As the polyol (PO), diols (DIO), polyols (TO) having three or more valences, and mixtures thereof can be used, and diols (DIO) alone or mixtures of a diol and a small amount of a polyol are preferably used. These can be used alone or in combination. Among these, diols (DIO) and mixtures in which a diol (DIO) is mixed with a small amount of a polyol (TO) having three or more valences are preferably used.

Specific examples of the diols (DIO) include, but are not limited to, alkylene glycols, alkylene ether glycols, alicyclic diols, adducts of the alicyclic diols with an alkylene oxide, bisphenols, adducts of the bisphenols with an alkylene oxide, etc.

Specific examples of the alkylene glycols include, but are not limited to, glycols having 2 to 12 carbon atoms such as ethylene glycol, 1,2-propylene glycol, 1,3-propylene glycol, 1,4-butanediol, and 1,6-hexanediol.

Specific examples of the alkylene ether glycols include, but are not limited to, diethylene glycol, triethylene glycol, dipropylene glycol, polyethylene glycol, polypropylene glycol, polytetramethylene ether glycol, etc.

Specific examples of the alicyclic diols include, but are not limited to, 1,4-cyclohexanedimethanol, hydrogenated bisphenol A, etc.

Specific examples of the adducts of the alicyclic diols with an alkylene oxide include, but are not limited to, the adducts of the alicyclic diol with ethylene oxide, propylene oxide, butylenes oxide, etc.

Specific examples of the bisphenols include, but are not limited to, bisphenol A, bisphenol F, bisphenol S, etc.

Specific examples of the adducts of the bisphenols with an alkylene oxide include, but are not limited to, the adducts of the bisphenol with ethylene oxide, propylene oxide, butylenes oxide, etc.

Among these, alkylene glycols having 2 to 12 carbon atoms and adducts of bisphenols with an alkylene oxide are preferably used, and a mixture thereof is more preferably used.

Specific examples of the polyols (TO) having three or more valences include, but are not limited to, multivalent aliphatic alcohols having three or more valences, polyphenols having three or more valences, adducts of the polyphenols having three or more valences with an alkylene oxide, etc.

Specific examples of the multivalent aliphatic alcohols having three or more valences include, but are not limited to, glycerin, trimethylolethane, trimethylolpropane, pentaerythritol, sorbitol, etc.

Specific examples of the polyphenols having three or more valences include, but are not limited to, trisphenol PA, phenol novolac, cresol novolac, etc.

Specific examples of the adducts of the polyphenols having three or more valences with an alkylene oxide include, but are not limited to, the adducts of the polyphenols having three or more valences with ethylene oxide, propylene oxide, butylenes oxide, etc.

The mixing ratio (i.e., DIO/TO) of the content of the diol (DIO) to the polyol (TO) having three or more valences is preferably from 100/0.01 to 100/10, and more preferably from 100/0.01 to 100/1.

As the polycarboxylic acid (PC), dicarboxylic acids (DIC) and polycarboxylic acids (TC) having three or more valences, and mixtures thereof can be used. These can be used alone or in combination. Among these, dicarboxylic acids (DIC) alone, or mixtures in which a dicarboxylic acid (DIC) is mixed with a small amount of a polycarboxylic acid (TC) having three or more valences are preferably used.

Specific examples of the dicarboxylic acids (DIC) include, but are not limited to, alkylene dicarboxylic acids, alkenylene dicarboxylic acids, aromatic dicarboxylic acids, etc.

Specific examples of the alkylene dicarboxylic acids include, but are not limited to, succinic acid, adipic acid, sebacic acid, etc.

Specific examples of the alkenylene dicarboxylic acids include, but are not limited to, alkenylene dicarboxylic acids having 4 to 20 carbon atoms such as maleic acid and fumaric acid.

Specific examples of the aromatic dicarboxylic acids include, but are not limited to, aromatic dicarboxylic acids having 8 to 20 carbon atoms such as phthalic acid, isophthalic acid, terephthalic acid, and naphthalene dicarboxylic acid.

Among these, alkenylene dicarboxylic acids having 4 to 20 carbon atoms and aromatic dicarboxylic acids having 8 to 20 carbon atoms are preferably used.

Specific examples of the polycarboxylic acid (TC) having three or more valences include, but are not limited to, aromatic polycarboxylic acids, etc.

Specific examples of the aromatic polycarboxylic acids include, but are not limited to, aromatic polycarboxylic acids having 9 to 20 carbon atoms such as trimellitic acid and pyromellitic acid.

As the polycarboxylic acid (PC), acid anhydrides and lower alkyl esters of dicarboxylic acids (DIC), polycarboxylic acids (TC) having three or more valences, and mixtures thereof, can also be used. Suitable lower alkyl esters include, but are not limited to, methyl esters, ethyl esters, isopropyl esters, etc.

The mixing ratio (i.e., DIC/TC) of the content of the dicarboxylic acid (DIC) to the polycarboxylic acid (TC) having three or more valences is preferably from 100/0.01 to 100/10, and more preferably from 100/0.01 to 100/1.

A polyol (PO) and a polycarboxylic acid (PC) are mixed so that the equivalent ratio ([OH]/[COOH]) between a hydroxyl group [OH] and a carboxylic group [COOH] is typically from 2/1 to 1/1, preferably from 1.5/1 to 1/1, and more preferably from 1.3/1 to 1.02/1.

The polyester prepolymer (A) having an isocyanate group preferably includes a polyol (PO) unit in an amount of from 0.5 to 40% by weight, more preferably from 1 to 30% by weight, and much more preferably from 2 to 20% by weight, but the content of the polyol (PO) unit is not particularly limited. When the content is too small, hot offset resistance of the resultant toner deteriorates and the toner cannot have a good combination of thermostable preservability and low temperature fixability. When the content is too large, low temperature fixability of the resultant toner deteriorates.

Specific examples of the polyisocyanates (PIC) include, but are not limited to, aliphatic polyisocyanates, alicyclic polyisocyanates, aromatic diisocyanates, aromatic aliphatic diisocyanates, isocyanurates, phenol derivatives thereof, the above-mentioned polyisocyanates blocked with oxime, caprolactam, etc.

Specific examples of the aliphatic polyisocyanates include, but are not limited to, tetramethylene diisocyanate, hexamethylene diisocyanate, 2,6-diisocyanatemethyl caproate, octamethylene diisocyanate, decamethylene diisocyanate, dodecamethylene diisocyanate, tetradecamethylene diisocyanate, trimethylhexane diisocyanate, tetramethylhexane diisocyanate, etc.

Specific examples of the alicyclic polyisocyanates include, but are not limited to, isophorone diisocyanate, cyclohexylmethane diisocyanate, etc.

Specific examples of the aromatic diisocyanates include, but are not limited to, tolylene diisocyanate, diphenylmethane diisocyanate, 1,5-naphthylene diisocyanate, diphenylene-4,4'-diisocyanate, 4,4'-diisocyanato-3,3'-dimethyldiphenyl, 3-methyldiphenylmethane-4,4'-diisocyanate, diphenylether-4,4'-diisocyanate, etc.

Specific examples of the aromatic aliphatic diisocyanates include, but are not limited to, $\alpha,\alpha,\alpha',\alpha'$-tetramethylxylylene diisocyanate, etc.

Specific examples of the isocyanurates include, but are not limited to, tris-isocyanatoalkyl-isocyanurate, triisocyanatocycloalkyl-isocyanurate, etc.

These can be used alone or in combination.

A polyisocyanate (PIC) is mixed with a polyester resin having an active hydrogen group (e.g., a polyester resin having a hydroxyl group) so that the equivalent ratio ([NCO]/

[OH]) between isocyanate group [NCO] and hydroxyl group [OH] is typically from 5/1 to 1/1, preferably from 4/1 to 1.2/1 and more preferably from 3/1 to 1.5/1. When the ratio [NCO]/[OH] is too large, low temperature fixability of the resultant toner deteriorates. When the ratio [NCO]/[OH] is too small, hot offset resistance of the resultant toner deteriorates.

The polyester prepolymer (A) having an isocyanate group preferably includes a polyisocyanate (PIC) unit in an amount of from 0.5 to 40% by weight, preferably from 1 to 30% by weight, and more preferably from 2 to 20% by weight. When the content is too small, hot offset resistance of the resultant toner deteriorates and the toner cannot have a good combination of thermostable preservability and low temperature fixability. When the content is too large, low temperature fixability of the resultant toner deteriorates.

The average number of isocyanate group included in a molecule of the polyester prepolymer (A) is preferably 1 or more, more preferably from 1.2 to 5, and much more preferably from 1.5 to 4. When the number of isocyanate groups is less than 1 per molecule, the molecular weight of the urea-modified polyester decreases and hot offset resistance of the resultant toner deteriorates.

The polymer capable of reacting with an active hydrogen group preferably has a weight average molecular weight (Mw) of from 1,000 to 30,000, and more preferably from 1,500 to 15,000, when the molecular weight distribution of the tetrahydrofuran (THF) soluble components of the above polymer is determined by gel permeation chromatography (GPC). When the Mw is too small, thermostable preservability of the resultant toner deteriorates. When the Mw is too large, low temperature fixability of the resultant toner deteriorates.

The molecular weight distribution can be measured with a gel permeation chromatography (GPC) system such as HLC-8220GPC (manufactured by Tosoh Corporation) by the following method:

(1) columns are stabilized in a heat chamber at a temperature of 40° C., and THF (i.e., column solvent) flows therein at a flow rate of 1 ml/min; and (2) from 50 to 200 μl of a sample solution of THF having a concentration of from 0.05 to 0.6% by weight is injected to the columns.

A molecular weight is calculated from a calibration curve (i.e., a relationship between molecular weight and count number) prepared using standard monodisperse polystyrenes. For example, standard monodisperse polystyrenes (manufactured by Pressure Chemical Co. or Tosoh Corporation) having a molecular weight of $6\times10^2$, $2.1\times10^2$, $4\times10^2$, $1.75\times10^4$, $1.1\times10^5$, $3.9\times10^5$, $8.6\times10^5$, $2\times10^6$, and $4.48\times10^6$, can be used. It is preferable that at least 10 standard monodisperse polystyrenes are used for preparing the calibration curve. As a detector, a refractive index detector (RI) can be used.

Binder Resin

As the binder resin, any known resins can be used, and are not particularly limited. Specific examples of the binder resins include polyester resins, but are not limited thereto. Among the polyester resins, unmodified polyester resins are preferably used. A toner including an unmodified polyester resin has good low temperature fixability and can produce high glossiness images.

Specific examples of the unmodified polyester resins include polycondensation products of the above-mentioned suitable polyols (PO) and polycarboxylic acids (PC), but are not limited thereto. It is preferable that the unmodified polyester and the urea-modified polyester are partially soluble with each other so as to improve low temperature fixability and hot offset resistance of the resultant toner. Therefore, the unmodified polyester and the urea-modified polyester preferably have similar structures.

The unmodified polyester resin preferably has a weight average molecular weight (Mw) of from 1,000 to 30,000, and more preferably from 1,500 to 15,000, when the molecular weight distribution of the tetrahydrofuran (THF) soluble components of the above polymer is determined by gel permeation chromatography (GPC). When the Mw is too small, thermostable preservability of the resultant toner deteriorates, and therefore the unmodified polyester resin includes components having a weight average molecular weight of less than 1,000 in an amount of from 8 to 28% by weight. When the Mw is too large, low temperature fixability of the resultant toner deteriorates.

The unmodified polyester resin preferably has a glass transition temperature of from 30 to 70° C., more preferably from 35 to 70° C., much more preferably from 35 to 50° C., and even more preferably from 35 to 45° C. When the glass transition temperature is too small, thermostable preservability of the resultant toner deteriorates. When the glass transition temperature is too large, low temperature fixability of the resultant toner deteriorates.

The unmodified polyester resin preferably has a hydroxyl value of not less than 5 mgKOH/g, more preferably from 10 to 120 mgKOH/g, and much more preferably from 20 to 80 mgKOH/g. When the hydroxyl value is too small, the resultant toner cannot have a good combination of thermostable preservability and low temperature fixability.

The unmodified polyester resin preferably has an acid value of from 1.0 to 50.0 mgKOH/g, more preferably from 1.0 to 45.0 mgKOH/g, and much more preferably from 15.0 to 45.0 mgKOH/g. When the unmodified polyester has a proper acid value, the resultant toner can be negatively charged with ease.

A weight ratio of the polymer capable of reacting with an active hydrogen (e.g., a polyester resin capable of forming urea bond) to the unmodified polyester resin is from 5/95 to 80/20, preferably from 10/90 to 25/75. When the weight ratio is too small, the resultant toner has poor hot offset resistance, thermostable preservability and low temperature fixability. When the weight ratio is too large, glossiness of the produced images deteriorates.

The binder resin preferably includes the unmodified polyester resin in an amount of from 50 to 100% by weight, more preferably from 70 to 95% by weight, and much more preferably from 80 to 90% by weight. When the amount is too small, low temperature fixability of the resultant toner and glossiness of the produced images deteriorates.

Colorant

Specific examples of the colorants for use in the present invention include any known dyes and pigments such as carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, etc. These materials can be used alone or in combination.

The toner preferably includes a colorant in an amount of from 1 to 15% by weight, and more preferably from 3 to 10% by weight.

When the amount of the colorant is too small, the coloring power of the resultant toner deteriorates. When the amount of the colorant is too large, the colorant cannot be sufficiently dispersed in the toner, resulting in deterioration of coloring power and electrical property of the resultant toner.

The colorant for use in the present invention can be combined with a resin to be used as a master batch. Specific examples of the resin for use in the master batch include, but are not limited to, styrene polymers and substituted styrene polymers, styrene copolymers, polymethyl methacrylates, polybutyl methacrylates, polyvinyl chlorides, polyvinyl acetates, polyethylenes, polypropylenes, polyesters, epoxy resins, epoxy polyol resins, polyurethanes, polyamides, polyvinyl butyrals, polyacrylic acids, rosins, modified rosins, terpene resins, aliphatic or alicyclic hydrocarbon resins, aromatic petroleum resins, chlorinated paraffins, paraffin waxes, etc. These resins can be used alone or in combination.

Specific examples of the styrene polymers and substituted styrene polymers include, but are not limited to, polystyrenes, poly-p-chlorostyrenes, polyvinyltoluenes, etc. Specific examples of the styrene copolymers include, but are not limited to, styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloro methacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, styrene-maleic acid ester copolymers, etc.

The master batch can be prepared by mixing one or more of the resins as mentioned above and the colorant as mentioned above and kneading the mixture while applying a high shearing force thereto. In this case, an organic solvent can be added to increase the interaction between the colorant and the resin. In addition, a flushing method in which an aqueous paste including a colorant and water is mixed with a resin dissolved in an organic solvent and kneaded so that the colorant is transferred to the resin side (i.e., the oil phase), and then the organic solvent (and water, if desired) is removed can be preferably used because the resultant wet cake can be used as it is without being dried. When performing the mixing and kneading process, dispersing devices capable of applying a high shearing force such as three roll mills can be preferably used.

Release Agent

The toner for use in the present invention may include a release agent. As the release agent, any known release agents can be used, and are not particularly limited. Specific examples of the release agents include waxes, but are not limited thereto.

Specific examples of the waxes include, but are not limited to, waxes having a carbonyl group, polyolefin waxes, long-chain hydrocarbons, etc. These can be used alone or in combination. Among these, waxes having a carbonyl group are preferably used.

Specific examples of the waxes having a carbonyl group include, but are not limited to, polyalkanoic acid esters, polyalkanol esters, polyalkanoic acid amides, polyalkyl amides, dialkyl ketones, etc.

Specific examples of the polyalkanoic acid esters include, but are not limited to, carnauba wax, montan wax, trimethylolpropane tribehenate, pentaerythritol tetrabehenate, pentaerythritol diacetate dibehenate, glycerin tribehenate, 1,18-octadecanediol distearate, etc.

Specific examples of the polyalkanol esters include, but are not limited to, tristearyl trimellitate, distearyl maleate, etc.

Specific examples of the polyalkanoic acid amides include, but are not limited to, dibehenyl amide, etc.

Specific examples of the polyalkyl amides include, but are not limited to, trimellitic acid tristearyl amide, etc.

Specific examples of the dialkyl ketones include, but are not limited to, distearyl ketone, etc.

Among these waxes having a carbonyl group, polyalkanoic acid esters are most preferably used.

Specific examples of the polyolefin waxes include, but are not limited to, polyethylene wax, polypropylene wax, etc.

Specific examples of the long-chain hydrocarbons include, but are not limited to, paraffin wax, SASOL wax, etc.

The release agent preferably has a melting point of from 40 to 160° C., more preferably from 50 to 120° C., and much more preferably from 60 to 90° C. When the melting point is too small, thermostable preservability of the resultant toner deteriorates. When the melting point is too large, cold offset tends to occur when the resultant toner is fixed at low temperatures.

The release agent preferably has a melt viscosity of 5 to 1000 cps, and more preferably from 10 to 100 cps, when measured at a temperature larger than the melting point thereof by 20° C. When the melt viscosity is too small, releasability of the resultant toner deteriorates. When the melt viscosity is too large, hot offset resistance and low temperature fixability of the resultant toner deteriorates.

The toner preferably includes the release agent in an amount of from 0 to 40% by weight, and more preferably from 3 to 30% by weight. When the amount is too large, fluidity of the resultant toner deteriorates.

Charge Controlling Agent

Any known charge controlling agents can be used for the toner for use in the present invention, and are not particularly limited. Since colored materials tend to change color tone of the resultant toner, colorless materials or whitish materials are preferably used. Specific examples of such charge controlling agents include triphenylmethane dyes, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, and salicylic acid derivatives, but are not limited thereto. These can be used alone or in combination.

Specific examples of commercially available charge controlling agents include, but are not limited to, BONTRON® P-51 (quaternary ammonium salt), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® PR (triphenyl methane derivative), COPY CHARGE®NEG VP2036 and COPY CHARGE® NX VP434 (quaternary ammonium salt), which are manufactured by Hoechst AG; LRA-901, and LR-147 (boron complex), which are manufactured by Japan Carlit Co., Ltd.; quinacridone; azo pigments and polymers having a functional group such as a sulfonate group, a carboxyl group, a quaternary ammonium group; etc.

The charge controlling agent can be melt-kneaded with a master batch or a binder resin, or directly dissolved in an organic solvent, or fixed on the surface of the toner.

The content of the charge controlling agent is determined depending on the species of the binder resin used, whether or not an additive is added and dispersing method used, and is not particularly limited. However, the content of the charge controlling agent is typically from 0.1 to 10 parts by weight, and preferably from 0.2 to parts by weight, based on 100 parts by weight of the binder resin included in the toner. When the content is too small, the resultant toner has poor chargeability. When the content is too large, the resultant toner has too large a charge quantity, and thereby the electrostatic force of a developing roller attracting the toner increases, resulting in deterioration of the fluidity of the toner and image density of the toner images.

Particulate Resin

In the present invention, any known toners manufactured by any known methods such as suspension-polymerization methods, emulsion-aggregation methods, emulsion-dispersion methods, etc., can be used, but the above-mentioned toner which is prepared by the following method is preferably used:

dissolving or dispersing toner constituents including a compound having an active hydrogen group and a polymer capable of reacting with the active hydrogen group in an organic solvent, to prepare a toner constituent mixture liquid;

dispersing the toner constituent mixture liquid in an aqueous medium and subjecting the compound having an active hydrogen group and the polymer capable of reacting with the active hydrogen group to a reaction, to prepare an emulsion or a dispersion of toner particles; and removing the organic solvent from the emulsion or the dispersion to prepare the toner particles.

In this method, toner particles are preferably manufactured in an aqueous medium containing a particulate resin. In this case, it is possible to control the shape and particle diameter distribution of the resultant toner, i.e., a toner having a narrow particle diameter distribution can be prepared.

Any known resins capable of forming an aqueous dispersion thereof can be used for the particulate resin of the present invention, and are not particularly limited. Both thermoplastic resins and thermosetting resins can be used. Specific examples of the resins for use in the particulate resin include, but are not limited to, vinyl resins, polyurethane resins, epoxy resins, polyester resins, polyamide resins, polyimide resins, silicon resins, phenol resins, melamine resins, urea resins, aniline resins, ionomer resins, polycarbonate resins, etc.

These resins can be used alone or in combination. Among these resins, vinyl resins, polyurethane resins, epoxy resins, polyester resins, and mixtures thereof are preferably used because these resins can easily form an aqueous dispersion of fine particles thereof.

Specific examples of the vinyl resins include, but are not limited to, homopolymers and copolymers of a vinyl monomer such as styrene-(meth)acrylate copolymers, styrene-butadiene copolymers, (meth)acrylic acid-acrylate copolymers, styrene-acrylonitrile copolymers, styrene-maleic anhydride copolymers, and styrene-(meth)acrylic acid copolymers.

As the particulate resin, copolymers comprising a monomer having at least 2 unsaturated groups can be used.

Specific examples of the copolymers comprising a monomer having at least 2 unsaturated groups include, but are not limited to, sodium salts of sulfate of an ethylene oxide adduct of methacrylic acid (e.g., ELEMINOL RS-30 from Sanyo Chemical Industries Ltd.), divinylbenzene, 1,6-hexanediol acrylate, etc.

The particulate resin can be polymerized by any known methods, and preferably prepared as an aqueous dispersion thereof. Suitable methods for forming an aqueous dispersion of a particulate resin include the following methods:

(1) When the resin is a vinyl resin, an aqueous dispersion of a particulate resin is directly formed by polymerization reaction (such as suspension polymerization, emulsion polymerization, seed polymerization, and dispersion polymerization) of monomers in an aqueous medium.

(2) When the resin is a polyaddition resin or a polycondensation resin such as polyester resin, polyurethane resin, and epoxy resin, a precursor of the resin (such as monomer and oligomer) or a solvent solution of the precursor is dispersed in an aqueous medium in the presence of a suitable dispersing agent, followed by heating or adding a curing agent so that an aqueous dispersion of a particulate resin is formed.

(3) When the resin is a polyaddition resin or a polycondensation resin such as polyester resin, polyurethane resin, and epoxy resin, a precursor of the resin (such as monomer and oligomer, preferably in liquid form, if not liquid, preferably liquefied by the application of heat) or a solvent solution of the precursor is phase-inversion emulsified by adding an aqueous medium after adding a suitable emulsifying agent thereto so that an aqueous dispersion of a particulate resin is formed.

(4) A resin formed by polymerization reaction (such as addition polymerization, ring-opening polymerization, condensation polymerization, addition condensation, etc.) is pulverized using a mechanical rotational type pulverizer or a jet type pulverizer, followed by classification, to prepare a particulate resin. The particulate resin is dispersed in an aqueous medium in the presence of a suitable dispersing agent so that an aqueous dispersion of the particulate resin is formed.

(5) A resin formed by polymerization reaction (such as addition polymerization, ring-opening polymerization, condensation polymerization, addition condensation, etc.) is dissolved in a solvent, and then the resin solution is sprayed in the air to prepare a particulate resin. The particulate resin is dispersed in an aqueous medium in the presence of a suitable dispersing agent so that an aqueous dispersion of the particulate resin is formed.

(6) A resin formed by polymerization reaction (such as addition polymerization, ring-opening polymerization, condensation polymerization, addition condensation, etc.) is dissolved in a solvent to prepare a resin solution. Another solvent is added to the resin solution or the resin solution is subjected to cooling after heating, and then the solvent is removed so that a particulate resin separates out. The particulate resin is dispersed in an aqueous medium in the presence of a suitable dispersing agent so that an aqueous dispersion of the particulate resin is formed.

(7) A resin formed by polymerization reaction (such as addition polymerization, ring-opening polymerization, condensation polymerization, addition condensation, etc.) is dissolved in a solvent, and then the resin solution is dispersed in an aqueous medium in the presence of a suitable dispersing agent, followed by removal of the solvent, so that an aqueous dispersion of a particulate resin is formed.

(8) A resin formed by polymerization reaction (such as addition polymerization, ring-opening polymerization, condensation polymerization, addition condensation, etc.) is dissolved in a solvent, and then the resin solution is phase-inversion emulsified by adding an aqueous medium after adding a suitable emulsifying agent thereto so that an aqueous dispersion of a particulate resin is formed.

Toner Constituent Mixture Liquid

The toner constituent mixture liquid can be prepared by dissolving or dispersing toner constituents in an organic solvent. Any known organic solvents which can dissolve and/or disperse the toner constituents can be used, and are not particularly limited.

Volatile organic solvents having a boiling point of less than 150° C. are preferably used because such solvents can be easily removed. Specific examples of the organic solvents include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc., but are not limited thereto. Among these, toluene, xylene, benzene, methylene chloride, 1,2-dichloroethane, chloroform, and carbon tetrachloride, are preferably used, and ethyl acetate is most preferably used. These organic solvents can be used alone or in combination.

The toner constituent mixture liquid typically includes an organic solvent in an amount of from 40 to 300 parts by weight, preferably from 60 to 140 parts by weight, and more preferably from 80 to 120 parts by weight, based on 100 parts by weight of the toner constituents.

Dispersion

The dispersion can be prepared by dispersing the toner constituent mixture liquid in an aqueous medium. The dispersion contains oil droplets consisting essentially of the toner constituent mixture liquid.

Aqueous Medium

Any known aqueous media can be used in the present invention, and are not particularly limited. Specific examples of the aqueous media include, but are not limited to, water, solvents which can be mixed with water, mixtures thereof, etc. Among these, water is preferably used.

Specific examples of the solvents which can be mixed with water include, but are not limited to, alcohols, dimethylformamide, tetrahydrofuran, cellosolves, lower ketones, etc.

Specific examples of the alcohols include, but are not limited to, methanol, isopropanol, ethylene glycol, etc. Specific examples of the lower ketones include, but are not limited to, acetone, methyl ethyl ketone, etc. These can be used alone or in combination.

The toner constituent mixture liquid is preferably dispersed in an aqueous medium while agitated. Any known dispersing methods can be used, and are not particularly limited. For example, any known dispersing machines can be used. Specific examples of the dispersing machines include, but are not limited to, low shearing force type dispersing machines, high shearing force type dispersing machines, friction type dispersing machines, high pressure jet type dispersing machines, ultrasonic dispersing machines, etc. Among these, high shearing force type dispersing machines are preferably used, because the particle diameter of the dispersing element (i.e., oil droplet) can be easily controlled to 2 to 20 μm.

When high shearing force type dispersing machines are used, the rotation speed of rotors is not particularly limited, but the rotation speed is typically from 1,000 to 30,000 rpm and preferably from 5,000 to 20,000 rpm. In addition, the dispersing time is also not particularly limited, but the dispersing time is generally from 0.1 to 5 minutes for batch dispersing machines. The temperature in the dispersing process is typically from 0 to 150° C. (under pressure), and preferably from 40 to 98° C. It is preferable that the temperature is relatively high because the toner constituent mixture liquid can be easily dispersed.

The toner for use in the present invention can be prepared by granulating the above-mentioned adhesive base material. This method comprises:

preparing an aqueous medium liquid, a toner constituent mixture liquid; and dispersing the toner constituent mixture liquid in the aqueous medium liquid to prepare a dispersion while synthesizing the compound having an active hydrogen group and the polymer (i.e., prepolymer) capable of reacting with the active hydrogen.

The aqueous medium liquid can be prepared by dispersing a particulate resin in an aqueous medium. The aqueous medium liquid preferably includes the particulate resin in an amount of from 0.5 to 10% by weight, but the amount is not limited thereto.

The toner constituent mixture liquid can be prepared by dissolving or dispersing toner constituents such as a compound having an active hydrogen group, a polymer capable of reacting with the active hydrogen group, a colorant, a release agent, a charge controlling agent, and an unmodified polyester resin, in an organic solvent. In order to form a layer including a particulate inorganic oxide in the toner surface region having a depth of 1 μm, the toner constituent mixture liquid may include a particulate inorganic material such as silica, titania, and alumina.

The toner constituents except the polymer (i.e., prepolymer) capable of reacting with the active hydrogen can be added to the aqueous medium when the particulate resin is dispersed therein to prepare the aqueous medium liquid, or added to the aqueous medium liquid when the toner constituent mixture liquid is added thereto.

The dispersion can be prepared by emulsifying or dispersing the toner constituent mixture liquid in the aqueous medium liquid. An adhesive base material is formed by subjecting the compound having an active hydrogen group and the polymer (i.e., prepolymer) capable of reacting with the active hydrogen to an elongation or a crosslinking reaction at the time of the emulsification or the dispersion.

The following methods are suitable for preparing the adhesive base material.

(1) A toner constituent mixture liquid containing a polymer capable of reacting with an active hydrogen group (e.g., the polyester prepolymer (A) having an isocyanate group) is emulsified or dispersed in an aqueous medium together with a compound having an active hydrogen group (e.g., the amine (B)), to prepare a dispersion of the toner constituent mixture liquid while subjecting the compound having an active hydrogen group and the polymer capable of reacting with the active hydrogen group to an elongation and/or crosslinking reaction.

(2) The toner constituent mixture liquid is emulsified or dispersed in an aqueous medium previously containing a compound having an active hydrogen group, to prepare a dispersion of the toner constituent mixture liquid while subjecting the compound having an active hydrogen group and the polymer capable of reacting with the active hydrogen group to an elongation and/or crosslinking reaction.

(3) The toner constituent mixture liquid is emulsified or dispersed in an aqueous medium, and then the compound having an active hydrogen group is added thereto, to prepare a dispersion of the toner constituent mixture liquid while subjecting the compound having an active hydrogen group and the polymer capable of reacting with the active hydrogen group to an elongation and/or crosslinking reaction.

In the above method (3), a modified polyester resin is selectively formed on the surface of the produced toner particles, i.e., the resultant toner can have a concentration gradient thereof.

The reaction conditions for preparing the adhesive base material are not particularly limited, and depend on a combination of a compound having an active hydrogen group and a polymer capable of reacting with the active hydrogen group. However, the reaction time is preferably from 10 minutes to 40 hours, and more preferably from 2 to 24 hours. The reaction temperature is preferably from 0 to 150° C., and more preferably from 40 to 98° C.

In order to stably form an aqueous dispersion containing the polymer capable of reacting with an active hydrogen group (e.g., the polyester prepolymer (A) having an isocyanate group), it is preferable that a toner constituent mixture liquid, which is prepared by dissolving or dispersing the polymer capable of reacting with an active hydrogen group (e.g., the polyester prepolymer (A) having an isocyanate group), a colorant, a charge controlling agent, a unmodified polyester resin, etc., in an organic solvent, is dispersed in an aqueous medium upon application of shear force. However, the dispersing method is not limited thereto.

When the toner constituent mixture liquid is emulsified or dispersed in an aqueous medium, a dispersant is preferably used to improve stability of the dispersion so as to obtain a toner having a desired shape and a narrow particle diameter distribution.

Any known dispersants can be used in the present invention, and are not particularly limited. Specific examples of the dispersants include, but are not limited to, surfactants, water-insoluble inorganic dispersants, polymeric protection colloids, etc. These can be used alone or in combination. Among these, surfactants are preferably used.

Specific examples of the surfactants include, but are not limited to, anionic surfactants, cationic surfactants, nonionic surfactants, ampholytic surfactants, etc.

Specific examples of the anionic surfactants include, but are not limited to, alkylbenzene sulfonic acid salts, α-olefin sulfonic acid salts, phosphoric acid salts, etc. In particular, anionic surfactants having a fluoroalkyl group are preferably used. Specific examples of the anionic surfactants having a fluoroalkyl group include, but are not limited to, fluoroalkyl carboxylic acids having 2 to 10 carbon atoms and metal salts thereof, disodium perfluorooctanesulfonylglutamate, sodium 3-{ω-fluoroalkyl(C6-C11)oxy}-1-alkyl(C3-C4) sulfonate, sodium 3-{ω-fluoroalkanoyl (C6-C8)-N-ethylamino}-1-propanesulfonate, fluoroalkyl(C11-C20) carboxylic acids and metal salts thereof, perfluoroalkyl(C7-C13) carboxylic acids and metal salts thereof, perfluoroalkyl(C4-C12) sulfonate and metal salts thereof, perfluorooctanesulfonic acid diethanol amides, N-propyl-N-(2-hydroxyethyl)perfluorooctanesulfone amide, perfluoroalkyl(C6-C10)sulfoneamidepropyltrimethyl ammonium salts, salts of perfluoroalkyl(C6-C10)-N-ethylsulfonyl glycin, monoperfluoroalkyl(C6-C16) ethylphosphates, etc. Specific examples of useable commercially available surfactants include, but are not limited to, SARFRON® S-111, S-112 and S-113, which are manufactured by Asahi Glass Co., Ltd.; FLUORAD® FC-93, FC-95, FC-98 and FC-129, which are manufactured by Sumitomo 3M Ltd.; UNIDYNE® DS-101 and DS-102, which are manufactured by Daikin Industries, Ltd.; MEGAFACE® F-110, F-120, F-113, F-191, F-812 and F-833 which are manufactured by Dainippon Ink and Chemicals, Inc.; ECTOP® EF-102, 103, 104, 105, 112, 123A, 123B, 306A, 501, 201 and 204, which are manufactured by Tochem Products Co., Ltd.; FUTARGENT® F-100 and F-150 manufactured by Neos; etc.

Specific examples of the cationic surfactants include, but are not limited to, amine salts, quaternary ammonium salts, etc. Specific examples of the amine salts include, but are not limited to, alkyl amine salts, aminoalcohol fatty acid derivatives, polyamine fatty acid derivatives, imidazoline, etc. Specific examples of the quaternary ammonium salts include, but are not limited to, alkyltrimethyl ammonium salts, dialkyldimethyl ammonium salts, alkyldimethyl benzyl ammonium salts, pyridinium salts, alkyl isoquinolinium salts, benzethonium chloride, etc. In addition, primary, secondary and tertiary aliphatic amines having a fluoroalkyl group, aliphatic quaternary salts such as perfluoroalkyl(C6-C10)sulfoneamidepropyltrimethylammonium salts, benzalkonium salts, benzetonium chloride, pyridinium salts, imidazolinium salts, etc., can be used. Specific examples of useable commercially available products thereof include, but are not limited to, SARFRON® S-121 (from Asahi Glass Co., Ltd.); FLUORAD® FC-135 (from Sumitomo 3M Ltd.); UNIDYNE® DS-202 (from Daikin Industries, Ltd.); MEGAFACE® F-150 and F-824 (from Dainippon Ink and Chemicals, Inc.); ECTOP® EF-132 (from Tohchem Products Co., Ltd.); FUTARGENT® F-300 (from Neos); etc.

Specific examples of the nonionic surfactants include, but are not limited to, fatty acid amine derivatives, polyhydric alcohol derivatives, etc.

Specific examples of the ampholytic surfactants include, but are not limited to, aniline, dodecyldi(aminoethyl)glycin, di(octylaminoethyl)glycin, N-alkyl-N,N-dimethylammonium betaine, etc.

Specific examples of the water-insoluble inorganic dispersants include, but are not limited to, tricalcium phosphate, calcium carbonate, titanium oxide, colloidal silica, hydroxyapatite, etc.

Specific examples of the protection colloids include, but are not limited to, polymers and copolymers prepared using monomers such as acids, (meth)acrylic monomers having a hydroxyl group, vinyl alcohols and ethers thereof, esters of a vinyl alcohol with a compound having a carboxyl group, amide compounds and methylol compounds thereof, chlorides, and monomers having a nitrogen atom or an alicyclic ring having a nitrogen atom; polyoxyethylene compounds; cellulose compounds; etc.

Specific examples of the acids include, but are not limited to, acrylic acid, methacrylic acid, α-cyanoacrylic acid, α-cyanomethacrylic acid, itaconic acid, crotonic acid, fumaric acid, maleic acid, maleic anhydride, etc.

Specific examples of the (meth)acrylic monomers having a hydroxyl group include, but are not limited to, β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, glycerinmonomethacrylic acid esters, N-methylolacrylamide, N-methylolmethacrylamide, etc.

Specific examples of the vinyl alcohols and ethers thereof include, but are not limited to, vinyl methyl ether, vinyl ethyl ether, vinyl propyl ether, etc.

Specific examples of the esters of a vinyl alcohol with a compound having a carboxyl group include, but are not limited to, vinyl acetate, vinyl propionate, vinyl butyrate, etc.

Specific examples of the amide compounds and methylol compounds thereof include, but are not limited to, acrylamide, methacrylamide, diacetoneacrylamide acid, etc., and methylol compounds thereof.

Specific examples of the chlorides include, but are not limited to, acrylic acid chloride, methacrylic acid chloride, etc.

Specific examples of the monomers having a nitrogen atom or an alicyclic ring having a nitrogen atom include, but are not limited to, vinyl pyridine, vinyl pyrrolidone, vinyl imidazole, ethylene imine, etc.

Specific examples of the polyoxyethylene compounds include, but are not limited to, polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, polyoxyethylene nonylphenyl esters, etc.

Specific examples of the cellulose compounds include, but are not limited to, methyl cellulose, hydroxyethyl cellulose, hydroxypropyl cellulose, etc.

When the dispersion is prepared, a dispersion stabilizer can be optionally used.

Specific examples of the dispersion stabilizer include, but are not limited to, calcium phosphate, which is soluble both in acids and bases, etc. When the compound soluble both in acids and bases are used as a dispersion stabilizer, the dispersion stabilizer can be removed by being dissolved by acids such as hydrochloric acid, followed by washing with water, or being decomposed by an enzyme.

When the dispersion is prepared, a catalyst of the elongation and/or crosslinking reaction can be optionally used. Specific examples of the catalysts include, but are not limited to, dibutyltin laurate, dioctyltin laurate, etc.

The organic solvent is removed from the dispersion (i.e., emulsion slurry). In order to remove an organic solvent from the emulsion, the following methods can be used.

(1) The emulsion is gradually heated to completely evaporate the organic solvent present in the drops of the oil phase.

(2) The emulsion is sprayed in a dry environment to dry the organic solvent in the drops of the oil phase and water in the dispersion, resulting in formation of toner particles.

After the organic solvent is removed, toner particles are obtained. The toner particles are subjected to washing and drying treatment, and then optionally subjected to classification. The toner particles can be classified by removing fine particles by methods such as cyclone, decantation, centrifugal separation, etc., in a liquid. Of course, the dried toner particles can be classified by the above methods.

The dried toner particles can be mixed with other particulate materials such as colorant, release agent, charge controlling agent, etc., optionally upon application of a mechanical impact thereto to fix and fuse the particulate materials on the surface of the toner particles.

Specific examples of such mechanical impact application methods include, but are not limited to, methods in which a mixture is mixed with a highly rotated blade and methods in which a mixture is put into air to collide the particles against each other or a collision plate. Specific examples of such mechanical impact applicators include, but are not limited to, ONG MILL (manufactured by Hosokawa Micron Co., Ltd.), modified I TYPE MILL in which the pressure of air used for pulverizing is reduced (manufactured by Nippon Pneumatic Mfg. Co., Ltd.), HYBRIDIZATION SYSTEM (manufactured by Nara Machine Co., Ltd.), KRYPTON SYSTEM (manufactured by Kawasaki Heavy Industries, Ltd.), automatic mortars, etc.

Particle Diameter

The toner for use in the present invention preferably has a volume average particle diameter (Dv) of from 3 to 8 μm, more preferably from 4 to 7 μm, and much more preferably from 5 to 6 μm. The volume average particle diameter (Dv) is defined by the following formula:

$$Dv=[(\Sigma(nD^3)/\Sigma n)]^{1/3}$$

wherein n represents the number of the toner particles, and D represents the particle diameter.

When the Dv is too small, the toner tends to fuse on the surface of the carrier by long-term agitation in a developing device, resulting in deterioration of chargeability of the carrier, when the toner is used for a two-component developer. When the toner is used for a one-component developer, problems such that the toner forms a film on a developing roller, and the toner fuses on a toner layer forming member tend to occur. In contrast, when the Dv is too large, it is difficult to obtain high definition and high quality images. In addition, an average particle diameter of toner particles included in a developer tends to be largely changed when the toner particles are partially replaced with fresh toner particles.

The toner preferably has a ratio (Dv/Dn) of the volume average particle diameter (Dv) to a number average particle diameter (Dn) of not greater than 1.25, more preferably from 1.00 to 1.20, and much more preferably from 1.10 to 1.20.

When the ratio (Dv/Dn) is relatively small, the toner has a relatively narrow particle diameter distribution and has good fixability. When the ratio (Dv/Dn) is too small, the toner tends to fuse on the surface of the carrier by long-term agitation in a developing device, resulting in deterioration of chargeability of the carrier, when the toner is used for a two-component developer. When the toner is used for a one-component developer, problems such that the toner forms a film on a developing roller, and the toner fuses on a toner layer forming member tend to be caused. In contrast, when the ratio (Dv/Dn) is too large, it is difficult to obtain high definition and high quality images. In addition, an average particle diameter of toner particles included in a developer tends to be largely changed when the toner particles are partially replaced with fresh toner particles.

The volume average particle diameter (Dv), the number average particle diameter (Dn), and the ratio (Dv/Dn) can be determined with an instrument such as COULTER MULTISIZER II (manufactured by Coulter Electrons Inc.).

Average Circularity

The toner for use in the present invention preferably has an average circularity of from 0.93 to 1.00, and more preferably from 0.94 to 0.99. The circularity of a particle is determined by the following equation:

$$C=Lo/L$$

wherein C represents the circularity, Lo represents the length of the circumference of a circle having the same area as that of the image of the particle and L represents the peripheral length of the image of the particle.

When the average circularity is too small (i.e., the toner is far from a true sphere), the toner has poor transferability and therefore high quality images without scattering tend not to be produced. When the average circularity is too large, the toner is hardly removed with a cleaning blade, and therefore residual toner particles tend to remain on the photoreceptor, the transfer belt, etc. As a result, the produced image is soiled with the residual toner particles. For example, when an image having a high image proportion is formed, untransferred toner particles remaining on the photoreceptor due to problems such as paper feeding failure tend to soil the background of the produced image. The charging roller configured to contact-charge the photoreceptor in contact therewith is also contaminated with the residual toner particles, resulting in deterioration of charging property of the charging roller.

The average circularity can be determined by passing a suspension liquid containing toner particles on a platy imaging detector, and then optically detecting particle images using a CCD camera. For example, the average circularity of a toner can be determined using a flow-type particle image analyzer FPIA-2100 (manufactured by Sysmex Corp.).

Shape Factors

The shape factor SF-1 represents the degree of the roundness of a toner particle, and is defined by the following equation (1):

$$SF\text{-}1=\{(MXLNG)^2/(\mathrm{AREA})\}\times(100\pi/4) \quad (1)$$

wherein MXLNG represents a diameter of the circle circumscribing the projected image of a toner particle; and AREA represents the area of the projected image.

The toner for use in the present invention preferably has a SF-1 of from 100 to 180, and more preferably from 105 to 140. When the SF-1 is 100, the toner particle has a true spherical form. When the SF-1 is larger than 100, the toner particles have irregular forms. When the SF-1 is too large, cleanability of the toner increases, but charge quantity distribution is broad, and therefore foggy images tend to be produced, resulting in deterioration of image quality. Such a toner cannot faithfully move along the electric field in the developing process and the transfer process, and therefore some toner particles are developed between thin lines. As a result, image uniformity and image quality deteriorate.

The shape factor SF-2 represents the degree of the concavity and convexity of a toner particle, and is defined by the following equation (2):

$$SF\text{-}2=\{(PERI)^2/(\mathrm{AREA})\}\times(100/4\pi) \quad (2)$$

wherein PERI represents the peripheral length of the projected image of a toner particle; and AREA represents the area of the projected image.

The toner for use in the present invention preferably has a SF-2 of from 100 to 180, and more preferably from 105 to 140. When the SF-2 is close to 100, the toner particles have smooth surfaces (i.e., the toner has few concavity and convexity). When the SF-2 is too large, the toner particles have rough surfaces.

The shape factors SF-1 and SF-2 are determined by, for example, photographing particles of a toner using a scanning electron microscope (FE-SEM S-800 manufactured by Hitachi Ltd.), and then analyzing the photographs using an image analyzer (LUZEX III manufactured by Nicolet Corp.) to determine the SF-1 and SF-2.

Size Factors

The toner for use in the present invention may have a form similar to the spherical form. The toner preferably satisfies the following relationship:

$$0.5\leqq(r2/r1)\leqq1.0 \text{ and } 0.7\leqq(r3/r2)\leqq1.0$$

wherein r1, r2 and r3 represent the average major axis particle diameter, the average minor axis particle diameter and the average thickness of particles of the toner, respectively, wherein $r3\leqq r2\leqq r1$.

When the ratio (r2/r1) is too small, the toner has a form far away from the spherical form, and therefore the toner has a poor dot reproducibility and transferability, resulting in deterioration of the image quality. When the ratio (r3/r2) is too small, the toner has a form far away from the spherical form, and therefore the toner has poor transferability. When the ratio (r3/r2) is 1.0, the toner has a form similar to the spherical form, and therefore the toner has good fluidity.

Toner Color

The color of the toner for use in the present invention is not limited. However, it is preferable that the toner has at least one of black, cyan, magenta, and yellow colors. A toner having a desired color can be prepared by choosing a proper colorant from the colorants mentioned above.

Developer

The developer for use in the present invention includes at least the above-mentioned toner and other components (such as a carrier) so as to be adjusted to the image forming method used. The developer may be either a one-component developer or a two-component developer. Two-component developers are preferably used for high-speed printers in compliance with the recent demands for improvement of information processing speed, in terms of improvement of life thereof.

A one-component developer consisting essentially of the toner for use in the present invention has a stable average particle diameter even if the toner particles are partially replaced with fresh toner particles, and hardly forms a film on a developing roller and hardly fuses on a toner layer forming member. Such a one-component developer has stable good developability, and therefore high quality images can be produced thereby even after a long repeated use. A two-component developer including the toner for use in the present invention also has a stable average particle diameter even if the toner particles are partially replaced with fresh toner particles. Such a two-component developer stably has good developability, and therefore high quality images can be produced thereby even after a long repeated use.

Any known carriers can be used for the two-component developer for use in the present invention, and are not particularly limited. However, carriers including a core and a resin layer which covers the core are preferably used.

Any known cores can be used for the carriers, and are not particularly limited. Specific examples of the cores include, but are not limited to, manganese-strontium (Mn—Sr) materials and manganese-magnesium (Mn—Mg) materials having a magnetization of from 50 to 90 emu/g, etc. In order to obtain images having a high image density, high-magnetization materials such as iron powders (having a magnetization of not less than 100 emu/g) and magnetites (having a magnetization of from 75 to 120 emu/g) are preferably used. In order to obtain high quality images, low-magnetization materials such as copper-zinc (Cu—Zn) materials (having a magnetization of from 30 to 80 emu/g) are preferably used, because the magnet brushes can softly contact a photoreceptor in such a case. These materials can be used alone or in combination.

The core preferably has a volume average particle diameter ($D_{50}$) of from 10 to 200 μm, and more preferably from 40 to 100 μm.

When the volume average particle diameter ($D_{50}$) is too small, the carrier includes too large an amount of fine particles and therefore magnetization per carrier particle decreases, resulting in occurrence of carrier scattering. When the volume average particle diameter is too large, the carrier has too small a specific surface area and therefore carrier scattering tends to occur and image reproducibility deteriorates especially in full-color solid images.

Any known resins can be used for the resin layer, and are not particularly limited. Specific examples of the resins include, but are not limited to, amino resins, polyvinyl resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, copolymers of vinylidene fluoride and acrylic monomer, copolymers of vinylidene fluoride and vinyl fluoride, fluoroterpolymers (e.g., terpolymer of tetrafluoroethylene and vinylidene fluoride and non-fluoride monomer), silicone resins, etc. These resins can be used alone or in combination.

Specific examples of the amino resins include, but are not limited to, urea-formaldehyde resins, melamine resins, benzoguanamine resins, urea resins, polyamide resins, epoxy resins, etc.

Specific examples of the polyvinyl resins include, but are not limited to, acrylic resins, polymethyl methacrylate resins, polyacrylonitrile resins, polyvinyl acetate resins, polyvinyl alcohol resins, polyvinyl butyral resins, etc.

Specific examples of the polystyrene resins include, but are not limited to, polystyrene resins, styrene-acrylic copolymer resins, etc.

Specific examples of the halogenated olefin resins include, but are not limited to, polyvinyl chloride, etc.

Specific examples of the polyester resins include, but are not limited to, polyethylene terephthalate resins, polybutylene terephthalate resins, etc.

The resin layer optionally includes a particulate conductive material. Specific examples of the particulate conductive materials include, but are not limited to, metal powders, carbon blacks, titanium oxides, tin oxides, zinc oxides, etc. The particulate conductive material preferably has an average particle diameter of not greater than 1 μm. When the average particle diameter is too small, it is difficult to control the electrical resistance of the carrier.

The resin layer can be formed by the following method:

(1) dissolving the resin, etc. in an organic solvent to prepare a resin layer constituent liquid;

(2) uniformly coating the resin layer constituent liquid on the core by known methods such as dip coating, spray coating, brush coating, etc.; and (3) drying and baking the coated core.

Specific examples of the organic solvents include toluene, xylene, methyl ethyl ketone, methyl isobutyl ketone, cellosolve butyl acetate, etc., but are not limited thereto.

The baking method can be either or both of an external heating method or an internal heating method. Specific baking methods include methods using a fixed electric furnace, a portable electric furnace, a rotary electric furnace, a burner furnace and a microwave, but are not limited thereto.

The carrier preferably includes the resin layer in an amount of from 0.01 to 5.0% by weight. When the amount is too small, the resin layer cannot be uniformly formed on the surface of the core. When the amount is too large, the carrier has too thick a resin layer and therefore the carrier particles tend to aggregate. In this case, nonuniform carrier particles are obtained.

The two-component developer preferably includes the carrier in an amount of from 90 to 98% by weight, and more preferably from 93 to 97% by weight.

The two-component developer generally includes a toner in an amount of from 1 to 10.0 parts by weight, based on 100 parts by weight of a carrier.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Toner Manufacturing Example 1

The following components are fed in a reaction vessel equipped with a condenser, a stirrer and a nitrogen feed pipe.

| | |
|---|---|
| Ethylene oxide (2 mole) adduct of bisphenol A | 724 parts |
| Isophthalic acid | 276 parts |
| Dibutyl tin oxide | 2 parts |

The mixture is reacted for 8 hours at 230° C. under normal pressure. Then the reaction is further continued for 5 hours under a reduced pressure of 10 to 15 mmHg, and then the mixture is cooled to 160° C. Further, 32 parts of phthalic anhydride is added thereto. The mixture is reacted for 2 hours, and then cooled to 80° C. Then the reaction product is reacted with 188 parts of isophorone diisocyanate for 2 hours in ethyl acetate. Thus, a prepolymer (1) having an isocyanate group is prepared.

Then 267 parts of the prepolymer (1) is reacted with 14 parts of isophorone diamine for 2 hours at 50° C. Thus, a urea-modified polyester resin (1) having a weight average molecular weight of 64,000 is prepared.

Next, the following components are fed in a reaction vessel equipped with a condenser, a stirrer and a nitrogen feed pipe. Ethylene oxide (2 mole) adduct of

| | |
|---|---|
| Ethylene oxide (2 mole) adduct of bisphenol A | 724 parts |
| Terephthalic acid | 276 parts |

The mixture is reacted for 8 hours at 230° C. under normal pressure. Then the reaction is further continued for 5 hours under a reduced pressure of 10 to 15 mmHg. Thus, an unmodified polyester resin (a) having a peak molecular weight of 5,000 is prepared.

Then 200 parts of the urea-modified polyester resin (1) and 800 parts of the unmodified polyester resin (a) are dissolved in 2,000 parts of a mixed solvent of acetic acid and MEK (acetic acid/MEK=1/1). Thus, an acetic acid/MEK solution of a toner binder resin (1) is prepared.

A part of the solution is dried under a reduced pressure so as to isolate the toner binder resin (1). The toner binder resin (1) has a glass transition temperature (Tg) of 62° C. and an acid value of 10.

Next, 240 parts of the acetic acid/MEK solution of the toner binder resin (1) prepared above, 20 parts of a pentaerythritol tetrabehenate (having a melting point of 81° C. and a melt viscosity of 25 cps), and 10 parts of a carbon black are fed in a beaker, and the mixture is agitated at 60° C. using a TK HOMOMIXER at a revolution speed of 12,000 rpm. Thus, a toner constituent mixture liquid (1) is prepared.

On the other hand, 706 parts of ion-exchanged water, 294 parts of a 10% suspension liquid of a hydroxyapatite (SUPATITE® 10 manufactured by Nippon Chemical Industrial Co., Ltd.), and 0.2 parts of sodium dodecylbenzene sulfonate are fed in another beaker and mixed. Thus, a water phase (1) is prepared.

The water phase (1) is heated to 60° C., and then the toner constituent mixture liquid (1) is added thereto while the mixture is agitated using a TK HOMOMIXER at a revolution of 12,000 rpm. The mixture is further agitated for 10 minutes. Thus, a dispersion (1) is prepared.

The dispersion (1) is fed to a conical flask equipped with a stirrer and a thermometer, and heated to 98° C. so as to remove a part of the solvent therefrom. The dispersion (1) is cooled to room temperature again and further agitated using a TK HOMOMIXER at a revolution of 12,000 rpm so as to alter the spherical shape of toner particles. After the solvent is completely removed from the dispersion (1), the dispersion (1) is subjected to filtration, washing, drying, and classification using wind power. Thus, mother toner particles (1) are prepared.

Then 100 parts of the mother toner particles (1) are mixed with 0.5 parts of a hydrophobized silica using a HENSCHEL MIXER. Thus, a toner (1) is prepared. The toner (1) has an average circularity of 0.948.

The average circularity is measured as follows. At first, 2 to 20 mg of a sample to be measured is mixed with 100 to 150 ml of an electrolyte (i.e., a 1% by weight of aqueous solution of NaCl prepared using first-grade sodium chloride) including 0.1 to 5 ml of a dispersant (i.e., a surfactant) such as an alkylbenzene sulfonic acid salt. The mixture is dispersed using an ultrasonic dispersing machine for about 1 to 3 minutes. Then 100 to 200 ml of the electrolyte is fed into another beaker, and the above mixture containing the sample is added thereto to prepare a suspension having a predetermined concentration. The suspension containing the sample particles is passed through a platy imaging detector, and then particle images are optically detected using CCD camera. The average circularity of the sample is determined using a flow-type particle image analyzer FPIA-1000 (manufactured by Sysmex Corp.).

Toner Manufacturing Example 2

At first, 850 parts of the urea-modified polyester resin (1) and 150 parts of the unmodified polyester resin (a) are dissolved in 2,000 parts of a mixed solvent of acetic acid and MEK (acetic acid/MEK=1/1). Thus, an acetic acid/MEK solution of a toner binder resin (2) is prepared. A part of the solution is dried under a reduced pressure so as to isolate the toner binder resin (2).

The procedure for preparing the toner (1) is repeated except the toner binder resin (1) is replaced with the toner binder resin (2). Thus, a toner (2) is prepared. The toner (2) has an average circularity of 0.987.

Toner Manufacturing Example 3

The following components are fed in a reaction vessel equipped with a condenser, a stirrer and a nitrogen feed pipe. Ethylene oxide (2 mole) adduct of

| | |
|---|---|
| Ethylene oxide (2 mole) adduct of bisphenol A | 343 parts |
| Isophthalic acid | 166 parts |
| Dibutyl tin oxide | 2 parts |

The mixture is reacted for 8 hours at 230° C. under normal pressure. The reaction is further continued for 5 hours under a reduced pressure of 10 to 15 mmHg, and then the mixture is cooled to 80° C. The reaction product is reacted with 14 parts of toluene diisocyanate for 5 hours at 110° C. in toluene.

The toluene is removed after the reaction. Thus, a urethane-modified polyester resin having a weight average molecular weight of 98,000 is prepared.

Next, the following components are fed in a reaction vessel equipped with a condenser, a stirrer and a nitrogen feed pipe.

Ethylene oxide (2 mole) adduct of

| | |
|---|---|
| Ethylene oxide (2 mole) adduct of bisphenol A | 363 parts |
| Isophthalic acid | 166 parts |

The mixture is reacted for 8 hours at 230° C. under normal pressure. Then the reaction is further continued for 5 hours under a reduced pressure of 10 to 15 mmHg. Thus, an unmodified polyester resin (b) is prepared.

Then 350 parts of the urethane-modified polyester resin and 650 parts of the unmodified polyester resin (b) are dissolved and mixed in toluene, followed by removing the toluene therefrom. Thus, a toner binder resin (3) is prepared.

Next, 100 parts of the toner binder resin (3) and 8 parts of a carbon black are pre-mixed using a HENSCHEL MIXER, and then the mixture is kneaded using a continuous kneader. The kneaded mixture is pulverized using a jet-type pulverizer, and the pulverized particles are classified using an airflow-type classifier. Thus, mother toner particles (3) are prepared.

Then 100 parts of the mother toner particles (3) are mixed with 1.0 part of a hydrophobized silica and 0.5 parts of a hydrophobized titanium oxide using a HENSCHEL MIXER. Thus, a toner (3) is prepared. The toner (3) has an average circularity of 0.934.

Charge Transport Polyol Synthesis Example 1

Synthesis of diethyl 4-methoxybenzyl phosphonate

At first, 4-methoxybenzyl chloride is reacted with triethyl phosphite for 5 hours at 150° C. After the reaction, the excess triethyl phosphite and ethyl chloride (i.e., a by-product) are removed by distillation under reduced pressure. Thus, diethyl 4-methoxybenzyl phosphonate is prepared.

Synthesis of 4-methoxy-4'-(di-p-tolylamino)stilbene

Diethyl 4-methoxybenzyl phosphonate and equimolar amount of 4-methoxy-4'-(di-p-tolylamino)benzaldehyde are dissolved in N,N-dimethylformamide. Then potassium t-butoxide is gradually added thereto while water-cooling and agitating the mixture. The mixture is further agitated for 5 hours at room temperature, and then water is added thereto so as to make the mixture acidic. The crude objective material is precipitated therefrom. The crude objective material is purified with a column chromatography using silica gel. Thus, 4-methoxy-4'-(di-p-tolylamino)stilbene (i.e., objective material) is prepared.

Synthesis of 4-hydroxy-4'-(di-p-tolylamino)stilbene

The above-prepared 4-methoxy-4'-(di-p-tolylamino)stilbene and twice equimolar amount of sodium ethanethiolate are dissolved in N,N-dimethylformamide, and reacted for 5 hours at 130° C. The mixture is cooled down, and then poured into water and neutralized with hydrochloric acid. The objective material is extracted therefrom using acetic acid. The extracted liquid is washed with water, and then dried. The crude objective material is prepared by removing the solvent (i.e., N,N-dimethylformamide) therefrom. Further, the crude objective material is purified with a column chromatography using silica gel. Thus, 4-hydroxy-4'-(di-p-tolylamino)stilbene (i.e., objective material) is prepared.

Synthesis of 1,2-dihydroxy-3-[4'-(di-p-tolylamino) stilbene-4-yloxy]propane

In a reaction vessel equipped with a stirrer, a thermometer, a condenser, and a dropping funnel, 11.75 g of 4-hydroxy-4'-(di-p-tolylamino)stilbene, 4.35 g of glycidyl methacrylate, and 8 ml of toluene are contained, and the mixture is heated to 90° C. Further, 0.16 g of triethylamine is added thereto, and the mixture is agitated for 8 hours at 95° C. Next, 16 ml of toluene and 20 ml of a 10% aqueous solution of sodium hydroxide are added thereto, and the mixture is further agitated for 8 hours at 95° C.

After the reaction, the mixture is diluted with ethyl acetate, and subjected to acid washing and then water washing. The solvent (i.e., toluene) is removed from the mixture, and 19 g of the crude objective material is prepared. The crude objective material is purified with a column chromatography (solvent:ethyl acetate) using silica gel. Thus, 1,2-dihydroxy-3-[4'-(di-p-tolylamino)stilbene-4-yloxy]propane (i.e., a charge transport polyol (CTP-1) having the following formula is prepared.

(CTP-1)

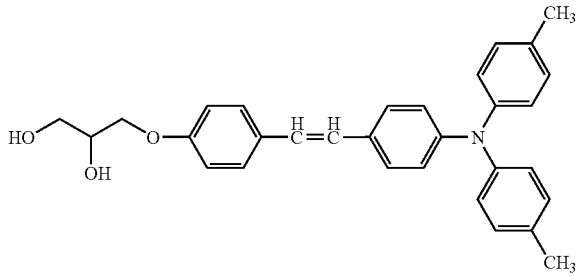

Figure 14:
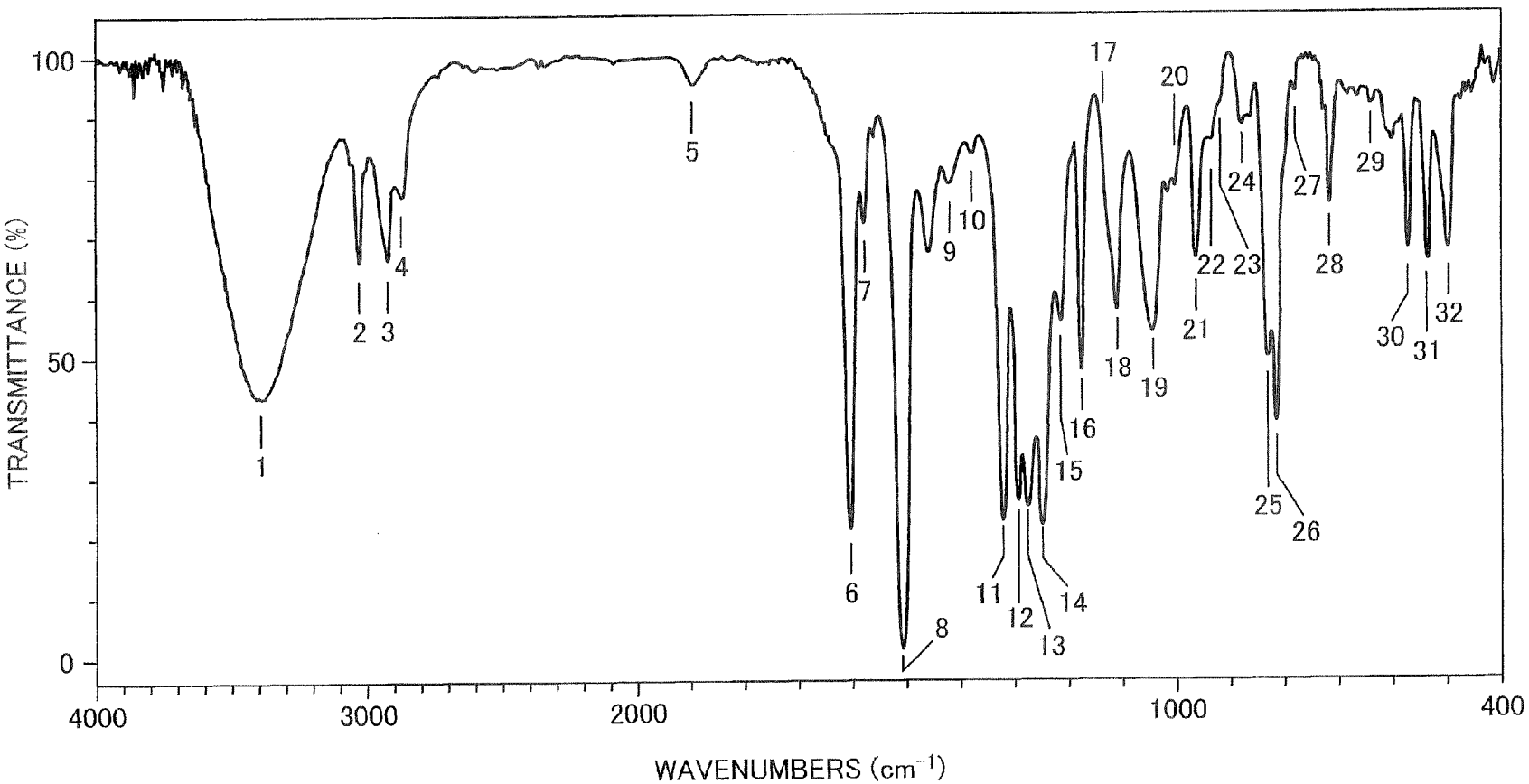
FIG. 14 is an infrared absorption spectrum of a charge transport polyol for use in the electrostatic latent image bearing member of the present invention.

The yield is 9.85 g. The product is a yellow crystal, and has a melting point of 127 to 128.7° C. The infrared absorption spectrum of the product is illustrated in FIG. 14.

As shown above, a charge transport polyol can be synthesized by reacting diethyl 4-methoxybenzyl phosphonate or a derivative thereof with a benzaldehyde derivative to prepare a 4-methoxystilbene derivative, and following the reaction path mentioned above.

In the reaction path mentioned above, a charge transport material (i.e., 4-hydroxy-4'-(di-p-tolylamino)stilbene) having a hydroxyl group is reacted with glycidyl methacrylate, and then subjected to alkali hydrolysis. Thereby, the resultant charge transport polyol has 1,2-dihydroxypropyl group. The number of the 1,2-dihydroxypropyl group included in the charge transport polyol can be arbitrarily determined considering the balance between charge transport ability and abrasion resistance of the resultant electrostatic latent image bearing member. The number of the 1,2-dihydroxypropyl group included in the charge transport polyol can be arbitrarily controlled by designing molecular structure thereof, and can be theoretically increased to infinity. In the present invention, the charge transport polyol preferably has 1 to 4 1,2-dihydroxypropyl groups.

Charge Transport Polyol Synthesis Example 2

By following the same reaction path for preparing CTP-1, a hydroxybiphenylyl derivative is prepared. The hydroxybiphenylyl derivative is reacted with glycidyl methacrylate, and then subjected to alkali hydrolysis. Thus, a charge transport polyol (CTP-2) having the following formula is prepared.

(CTP-2)

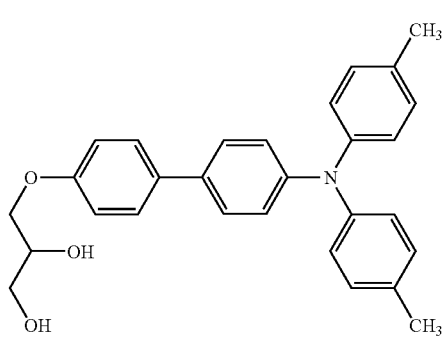

Charge Transport Polyol Synthesis Example 3

By following the same reaction path for preparing CTP-1, a hydroxy α-phenylstilbene derivative is prepared. The hydroxy α-phenylstilbene derivative is reacted with glycidyl methacrylate, and then subjected to alkali hydrolysis. Thus, a charge transport polyol (CTP-3) having the following formula is prepared.

(CTP-3)

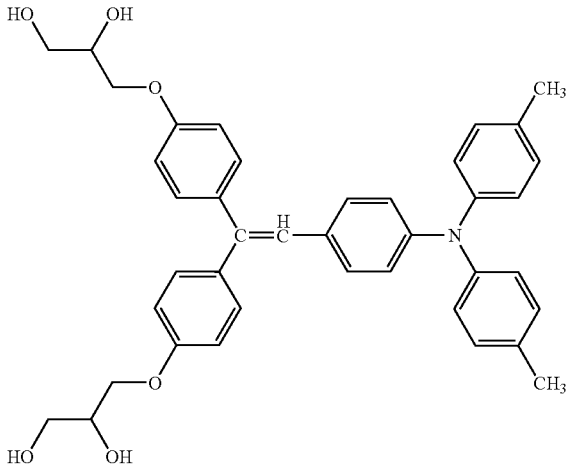

Charge Transport Polyol Synthesis Example 4

By following the same reaction path for preparing CTP-1, a hydroxydistyryl amine derivative is prepared. The hydroxydistyryl amine derivative is reacted with glycidyl methacrylate, and then subjected to alkali hydrolysis. Thus, a charge transport polyol (CTP-4) having the following formula is prepared.

(CTP-4)

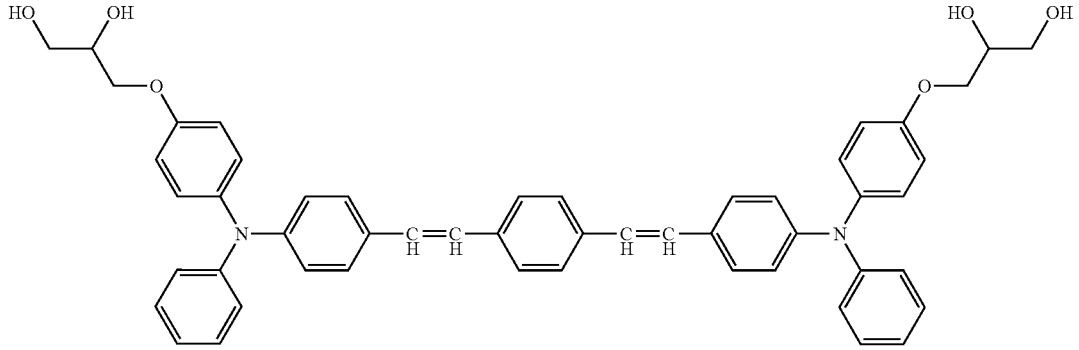

Charge Transport Polyol Synthesis Examples 5 and 6

By following the same reaction paths for preparing CTP-3 and CTP-4, a derivative having 3 hydroxyl groups and a derivative having 4 hydroxyl groups are prepared, respectively. Each of these derivatives is reacted with glycidyl methacrylate, and then subjected to alkali hydrolysis. Thus, charge transport polyol (CTP-5) and (CTP-6) having the following formulae are prepared.

(CTP-5)

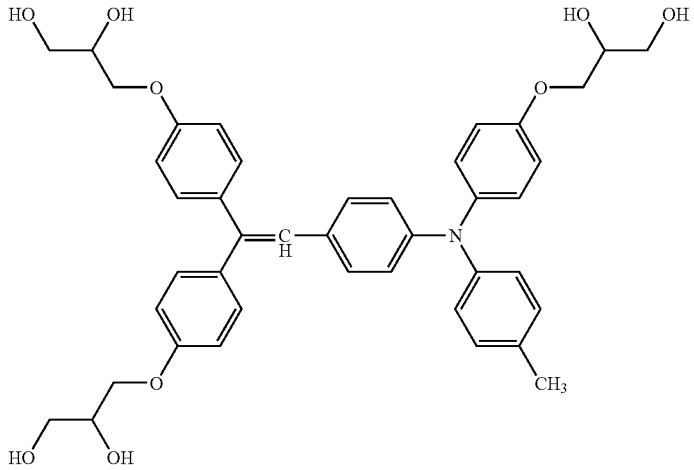

(CTP-6)

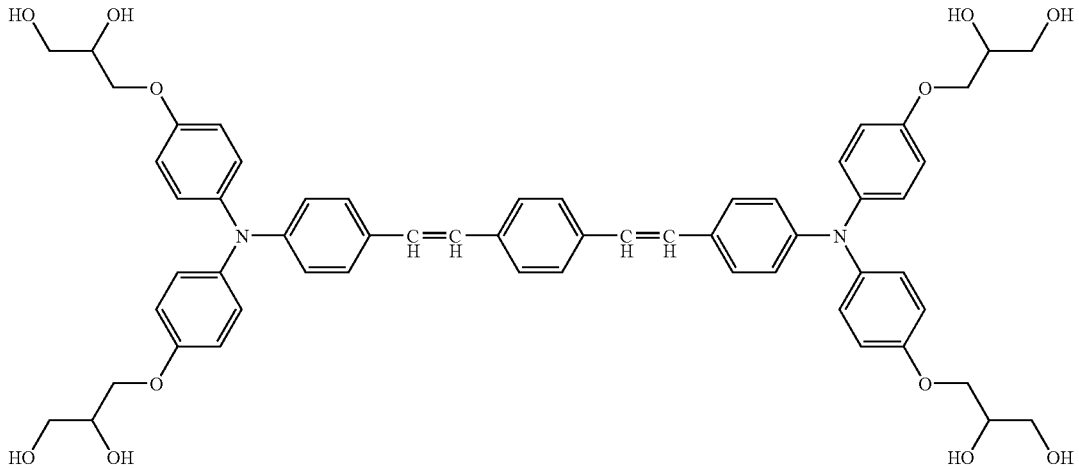

Example 1

Formation of Undercoat Layer

At first, 15 parts of an alkyd resin (BECKOLITE® M6401-50 manufactured by Dainippon Ink and Chemicals, Incorporated) and 10 parts of a melamine resin (SUPER BECKAMINE® G-821-60 manufactured by Dainippon Ink and Chemicals, Incorporated) are dissolved in 150 parts of methyl ethyl ketone. Then 90 parts of a titanium oxide powder (TIPAQUE CR-EL manufactured by Ishihara Sangyo Kaisha, Ltd.) is added thereto, and the mixture is subjected to a dispersion treatment for 12 hours using a ball mill. Thus, an undercoat layer coating liquid is prepared.

The undercoat layer coating liquid is coated on an aluminum cylinder having a diameter of 30 mm by a dip coating method and dried for 20 minutes at 130° C. to prepare an undercoat layer having a thickness of 3.5 μm.

Formation of CGL

At first, 4 parts of a polyvinyl butyral resin (XYHL manufactured by Union Carbide Corp.) is dissolved in 150 parts of cyclohexanone. Then 10 parts of a bisazo pigment having the following formula (A) is added thereto, and the mixture is subjected to a dispersion treatment for 48 hours using a ball mill:

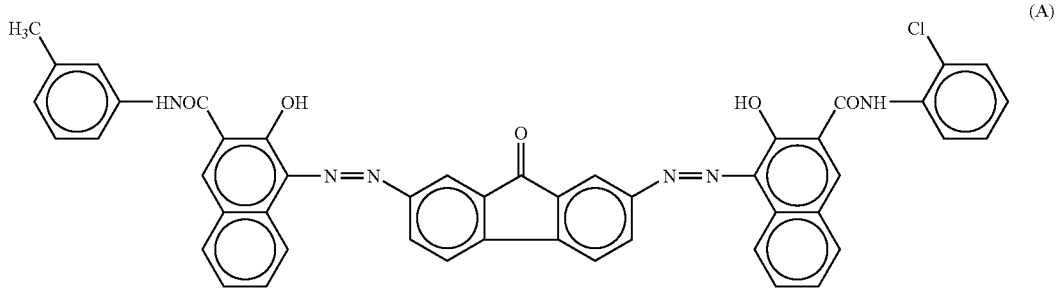

Further, 210 parts of cyclohexanone is added thereto, and the mixture is subjected to a dispersion treatment for 3 hours. The mixture is fed into a vessel, and cyclohexanone is added thereto to adjust the solid content of the mixture to 1.5% by weight. Thus, a CGL coating liquid is prepared.

The CGL coating liquid is coated on the undercoat layer and dried for 20 minutes at 130° C. to prepare a CGL layer having a thickness of 0.2 μm.

Formation of CTL

Ten (10) parts of a bisphenol Z-from polycarbonate resin, 0.002 parts of a silicone oil (KF-50 manufactured by Shin-Etsu Chemical Co., Ltd.), and 7 parts of a charge transport material having the following formula (B) are dissolved in 100 parts of tetrahydrofuran:

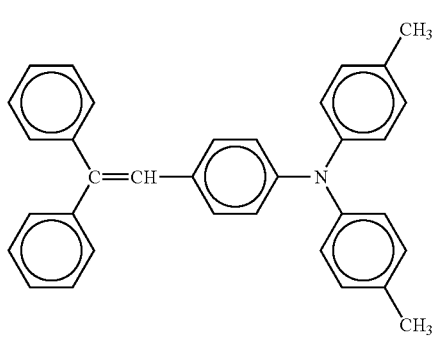

Thus, a CTL coating liquid is prepared.

The CTL coating liquid is coated on the CGL by a dip coating method and dried for 20 minutes at 110° C. to prepare a CTL having a thickness of 25 μm.

Formation of Protective Layer

At first, 22 parts of a polyol (i.e., a styrene-methyl methacrylate-hydroxyethyl methacrylate copolymer LZR-170 having an OH equivalence of about 367 and a solid content of 41% by weight, manufactured by Fujikura Kasei Co., Ltd.) and 30 parts of the above-prepared charge transport polyol (CTP-1) (i.e., 1,2-dihydroxy-3-[4'-(di-p-tolylamino)stilbene-4-yloxy]propane) are dissolved in a mixture of 100 parts of cyclohexanone and 200 parts of tetrahydrofuran. Further, 46 parts of a polyisocyanate (SUMIDUR HT having a solid content of 75% by weight, manufactured by Sumika Bayer Urethane Co., Ltd.) is dissolved therein. Thus, a protective layer coating liquid (1) is prepared.

The protective layer coating liquid (1) is coated on the CTL by a spray coating method and heated for 30 minutes at 150° C. to prepare a protective layer having a thickness of 5 μm.

Thus, an electrostatic latent image bearing member (1) having the undercoat layer, the CGL, the CTL, and the protective layer, wherein the layers are overlaid on the aluminum substrate in this order, is prepared.

Example 2

At first, the procedures for formation of the undercoat layer, the CGL, and the CTL in Example 1 are repeated.

Then a protective layer is formed thereon as follows: 24 parts of a polyol (i.e., a styrene-methyl methacrylate-hydroxyethyl methacrylate copolymer LZR-170 having an OH equivalence of about 367 and a solid content of 41% by weight, manufactured by Fujikura Kasei Co., Ltd.) and 30 parts of the above-prepared charge transport polyol (CTP-2) are dissolved in a mixture of 100 parts of cyclohexanone and 200 parts of tetrahydrofuran. Further, 44 parts of a polyisocyanate (SUMIDUR HT having a solid content of 75% by weight, manufactured by Sumika Bayer Urethane Co., Ltd.) is dissolved therein. Thus, a protective layer coating liquid (2) is prepared.

The protective layer coating liquid (2) is coated on the CTL by a spray coating method and heated for 30 minutes at 150° C. to prepare a protective layer having a thickness of 5 μm.

Thus, an electrostatic latent image bearing member (2) having the undercoat layer, the CGL, the CTL, and the protective layer, wherein the layers are overlaid on the aluminum substrate in this order, is prepared.

Example 3

At first, the procedures for formation of the undercoat layer, the CGL, and the CTL in Example 1 are repeated.

Then a protective layer is formed thereon as follows: 4 parts of a polyol (i.e., a styrene-methyl methacrylate-hydroxyethyl methacrylate copolymer LZR-170 having an OH equivalence of about 367 and a solid content of 41% by weight, manufactured by Fujikura Kasei Co., Ltd.) and 30 parts of the above-prepared charge transport polyol (CTP-3) are dissolved in a mixture of 100 parts of cyclohexanone and 200 parts of tetrahydrofuran. Further, 55 parts of a polyisocyanate (SUMIDUR HT having a solid content of 75% by weight, manufactured by Sumika Bayer Urethane Co., Ltd.) is dissolved therein. Thus, a protective layer coating liquid (3) is prepared.

The protective layer coating liquid (3) is coated on the CTL by a spray coating method and heated for 30 minutes at 150° C. to prepare a protective layer having a thickness of 5 μm.

Thus, an electrostatic latent image bearing member (3) having the undercoat layer, the CGL, the CTL, and the protective layer, wherein the layers are overlaid on the aluminum substrate in this order, is prepared.

Example 4

At first, the procedures for formation of the undercoat layer, the CGL, and the CTL in Example 1 are repeated.

Then a protective layer is formed thereon as follows: 25 parts of a polyol (i.e., a styrene-methyl methacrylate-hydroxyethyl methacrylate copolymer LZR-170 having an OH equivalence of about 367 and a solid content of 41% by weight, manufactured by Fujikura Kasei Co., Ltd.) and 30 parts of the above-prepared charge transport polyol (CTP-4) are dissolved in a mixture of 100 parts of cyclohexanone and 200 parts of tetrahydrofuran. Further, 50 parts of a polyisocyanate (SUMIDUR HT having a solid content of 75% by weight, manufactured by Sumika Bayer Urethane Co., Ltd.) is dissolved therein. Thus, a protective layer coating liquid (4) is prepared.

The protective layer coating liquid (4) is coated on the CTL by a spray coating method and heated for 30 minutes at 150° C. to prepare a protective layer having a thickness of 5 μm.

Thus, an electrostatic latent image bearing member (4) having the undercoat layer, the CGL, the CTL, and the protective layer, wherein the layers are overlaid on the aluminum substrate in this order, is prepared.

Example 5

At first, the procedures for formation of the undercoat layer, the CGL, and the CTL in Example 1 are repeated.

Then a protective layer is formed thereon as follows: 10 parts of a polyol (i.e., a styrene-methyl methacrylate-hydroxyethyl methacrylate copolymer LZR-170 having an OH equivalence of about 367 and a solid content of 41% by weight, manufactured by Fujikura Kasei Co., Ltd.) and 30 parts of the above-prepared charge transport polyol (CTP-5) are dissolved in a mixture of 100 parts of cyclohexanone and 200 parts of tetrahydrofuran. Further, 75 parts of a polyisocyanate (SUMIDUR HT having a solid content of 75% by weight, manufactured by Sumika Bayer Urethane Co., Ltd.) is dissolved therein. Thus, a protective layer coating liquid (5) is prepared.

The protective layer coating liquid (5) is coated on the CTL by a spray coating method and heated for 30 minutes at 150° C. to prepare a protective layer having a thickness of 5 μm.

Thus, an electrostatic latent image bearing member (5) having the undercoat layer, the CGL, the CTL, and the protective layer, wherein the layers are overlaid on the aluminum substrate in this order, is prepared.

Example 6

At first, the procedures for formation of the undercoat layer, the CGL, and the CTL in Example 1 are repeated.

Then a protective layer is formed thereon as follows: 14 parts of a polyol (i.e., a styrene-methyl methacrylate-hydroxyethyl methacrylate copolymer LZR-170 having an OH equivalence of about 367 and a solid content of 41% by weight, manufactured by Fujikura Kasei Co., Ltd.) and 30 parts of the above-prepared charge transport polyol (CTP-6) are dissolved in a mixture of 100 parts of cyclohexanone and 200 parts of tetrahydrofuran. Further, 73 parts of a polyisocyanate (SUMIDUR HT having a solid content of 75% by weight, manufactured by Sumika Bayer Urethane Co., Ltd.) is dissolved therein. Thus, a protective layer coating liquid (6) is prepared.

The protective layer coating liquid (6) is coated on the CTL by a spray coating method and heated for 30 minutes at 150° C. to prepare a protective layer having a thickness of 5 μm.

Thus, an electrostatic latent image bearing member (6) having the undercoat layer, the CGL, the CTL, and the protective layer, wherein the layers are overlaid on the aluminum substrate in this order, is prepared.

Example 7

At first, the procedures for formation of the undercoat layer, the CGL, and the CTL in Example 1 are repeated.

Then a protective layer is formed thereon as follows: 47 parts of a polyol (i.e., a styrene-methyl methacrylate-hydroxyethyl methacrylate copolymer LZR-170 having an OH equivalence of about 367 and a solid content of 41% by weight, manufactured by Fujikura Kasei Co., Ltd.) and 20 parts of the above-prepared charge transport polyol (CTP-5) are dissolved in a mixture of 130 parts of cyclohexanone and 450 parts of tetrahydrofuran. Further, 65 parts of a polyisocyanate (SUMIDUR HT having a solid content of 75% by weight, manufactured by Sumika Bayer Urethane Co., Ltd.) is dissolved therein. Thus, a protective layer coating liquid (7) is prepared.

The protective layer coating liquid (7) is coated on the CTL by a spray coating method and heated for 30 minutes at 150° C. to prepare a protective layer having a thickness of 5 μm.

Thus, an electrostatic latent image bearing member (7) having the undercoat layer, the CGL, the CTL, and the protective layer, wherein the layers are overlaid on the aluminum substrate in this order, is prepared.

Example 8

At first, the procedures for formation of the undercoat layer, the CGL, and the CTL in Example 1 are repeated.

Then a protective layer is formed thereon as follows: 90 parts of a polyol (i.e., a styrene-methyl methacrylate-hydroxyethyl methacrylate copolymer LZR-170 having an OH equivalence of about 367 and a solid content of 41% by weight, manufactured by Fujikura Kasei Co., Ltd.) and 12 parts of the above-prepared charge transport polyol (CTP-5) are dissolved in a mixture of 130 parts of cyclohexanone and 450 parts of tetrahydrofuran. Further, 58 parts of a polyisocyanate (SUMIDUR HT having a solid content of 75% by weight, manufactured by Sumika Bayer Urethane Co., Ltd.) is dissolved therein. Thus, a protective layer coating liquid (8) is prepared.

The protective layer coating liquid (8) is coated on the CTL by a spray coating method and heated for 30 minutes at 150° C. to prepare a protective layer having a thickness of 5 μm.

Thus, an electrostatic latent image bearing member (8) having the undercoat layer, the CGL, the CTL, and the protective layer, wherein the layers are overlaid on the aluminum substrate in this order, is prepared.

Example 9

At first, the procedures for formation of the undercoat layer, the CGL, and the CTL in Example 1 are repeated.

Then a protective layer is formed thereon as follows: 12 parts of a polyol (i.e., a styrene-methyl methacrylate-hydroxyethyl methacrylate copolymer LZR-170 having an OH equivalence of about 367 and a solid content of 41% by weight, manufactured by Fujikura Kasei Co., Ltd.) and 40 parts of the above-prepared charge transport polyol (CTP-2) are dissolved in a mixture of 130 parts of cyclohexanone and 450 parts of tetrahydrofuran. Further, 53 parts of a polyisocyanate (SUMIDUR HT having a solid content of 75% by weight, manufactured by Sumika Bayer Urethane Co., Ltd.) is dissolved therein. Thus, a protective layer coating liquid (9) is prepared.

The protective layer coating liquid (9) is coated on the CTL by a spray coating method and heated for 30 minutes at 150° C. to prepare a protective layer having a thickness of 5 μm.

Thus, an electrostatic latent image bearing member (9) having the undercoat layer, the CGL, the CTL, and the protective layer, wherein the layers are overlaid on the aluminum substrate in this order, is prepared.

Example 10

At first, the procedures for formation of the undercoat layer, the CGL, and the CTL in Example 1 are repeated.

Then a protective layer is formed thereon as follows: 50 parts of the above-prepared charge transport polyol (CTP-2) are dissolved in a mixture of 130 parts of cyclohexanone and 450 parts of tetrahydrofuran. Further, 46 parts of a polyisocyanate (SUMIDUR HT having a solid content of 75% by weight, manufactured by Sumika Bayer Urethane Co., Ltd.) is dissolved therein. Thus, a protective layer coating liquid (10) is prepared.

The protective layer coating liquid (10) is coated on the CTL by a spray coating method and heated for 30 minutes at 150° C. to prepare a protective layer having a thickness of 5 μm.

Thus, an electrostatic latent image bearing member (10) having the undercoat layer, the CGL, the CTL, and the protective layer, wherein the layers are overlaid on the aluminum substrate in this order, is prepared.

Example 11

At first, the procedures for formation of the undercoat layer, the CGL, and the CTL in Example 1 are repeated.

Then a protective layer is formed thereon as follows: 8 parts of 2-ethyl-2-hydroxymethyl-1,3-propanediol and 20 parts of the above-prepared charge transport polyol (CTP-1) are dissolved in a mixture of 130 parts of cyclohexanone and 450 parts of tetrahydrofuran. Further, 78 parts of a polyisocyanate (SUMIDUR HT having a solid content of 75% by weight, manufactured by Sumika Bayer Urethane Co., Ltd.) is dissolved therein. Thus, a protective layer coating liquid (11) is prepared.

The protective layer coating liquid (11) is coated on the CTL by a spray coating method and heated for 30 minutes at 150° C. to prepare a protective layer having a thickness of 5 μm.

Thus, an electrostatic latent image bearing member (11) having the undercoat layer, the CGL, the CTL, and the protective layer, wherein the layers are overlaid on the aluminum substrate in this order, is prepared.

Example 12

At first, the procedures for formation of the undercoat layer, the CGL, and the CTL in Example 1 are repeated.

Then a protective layer is formed thereon as follows: 5 parts of 2-ethyl-2-hydroxymethyl-1,3-propanediol and 30 parts of the above-prepared charge transport polyol (CTP-6) are dissolved in a mixture of 130 parts of cyclohexanone and 450 parts of tetrahydrofuran. Further, 30 parts of a polyisocyanate (SUMIDUR HT having a solid content of 75% by weight, manufactured by Sumika Bayer Urethane Co., Ltd.) is dissolved therein. Thus, a protective layer coating liquid (12) is prepared.

The protective layer coating liquid (12) is coated on the CTL by a spray coating method and heated for 30 minutes at 150° C. to prepare a protective layer having a thickness of 5 μm.

Thus, an electrostatic latent image bearing member (12) having the undercoat layer, the CGL, the CTL, and the protective layer, wherein the layers are overlaid on the aluminum substrate in this order, is prepared.

Comparative Example 1

The procedure for preparation of the electrostatic latent image bearing member in Example 1 is repeated except that the charge transport polyol (CTP-1) is replaced with a charge transport material (RTP-1) having the following formula, the amount of the polyol (i.e., a styrene-methyl methacrylate-hydroxyethyl methacrylate copolymer LZR-170 having an OH equivalence of about 367 and a solid content of 41% by weight, manufactured by Fujikura Kasei Co., Ltd.) is changed to 40 parts, and the amount of the polyisocyanate (SUMIDUR HT having a solid content of 75% by weight, manufactured by Sumika Bayer Urethane Co., Ltd.) is changed to 36 parts:

(RTP-1)

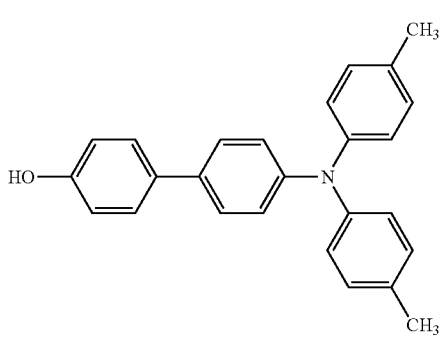

Thus, a comparative electrostatic latent image bearing member (C1) is prepared.

Comparative Example 2

The procedure for preparation of the image bearing member in Example 1 is repeated except that the charge transport polyol (CTP-1) is replaced with a charge transport material (RTP-2) having the following formula, the amount of the polyol (i.e., a styrene-methyl methacrylate-hydroxyethyl methacrylate copolymer LZR-170 having an OH equivalence of about 367 and a solid content of 41% by weight, manufactured by Fujikura Kasei Co., Ltd.) is changed to 4.5 parts, and the amount of the polyisocyanate (SUMIDUR HT having a solid content of 75% by weight, manufactured by Sumika Bayer Urethane Co., Ltd.) is changed to 78 parts:

(RTP-2)

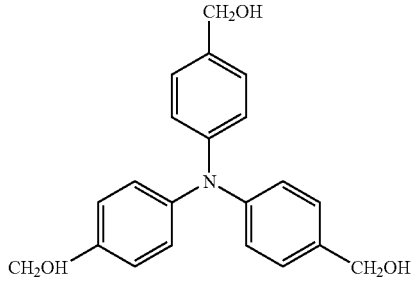

Thus, a comparative electrostatic latent image bearing member (C2) is prepared.

Comparative Example 3

The procedure for preparation of the electrostatic latent image bearing member in Example 1 is repeated except that the charge transport polyol (CTP-1) was replaced with a charge transport material (RTP-3) having the following formula, the amount of the polyol (i.e., a styrene-methyl methacrylate-hydroxyethyl methacrylate copolymer LZR-170 having an OH equivalence of about 367 and a solid content of 41% by weight, manufactured by Fujikura Kasei Co., Ltd.) is changed to 26 parts, and the amount of the polyisocyanate (SUMIDUR HT having a solid content of 75% by weight, manufactured by Sumika Bayer Urethane Co., Ltd.) is changed to 44 parts:

(RTP-3)

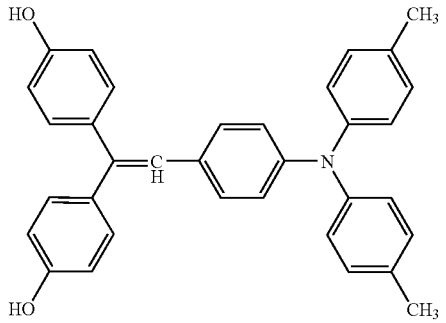

Thus, a comparative electrostatic latent image bearing member (C3) is prepared.

Evaluation

The electrostatic latent image bearing members (1) to (12) and comparative electrostatic latent image bearing members (C1) to (C3) prepared above are evaluated as follows.

(A) Abrasion Loss

In order to evaluate abrasion resistance of the electrostatic latent image bearing members prepared above, each of the electrostatic latent image bearing members and the toner (1) are set in a modified full color printer (IPSIO CX8200 manufactured and modified by Ricoh Co., Ltd.). The following modifications are made to the full color printer.

(i) Tripling the contact pressure of the cleaning blade so as to apply excessive load onto the surface of the electrostatic latent image bearing member.

(ii) Arranging a zinc stearate bar (prepared by melting and solidifying zinc stearate) in contact with the cleaning brush so that the zinc stearate is applied to the surface of the electrostatic latent image bearing member by the cleaning brush.

The charger is adjusted so that non-irradiated portion of the electrostatic latent image bearing member has a potential (VD) of −700 V. A running test in which 60,000 copies of an A4-sized image having a resolution of 1200 dpi and an image proportion of 5% are continuously produced by irradiating a laser beam having a wavelength of 660 nm is performed. The thickness of the photosensitive layer of each electrostatic latent image bearing member is determined using an eddy current thickness meter (FISCHERSCOPE® MMS manufactured by Fisher) before and after the running test, to determine the abrasion loss. When a peeling of a protective layer is observed, a thickness of an unpeeled portion is measured to determine the abrasion loss.

(B) Residual Potential

A modified developing unit in which a probe of a surface electrometer (MODEL 344 manufactured by Trek, Inc.) is attached to a developing sleeve is mounted on the above modified full color printer. The charger is adjusted so that non-irradiated portion of the electrostatic latent image bearing member has a potential (VD) of −600 V. A surface potential at the developing sleeve portion of the electrostatic latent image bearing member is measured when a solid image having a resolution of 1200 dpi is written thereon, to determine the residual potential.

(C) Image Quality

After the above running test is performed, an image including a character having a font size of 2 points (i.e., about 0.5 mm×0.5 mm size) is produced to evaluate the image quality. The image quality is graded as follows:

Good: Good image quality.

Average: Inage deletion is slightly observed, but no problem in practical use.

Poor: Image deletion and thin images are observed, and cannot be practically used.

The evaluation results are shown in Table 1.

TABLE 1

| | Residual potential (−V) | Abrasion loss (μm) | Image quality |
|---|---|---|---|
| Example 1 | 80 | 2.0 | Good |
| Example 2 | 110 | 2.2 | Good |
| Example 3 | 100 | 0.15 | Good |
| Example 4 | 210 | 0.15 | Good |
| Example 5 | 100 | 0.10 | Good |
| Example 6 | 230 | 0.50 | Good |
| Example 7 | 240 | 0.55 | Good |
| Example 8 | 290 | 0.85 | Average |
| Example 9 | 70 | 2.8 | Good |
| Example 10 | 50 | 3.0 | Average |
| Example 11 | 200 | 1.1 | Good |
| Example 12 | 270 | 0.20 | Good |
| Comparative Example 1 | 90 | The protective layer disappears after 10,000 copies are produced. | |
| Comparative Example 2 | 600 | 0.25 | Poor |
| Comparative Example 3 | 300 | 2.4 | Average |

It is clear from Table 1 that each of the electrostatic latent image bearing members of the present invention (Examples 1 to 12) has good abrasion resistance and low residual potential, and is capable of producing high quality images. In contrast, the comparative electrostatic latent image bearing members (Comparative Examples 1 to 3) have some problems, respectively. In Comparative Example 1, the electrostatic latent image bearing member has poor abrasion resistance such that the protective layer disappears after 10,000 copies are produced. In Comparative Example 2, the residual potential of the irradiated portion is too high, and therefore high quality images cannot be produced. In Comparative Example 3, the residual potential of the irradiated portion is also too high, and therefore produced image quality is not sufficient. In addition, the abrasion resistance is poor.

Other Examples

The electrostatic latent image bearing members (1) to (12) are subjected to the above evaluations again except that the toner (1) is replaced with the toners (2) and (3), respectively. All the evaluation results are good.

In addition, the electrostatic latent image bearing members (1) to (12) are subjected to the above evaluations again except that the zinc stearate bar is replaced with a calcium stearate bar, an aluminum stearate bar, and a carnauba wax bar, respectively. All the evaluation results are good.

This document claims priority and contains subject matter related to Japanese Patent Application No. 2005-335725, filed on Nov. 21, 2005, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed as now and desired to be secured by Letters Patent of the United States is:

1. An electrostatic latent image bearing member, comprising:

a substrate; and a photosensitive layer located overlying the substrate, wherein an outermost layer of the electrostatic latent image bearing member comprises a cross-linked resin formed from a cross-linking reaction between a charge transport polyol having the following formula (1) and an isocyanate compound:

(1)

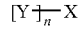

wherein Y represents a substituted or unsubstituted alkyl group or alkoxy group having 2 to 6 carbon atoms, wherein 2 carbon atoms are each bound to a hydroxyl group; X represents an organic residue group comprising a hydrocarbon bond having 1 to 4 valences, which has a charge transport molecular structure; and n represents an integer of from 1 to 4.

2. The electrostatic latent image bearing member according to claim 1, wherein the 2 carbon atoms each bound to a hydroxyl group are adjacent to each other.

3. The electrostatic latent image bearing member according to claim 1, wherein the charge transport polyol has the following formula (2):

(2)

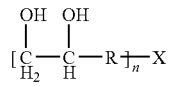

wherein R represents a substituted or unsubstituted alkylene group or oxyalkylene group having 1 to 4 carbon atoms; X represents an organic residue group comprising a hydrocarbon bond having 1 to 4 valences, which has a charge transport molecular structure; and n represents an integer of from 1 to 4.

4. The electrostatic latent image bearing member according to claim 1, wherein X results from a charge transport molecular structure having the following formula (3):

(3)

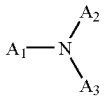

wherein at least one of $A_1$, $A_2$, and $A_3$ is bound to Y, wherein any one of which bound to Y represents a substituted or unsubstituted arylene group, aralkylene group, or alkylene group, and the others each, independently, represent a substituted or unsubstituted aryl group, aralkyl group, or alkyl group.

5. The electrostatic latent image bearing member according to claim 1, wherein X results from a charge transport molecular structure having the following formula (4):

(4)

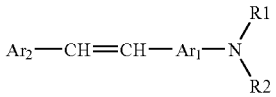

wherein at least one of $R_1$, $R_2$, and $Ar_2$ is bound to Y, wherein any one of which bound to Y represents a substituted or unsubstituted arylene group, aralkylene group, or alkylene group, and the others each, independently, represent a substituted or unsubstituted aryl group, aralkyl group, or alkyl group; and $Ar_1$ represents a substituted or unsubstituted arylene group.

6. The electrostatic latent image bearing member according to claim 1, wherein X results from a charge transport molecular structure having the following formula (5):

(5)

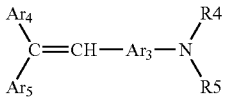

wherein at least one of $Ar_4$, $Ar_5$, $R_4$, and $R_5$ is bound to Y, wherein any one of which bound to Y represents a substituted or unsubstituted arylene group, aralkylene group, or alkylene group, and the others each, independently, represent a substituted or unsubstituted aryl group, aralkyl group, or alkyl group; and $Ar_3$ represents a substituted or unsubstituted arylene group.

7. The electrostatic latent image bearing member according to claim 1, wherein X results from a charge transport molecular structure having the following formula (6):

(6)

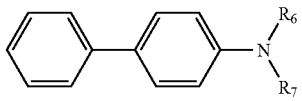

wherein at least one of biphenylyl, $R_6$, and $R_7$ is bound to Y; when $R_6$ or $R_7$ is bound to Y, any one of $R_6$ and $R_7$ bound to Y represents a substituted or unsubstituted arylene group, aralkylene group, or alkylene group, and the other, independently, represents a substituted or unsubstituted aryl group, aralkyl group, or alkyl group; and when biphenylyl is bound to Y, biphenylyl represents a biphenylidene group, and $R_6$ and $R_7$ each, independently, represent a substituted or unsubstituted aryl group, aralkyl group, or alkyl group.

8. The electrostatic latent image bearing member according to claim 1, wherein X results from a charge transport molecular structure having the following formula (7):

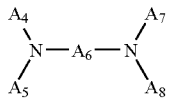

(7)

wherein at least one of $A_4$, $A_5$, $A_7$, and $A_8$ is bound to Y, and any one of which bound to Y represents a substituted or unsubstituted arylene group, aralkylene group, or alkylene group, and the others each, independently, represent a substituted or unsubstituted aryl group, aralkyl group, or alkyl group; and $A_6$ represents a substituted or unsubstituted arylene group.

9. The electrostatic latent image bearing member according to claim 1, wherein the isocyanate compound includes at least three NCO groups per molecule.

10. The electrostatic latent image bearing member according to claim 1, wherein the cross-linked resin is formed from a cross-linking reaction of (a) a polyol having no charge transport molecular structure and (b) the charge transport polyol having the formula (1) with (c) the isocyanate compound.

11. The electrostatic latent image bearing member according to claim 10, wherein the polyol having no charge transport molecular structure has a ratio of a molecular weight to a number of the hydroxyl group (i.e., an OH equivalent) of not less than 30 and less than 150.

12. The electrostatic latent image bearing member according to claim 1, further comprising a protective layer located overlying the photosensitive layer, wherein the protective layer is the outermost layer.

13. An image forming apparatus, comprising:

one or more image forming units each comprising:

an electrostatic latent image bearing member;

an electrostatic latent image forming means for forming an electrostatic latent image on the electrostatic latent image bearing member; and a developing means for developing the electrostatic latent image with a toner to form a toner image;

a transfer means for transferring the toner image onto a recording medium; and a fixing means for fixing the transferred toner image onto the recording medium, wherein the electrostatic latent image bearing member is the electrostatic latent image bearing member according to claim 1.

14. The image forming apparatus according to claim 13, further comprising a cleaning means for removing residual toner particles remaining on a surface of the electrostatic latent image bearing member.

15. The image forming apparatus according to claim 13, wherein the electrostatic latent image forming means comprises:

a charger located in contact with or close to the electrostatic latent image bearing member; and a light irradiator, wherein the charger applies a DC voltage overlapped with an AC voltage to the electrostatic latent image bearing member.

16. The image forming apparatus according to claim 15, further comprising a means for forming a gap between the electrostatic latent image bearing member and the charger, wherein the charger is a charging roller.

17. The image forming apparatus according to claim 13, further comprising an applicator configured to apply a lubricant to the surface of the electrostatic latent image bearing member.

18. The image forming apparatus according to claim 17, wherein the lubricant is a metal soap.

19. An image forming method, comprising:

forming an electrostatic latent image on an electrostatic latent image bearing member;

developing the electrostatic latent image with a toner to form a toner image;

transferring the toner image onto a recording medium; and fixing the toner image onto the recording medium, wherein the electrostatic latent image bearing member is the electrostatic latent image bearing member according to claim 1.

20. A process cartridge, comprising:

the electrostatic latent image bearing member according to claim 1; and at least one of an electrostatic latent image forming means, a light irradiating means, a developing means, a transfer means, and a cleaning means.

* * * * *